US009202442B2

(12) United States Patent
Furihata et al.

(10) Patent No.: US 9,202,442 B2
(45) Date of Patent: Dec. 1, 2015

(54) DISPLAY AND DISPLAY CONTROL CIRCUIT

(75) Inventors: Hirobumi Furihata, Kanagawa (JP); Takashi Nose, Kanagawa (JP); Yoshihiko Hori, Kanagawa (JP)

(73) Assignee: RENESAS ELECTRONICS CORPORATION, Tokyo (JP)

( * ) Notice: Subject to any disclaimer, the term of this patent is extended or adjusted under 35 U.S.C. 154(b) by 383 days.

(21) Appl. No.: 13/489,845

(22) Filed: Jun. 6, 2012

(65) Prior Publication Data

US 2013/0002618 A1 Jan. 3, 2013

(30) Foreign Application Priority Data

Jun. 29, 2011 (JP) ..... 2011-144837

(51) Int. Cl.
*G06F 3/038* (2013.01)
*G09G 5/36* (2006.01)

(52) U.S. Cl.
CPC ..... *G09G 5/363* (2013.01); *G09G 2320/0252* (2013.01); *G09G 2330/06* (2013.01); *G09G 2340/02* (2013.01)

(58) Field of Classification Search
CPC ..... G06F 3/038; G09G 5/363; G09G 2320/0252; G09G 2340/04
USPC ..... 345/204
See application file for complete search history.

(56) References Cited

U.S. PATENT DOCUMENTS 7,660,010 B2 2/2010 Furihata et al.
7,724,971 B2 * 5/2010 Huang et al. ..... 382/236
8,699,803 B2 * 4/2014 Katayama et al. ..... 382/233
2006/0152463 A1 * 7/2006 Furihata et al. ..... 345/98
2006/0164365 A1 * 7/2006 Huang et al. ..... 345/98
2009/0021499 A1 * 1/2009 Chen et al. ..... 345/204

(Continued)

FOREIGN PATENT DOCUMENTS

CN 1804987 A 7/2006
JP 11-065535 A 3/1999

(Continued)

OTHER PUBLICATIONS

Notification of Reasons for Refusal Japanese Patent Application No. 2011-144837 dated Jan. 6, 2015 with full English translation.
Notification of First Office Action Chinese Patent Application No. 201210225466.2 dated Jul. 14, 2015 with English translation.

*Primary Examiner* — Allison Johnson
*Assistant Examiner* — Afroza Chowdhury
(74) *Attorney, Agent, or Firm* — McDermott Will & Emery LLP

(57) ABSTRACT

A display control circuit of a display performs generation of overdrive processed data and detection of a proper direction of overdriving from current frame uncompressed compressed data obtained by performing compression processing and uncompression processing on compressed data corresponding to image data of a current frame, and previous frame uncompressed compressed data obtained by performing the compression processing and the uncompression processing on image data of a previous frame, and generates post-correction overdrive processed data by correcting the overdrive processed data according to the detected proper direction. The display control circuit transmits post-correction compressed data obtained by compressing the post-correction overdrive processed data to a driver as transfer compressed data.

7 Claims, 33 Drawing Sheets

(56) References Cited

U.S. PATENT DOCUMENTS

| | | | | |
|---|---|---|---|---|
| 2009/0109211 | A1* | 4/2009 | Nose et al. | 345/214 |
| 2009/0225096 | A1* | 9/2009 | Yoshiga et al. | 345/545 |
| 2010/0164982 | A1* | 7/2010 | Lu | 345/604 |
| 2010/0295872 | A1* | 11/2010 | Uchida et al. | 345/660 |
| 2010/0315406 | A1* | 12/2010 | Nose et al. | 345/212 |
| 2011/0148844 | A1* | 6/2011 | Furihata et al. | 345/211 |
| 2011/0206290 | A1* | 8/2011 | Katayama et al. | 382/250 |
| 2011/0243465 | A1* | 10/2011 | Lin et al. | 382/233 |

FOREIGN PATENT DOCUMENTS

| | | | |
|---|---|---|---|
| JP | 2006-195151 | A | 7/2006 |
| JP | 2008-281734 | | 11/2008 |
| JP | 2009-109835 | | 5/2009 |
| JP | 2009-151277 | A | 7/2009 |

* cited by examiner

FIG. 7

| | $R_A$ | $R_B$ | $R_C$ | $R_D$ | $G_A$ | $G_B$ | $G_C$ | $G_D$ | $B_A$ | $B_B$ | $B_C$ | $B_D$ |
|---|---|---|---|---|---|---|---|---|---|---|---|---|
| PREVIOUS FRAME UNCOMPRESSED COMPRESSED DATA | 10 | 10 | 10 | 10 | 100 | 100 | 100 | 100 | 15 | 15 | 15 | 15 |
| CURRENT FRAME UNCOMPRESSED COMPRESSED DATA | 11 | 11 | 11 | 11 | 100 | 100 | 100 | 100 | 16 | 16 | 16 | 16 |
| NO-CORRECTION OVERDRIVE PROCESSED DATA | 11 | 11 | 11 | 11 | 100 | 100 | 100 | 100 | 16 | 16 | 16 | 16 |

FIG. 15A

| | R | G | B |
|---|---|---|---|
| A | 10 | 5 | 15 |
| B | 10 | 5 | 15 |
| C | 10 | 5 | 15 |
| D | 10 | 5 | 15 |

FIG. 15B

| | R | G | B |
|---|---|---|---|
| A | 50 | 50 | 50 |
| B | 200 | 200 | 200 |
| C | 100 | 100 | 100 |
| D | 10 | 10 | 10 |

FIG. 15C

| | R | G | B |
|---|---|---|---|
| A | 50 | 5 | 5 |
| B | 200 | 5 | 5 |
| C | 100 | 5 | 5 |
| D | 10 | 5 | 5 |

FIG. 15D

| | R | G | B |
|---|---|---|---|
| A | 5 | 5 | 5 |
| B | 5 | 200 | 5 |
| C | 5 | 100 | 5 |
| D | 5 | 10 | 5 |

FIG. 15E

| | R | G | B |
|---|---|---|---|
| A | 5 | 5 | 50 |
| B | 5 | 5 | 200 |
| C | 5 | 5 | 100 |
| D | 5 | 5 | 10 |

FIG. 15F

| | R | G | B |
|---|---|---|---|
| A | 50 | 5 | 50 |
| B | 200 | 5 | 200 |
| C | 100 | 5 | 100 |
| D | 10 | 5 | 10 |

FIG. 15G

| | R | G | B |
|---|---|---|---|
| A | 50 | 50 | 5 |
| B | 200 | 200 | 5 |
| C | 100 | 100 | 5 |
| D | 10 | 10 | 5 |

FIG. 15H

| | R | G | B |
|---|---|---|---|
| A | 5 | 5 | 5 |
| B | 5 | 200 | 200 |
| C | 5 | 100 | 100 |
| D | 5 | 10 | 10 |

FIG. 18

(1×4) PIXEL COMPRESSION

<ORIGINAL IMAGE DATA>

| | R | G | B | α |
|---|---|---|---|---|
| A | 50 | 1 | 30 | 0 |
| B | 51 | 100 | 39 | 5 |
| C | 4 | 4 | 100 | 10 |
| D | 100 | 1 | 2 | 15 |

α IS ADDED →

| | R | G | B |
|---|---|---|---|
| A | 50 | 1 | 30 |
| B | 56 | 105 | 44 |
| C | 14 | 14 | 110 |
| D | 115 | 16 | 17 |

ROUNDING →

<COMPRESSED DATA>

| | R | G | B |
|---|---|---|---|
| A | 3 | 0 | 2 |
| B | 4 | 7 | 3 |
| C | 1 | 1 | 7 |
| D | 7 | 1 | 1 |

ROUNDING: ONLY B SUBPIXEL OF PIXEL D IS ADDED 16, AND IS ROUNDED DOWN BYFIVE BITS OTHER SUBPIXELS ARE ADDED 8, AND IS ROUNDED DOWN BY FOUR BITS, RESPECTIVELY

FIG. 19

(1×4) PIXEL UNCOMPRESSION

<COMPRESSED DATA>

| | R | G | B |
|---|---|---|---|
| A | 3 | 0 | 2 |
| B | 4 | 7 | 3 |
| C | 1 | 1 | 7 |
| D | 7 | 1 | 1 |

BIT CARRY →

| | R | G | B |
|---|---|---|---|
| A | 48 | 0 | 32 |
| B | 64 | 112 | 48 |
| C | 16 | 16 | 112 |
| D | 112 | 16 | 32 |

α IS SUBTRACTED →

<UNCOMPRESSED DATA>

| | R | G | B |
|---|---|---|---|
| A | 48 | 0 | 32 |
| B | 59 | 107 | 43 |
| C | 6 | 6 | 102 |
| D | 97 | 1 | 17 |

(8 bits/sub-pixel)

BIT CARRY: ONLY B SUBPIXEL OF PIXEL D IS CARRIED BY FIVE BITS
OTHER SUBPIXELS ARE CARRIED BY FOUR BITS

FIG. 21

(2+1×2) PIXEL COMPRESSION

<ORIGINAL IMAGE DATA>

| | R | G | B |
|---|---|---|---|
| A | 50 | 2 | 30 |
| B | 59 | 1 | 39 |
| C | 4 | 4 | 100 |
| D | 100 | 1 | 2 |

PIXELS A, B: HIGH CORRELATION

| | R | G | B |
|---|---|---|---|
| A | 50 | 2 | 30 |
| B | 59 | 1 | 39 |

↓ ↓ ↓

| | | | |
|---|---|---|---|
| (A+B+1)/2 | 55 | 2 | 35 |
| COMPARISON WITH $\beta$ | LARGE | SMALL | – |
| WHICH IS LARGER | B | – | – |

α IS ADDED →

| R | G | B |
|---|---|---|
| 55 | 2 | 35 |

ROUNDING/ ROUND-DOWN PROCESSING →

REPRE-SENTATIVE VALUE

<COMPRESSED DATA>

| R | G | B |
|---|---|---|
| 7 | 1 | 4 |

| | R | G | B |
|---|---|---|---|
| C | 4 | 4 | 100 |
| D | 100 | 1 | 2 |

α IS ADDED →

| | R | G | B |
|---|---|---|---|
| C | 14 | 14 | 110 |
| D | 115 | 16 | 17 |

ROUNDING/ ROUND-DOWN PROCESSING →

| | R | G | B |
|---|---|---|---|
| C | 1 | 1 | 7 |
| D | 7 | 1 | 1 |

FIG. 24

(2×2) PIXEL COMPRESSION

<ORIGINAL IMAGE DATA>

| | R | G | B |
|---|---|---|---|
| A | 50 | 2 | 30 |
| B | 59 | 1 | 39 |
| C | 100 | 80 | 8 |
| D | 100 | 85 | 2 |

PIXELS A, B: HIGH CORRELATION
PIXELS C, D: HIGH CORRELATION

| | R | G | B |
|---|---|---|---|
| A | 50 | 2 | 30 |
| B | 59 | 1 | 39 |

| | R | G | B |
|---|---|---|---|
| (A+B+1)/2 | 55 | 2 | 35 |
| COMPARISON WITH β | LARGE | SMALL | LARGE |
| WHICH IS LARGER | B | – | B |

α IS ADDED →

| R | G | B |
|---|---|---|
| 55 | 2 | 35 |

ROUNDING/ ROUND-DOWN PROCESSING →

REPRE-SENTATIVE VALUE #1

<COMPRESSED DATA (A, B)>

| R | G | B |
|---|---|---|
| 7 | 1 | 4 |

| | R | G | B |
|---|---|---|---|
| C | 100 | 80 | 8 |
| D | 100 | 85 | 2 |

| | R | G | B |
|---|---|---|---|
| (C+D+1)/2 | 100 | 83 | 5 |
| COMPARISON WITH β | SMALL | LARGE | LARGE |
| WHICH IS LARGER | – | D | C |

α IS ADDED →

| R | G | B |
|---|---|---|
| 110 | 93 | 15 |

ROUNDING/ ROUND-DOWN PROCESSING →

REPRE-SENTATIVE VALUE #2

<COMPRESSED DATA (C, D)>

| R | G | B |
|---|---|---|
| 28 | 23 | 2 |

FIG. 25

(2×2) PIXEL UNCOMPRESSION

<COMPRESSED DATA (A, B)>

| | R | G | B |
|---|---|---|---|
| REPRESENTATIVE VALUE #1 | 7 | 1 | 4 |
| COMPARISON WITH $\beta$ | LARGE | SMALL | LARGE |
| WHICH IS LARGER | B | – | B |

BIT CARRY →

| | R | G | B |
|---|---|---|---|
| | 56 | 4 | 32 |
| COMPARISON WITH $\beta$ | LARGE | SMALL | LARGE |
| WHICH IS LARGER | B | – | B |

$\alpha$ IS SUBTRACTED →

| | R | G | B |
|---|---|---|---|
| | 56 | 4 | 32 |
| COMPARISON WITH $\beta$ | LARGE | SMALL | LARGE |
| WHICH IS LARGER | B | – | B |

±5 ACCORDING TO SIZE OF A, B →

<UNCOMPRESSED DATA (A, B)>

| | R | G | B |
|---|---|---|---|
| A | 51 | 4 | 27 |
| B | 61 | 4 | 37 |

<COMPRESSED DATA (C, D)>

| | R | G | B |
|---|---|---|---|
| REPRESENTATIVE VALUE #2 | 28 | 23 | 2 |
| COMPARISON WITH $\beta$ | SMALL | LARGE | LARGE |
| WHICH IS LARGER | – | D | C |

BIT CARRY →

| | R | G | B |
|---|---|---|---|
| | 112 | 92 | 16 |
| COMPARISON WITH $\beta$ | SMALL | LARGE | LARGE |
| WHICH IS LARGER | SMALL | D | C |

$\alpha$ IS SUBTRACTED →

| | R | G | B |
|---|---|---|---|
| | 102 | 82 | 6 |
| COMPARISON WITH $\beta$ | SMALL | LARGE | LARGE |
| WHICH IS LARGER | – | D | C |

±5 ACCORDING TO SIZE OF C, D →

<UNCOMPRESSED DATA (C, D)>

| | R | G | B |
|---|---|---|---|
| C | 102 | 77 | 11 |
| D | 102 | 87 | 1 |

TOTAL 48 bits
(COMPRESSION RATIO 50%)

FIG. 30

(4×1) PIXEL COMPRESSION

<ORIGINAL IMAGE DATA>

| | R | G | B |
|---|---|---|---|
| A | 10 | 12 | 14 |
| B | 6 | 7 | 8 |
| C | 5 | 4 | 3 |
| D | 0 | 1 | 2 |

(8 bits/sub-pixel)

MATRIX OPERATION →

| | Y | Cb | Cr |
|---|---|---|---|
| A | 48 | 2 | −2 |
| B | 28 | 1 | −1 |
| C | 16 | −1 | 1 |
| D | 4 | 1 | −1 |

→

DO ARITHMETIC OPERATION OF Ymin, Ydist0, Ydist1, Ydist2, Cb', AND Cr'

FIG. 31

(4×1) PIXEL UNCOMPRESSION

RESTORATION OF $Y_A$ TO $Y_D$ →

| | Y | Cb' | Cr' |
|---|---|---|---|
| A | 48 | 1 | −1 |
| B | 28 | 1 | −1 |
| C | 16 | 1 | −1 |
| D | 4 | 1 | −1 |

MATRIX OPERATION →

<UNCOMPRESSED DATA>

| | R | G | B |
|---|---|---|---|
| A | 11 | 12 | 13 |
| B | 6 | 7 | 8 |
| C | 3 | 4 | 5 |
| D | 0 | 1 | 2 |

(8 bits/sub-pixel)

| | | X1X0 | | | |
|---|---|---|---|---|---|
| | | 00 | 01 | 10 | 11 |
| Y1Y0 | 00 | 15 | 05 | 01 | 11 |
| | 01 | 00 | 10 | 14 | 04 |
| | 10 | 07 | 09 | 13 | 02 |
| | 11 | 08 | 06 | 03 | 12 |

DISPLAY AND DISPLAY CONTROL CIRCUIT

CROSS-REFERENCE TO RELATED APPLICATIONS

The disclosure of Japanese Patent Application No. 2011-144837 filed on Jun. 29, 2011 including the specification, drawings, and abstract is incorporated herein by reference in its entirety.

BACKGROUND

The present invention relates to a display and a display control circuit and, more specifically, to a display configured to perform overdrive processing on image data and a display control circuit.

One of problems in the display in recent years is an increase of transfer volume of the image data to a display panel driver for driving the display panel. For example, in liquid crystal displays in recent years, since resolution has improved and the frame rate has increased by adoption of double-speed driving (for example, the double speed to the quad speed), it is necessary to transfer a lot of image data to the display panel driver. In order to transfer the lot of image data, necessity of increasing a data transfer rate rises. However, if the data transfer rate is increased in order to transfer a lot of image data, there will arise problems that power consumption will increase and EMI (electromagnetic interference) will also increase.

In order to cope with the problem of the increase of the transfer volume of image data, the inventors are examining reducing the data transfer volume by transferring the image data after compressing it. Since this enables the data transfer rate to be made small, it becomes easy to reduce the power consumption and to do EMI measure.

One of other problems in the display is to make fast driving pixels of the display panel. For example, in the liquid crystal display in recent years, a load capacity of the liquid crystal display panel has become large by enlargement and higher resolution of the display. On the other hand, a frame rate has increased due to adoption of double-speed driving, and a time given to charge data lines of the liquid crystal display panel has shortened. For this reason, a technology of driving the pixels at high speed is being required.

One of the technologies for accelerating the driving of the pixels is overdriving. The overdriving is a technology of, when there is a change in the gradation value of the image data, driving the pixel so that a change in the drive voltage may become larger than an original change in the gradation value of the image data. Thereby, a response speed of the display panel can be raised.

One technique of realizing the overdriving is correcting the gradation value of the image data by data processing. Specifically, with reference to the gradation value of the image data of the previous frame, the gradation value of the original image data is corrected so that when the gradation value of the image data increases to be larger than that of the previous frame, the gradation value may become larger, and that when it decrease, the gradation value may become smaller. Hereinafter, such processing is called the overdrive processing.

The inventors consider that there is a technical advantage in providing a display corresponding to both the overdrive processing and compression processing. However, according to the inventors' finding, when the technology of transferring the image data after compressing it and the overdrive processing are used together, there may arise the following problems. The first problem is that when the overdrive processing and the compression processing are used together, the overdriving may be performed in an improper overdrive direction for each pixel due to an effect of a compression error. Here, the compression error is a difference between the gradation value obtained by uncompression processing and the original gradation value when the compression processing and the uncompression processing are performed on the original gradation value of the image data.

As shown in FIG. 1, when the compression processing and the uncompression processing are performed, a size relation between gradation values of the continuous two frames will be reversed to an original size relation, and therefore the overdrive direction may be set improperly. For example, suppose that the gradation values of specific subpixels of specific pixels of continuous three frames (here, they are termed as the first, the second, and the third frames) are 100, 124, and 120. In this case, originally, the gradation value of the second frame must be larger than the gradation value of the first frame and the gradation value of the third frame must be smaller than the gradation value of the second frame. However, if the compression error is in a range of ±4, this relation will collapse in the worst case. For example, if the gradation values after the compression processing and the uncompression processing become 104, 120, and 124, respectively, the gradation value of the third frame will become larger than the gradation value of the second frame. This means that the overdriving is done in an improper direction.

The second problem is that as shown in FIG. 2, the overdriving may be performed due to an effect of the gradation values of the surrounding pixels depending on the compression processing, although the overdriving is originally unnecessary. For example, let it be assumed that the gradation values of specific subpixels of the specific pixel take a constant value of 100 ideally among three frames. However, if the compression error arises due to an effect of gradation values of the surrounding pixels, unnecessary overdriving may be performed. For example, even when the gradation value after the overdrive processing is a constant value of 100 for a period of three frames, if the compression error is in a range of ±4, the gradation value after the compression processing and the uncompression processing will become 96, 104, and 96, which will be able to cause the overdriving to take place improperly. It is desired that these problems should be dissolved.

An image processing technology that performs both the overdrive processing and the compression processing is disclosed, for example, by Japanese Unexamined Patent Publication No. 2008-281734. In this technology, in order to make small a capacity of memory for storing the image data of the previous frame, the compressed data obtained by compressing the image data of the previous frame is stored in the memory. The image data obtained by uncompressing the compressed data stored in the memory is used for the overdrive processing. Furthermore, in order to reduce an influence of the error by the compression, the compression processing and the uncompression processing are performed also on the image data of the current frame, and the image data obtained as its result is used for the overdrive processing.

Furthermore, Japanese Patent Unexamined Application Publication No. 2009-109835 discloses a technology of performing the overdrive processing and also performing the compression processing on the image data of the current frame read from the memory for display and storing it in memory for overdrive.

However, in these technologies, it should be noted that the compression processing is performed in order to reduce a capacity of memory used for the overdrive processing. In other words, in these technologies, the compression processing must be performed before the overdrive processing. These two patent documents do not suggest a technology of transferring the compressed data obtained by performing the compression processing after performing the overdrive processing on the transmission side to the reception side, i.e., the display panel driver.

SUMMARY

An object of the present invention is therefore to realize a technology of preventing overdriving from being performed improperly originating in a compression error in the display that is configured to transfer the image data to the driver after compressing it and performs the overdriving.

According to one aspect of the present invention, the display includes a display panel, the driver, and a display control circuit for supplying transfer compressed data generated from the image data to the driver. The display control circuit has: a first uncompression circuit for generating current frame uncompressed compressed data by performing uncompression processing on the compressed data corresponding to the image data of a current frame; a second uncompression circuit for generating previous frame uncompressed compressed data by performing the uncompression processing on the compressed data corresponding to the image data of a previous frame; an overdrive processing part for generating overdrive processed data by performing overdrive based on the current frame uncompressed compressed data and the previous frame uncompressed compressed data; an overdrive direction detection circuit for detecting a proper direction of the overdriving from the current frame uncompressed compressed data and the previous frame uncompressed compressed data; a correction part for generating post-correction overdrive processed data by correcting the overdrive processed data according to the detected proper direction; a first compression circuit for generating post-correction compressed data by compressing the post-correction overdrive processed data; and a transmission part for supporting an operation of transmitting the post-correction compressed data as the transfer compressed data to the driver. Responding to the display data obtained by uncompressing the transfer compressed data, the driver drives the display panel.

According to another aspect of the present invention, a display control circuit that supplies transfer compressed data generated from the image data to the driver for driving the display panel in response to the display data obtained by uncompressing the transfer compressed data is provided. The display control circuit has: a first uncompression circuit for generating the current frame uncompressed compressed data by performing the uncompression processing on the compressed data corresponding to the image data of the current frame; a second uncompression circuit for generating the previous frame uncompressed compressed data by performing the uncompression processing on the compressed data corresponding to the image data of the previous frame; the overdrive processing part for generating the overdrive processed data by performing the overdrive processing based on the current frame uncompressed compressed data and the previous frame uncompressed compressed data; an overdrive direction detection circuit for detecting a proper direction of the overdriving from the current frame uncompressed compressed data and the previous frame uncompressed compressed data; a correction part for generating post-correction overdrive processed data by correcting the overdrive processed data according to the detected proper direction; a first compression circuit for generating the post-correction compressed data by compressing the post-correction overdrive processed data; and a transmission part for supporting an operation of transmitting the post-correction overdrive processed data as the transfer compressed data to the driver.

According to the aspects of the present invention, it is possible to realize a technology of preventing the overdriving from being performed improperly originating in the compression error in a display that is configured to transfer the image data to a display panel driver after compressing it and performs the overdriving.

BRIEF DESCRIPTION OF THE DRAWINGS

FIG. 7 is a table showing examples of contents of previous frame uncompressed compressed data and current frame uncompressed compressed data in the case of no overdrive processing, and the no-correction overdrive processed data;

FIG. 15A is a diagram showing an example of a specific pattern on which lossless compression is performed;

FIG. 15B is a diagram showing an example of a specific pattern on which the lossless compression is performed;

FIG. 15C is a diagram showing an example of a specific pattern on which the lossless compression is performed;

FIG. 15D is a diagram showing an example of a specific pattern on which the lossless compression is performed;

FIG. 15E is a diagram showing an example of a specific pattern on which the lossless compression is performed;

FIG. 15F is a diagram showing an example of a specific pattern on which the lossless compression is performed;

FIG. 15G is a diagram showing an example of a specific pattern on which the lossless compression is performed;

FIG. 15H is a diagram showing an example of a specific pattern on which the lossless compression is performed;

FIG. 18 is a conceptual diagram showing processing details of (1×4) pixel compression;

FIG. 19 is a conceptual diagram showing details of uncompression processing of the (1×4) compressed data;

FIG. 21 is a conceptual diagram showing processing details of (2+1×2) pixel compression;

FIG. 24 is a concept diagram showing processing details of (2×2) pixel compression;

FIG. 25 is a conceptual diagram explaining details of uncompression processing of the (2×2) compressed data;

FIG. 30 is a conceptual diagram showing processing details of (4×1) pixel compression;

FIG. 31 is a conceptual diagram showing details of uncompression processing of (4×1) compressed data;

DETAILED DESCRIPTION

First Embodiment

Figure 1:
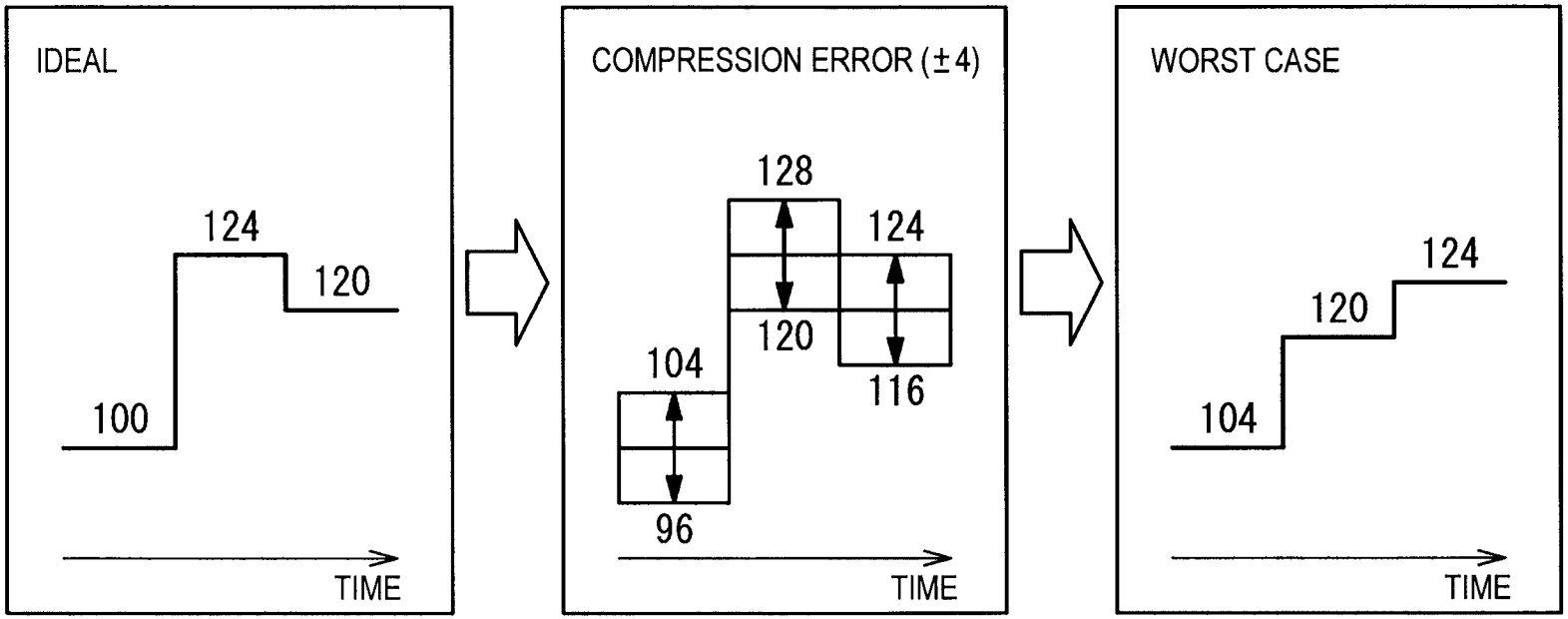
FIG. 1 is a conceptual diagram showing that overdriving may be performed in an improper direction due to a compression error.
Figure 2:
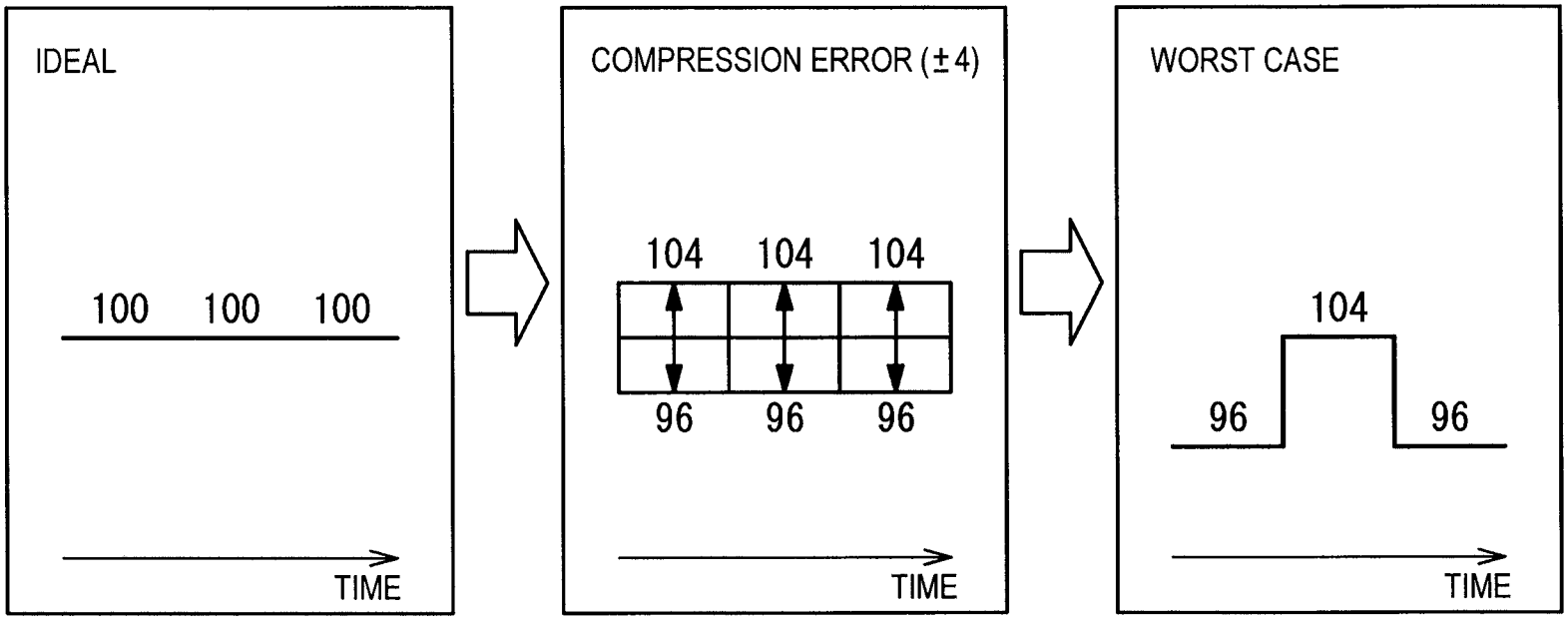
FIG. 2 is a conceptual diagram showing that unnecessary overdriving may be performed due to the compression error.
Figure 3:
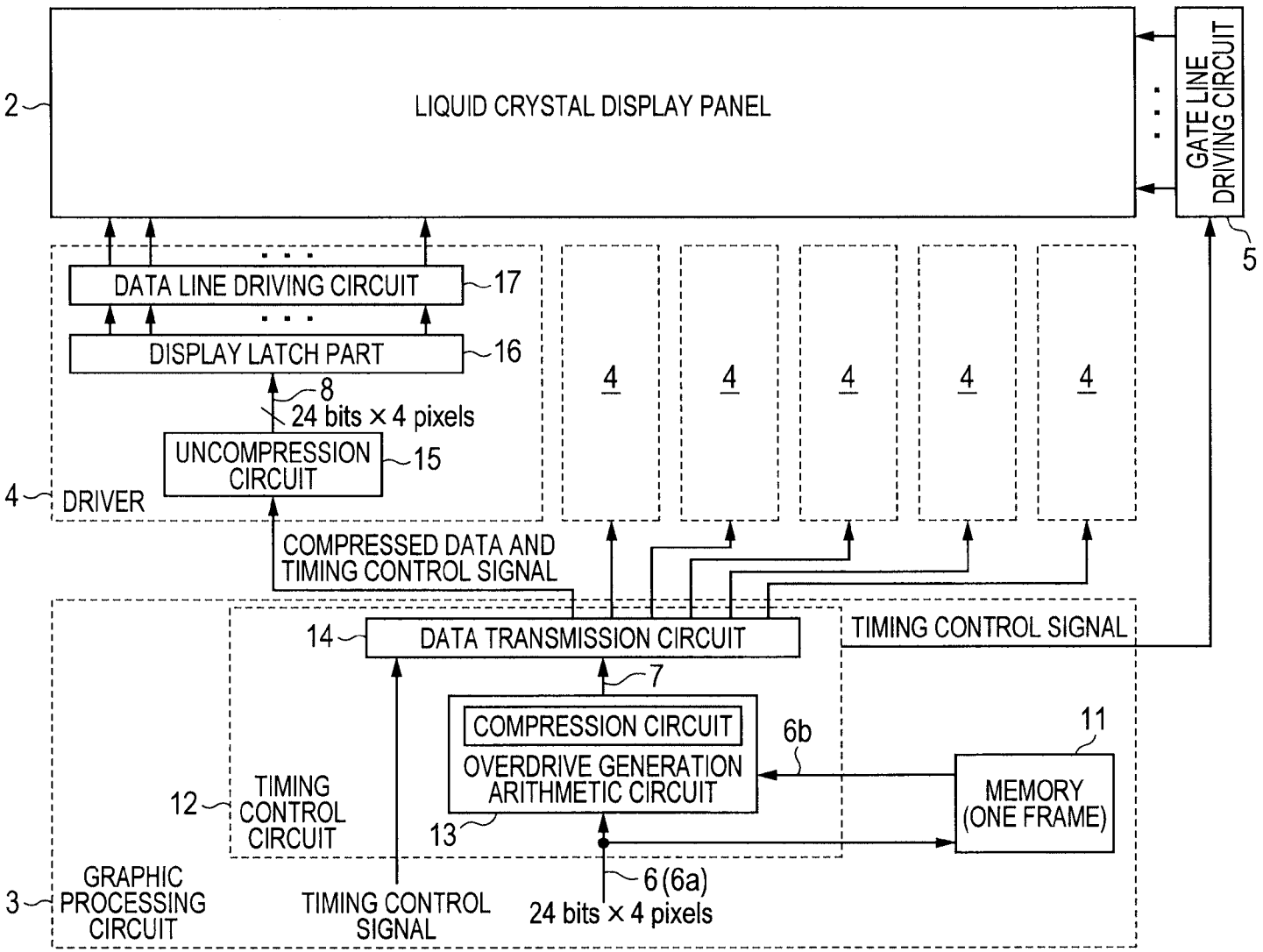
FIG. 3 is a block diagram showing a configuration of a liquid crystal display of a first embodiment of the present invention.

FIG. 3 is a block diagram showing a configuration of a liquid crystal display 1 of a first embodiment of the present invention. The liquid crystal display 1 is configured so as to display an image on a liquid crystal display panel 2 according to image data 6 transferred from the outside. Pixels, data lines (signal lines), and gate lines (scan lines) are arranged on the liquid crystal display panel 2. Each of the pixels is comprised of an R subpixel (a subpixel for displaying a red color), a G subpixel (a subpixel for displaying a green color), and a B subpixel (a subpixel for displaying a blue color), and the each subpixel is provided in a position where the corresponding data line and gate line intersect. Below, the pixels corresponding to the same gate line are called a pixel line.

In this embodiment, the image data 6 is supplied as data that represents gradations of the R subpixel, the G subpixel, and the B subpixel each in eight bits, i.e., data that represents the gradations of the respective pixels in 24 bits. However, the number of bits of the image data 6 is not limited to this. Moreover, the pixel is not limited to be comprised of the R subpixel, the G subpixel, and the B subpixel. For example, each pixel may additionally include a subpixel for representing a white color in addition to the R subpixel, the G subpixel, and the B subpixel, and may additionally include a subpixel for representing a yellow color. In this case, a format of the image data 6 is also changed to conform to the configuration of the pixel.

The liquid crystal display 1 includes a graphic processing circuit 3, a driver 4, and a gate line driving circuit 5. The driver 4 drives the data lines of the liquid crystal display panel 2, and the gate line driving circuit 5 drives the gate lines of the liquid crystal display panel 2. In this embodiment, the graphic processing circuit 3, the driver 4, and the gate line driving circuit 5 are mounted as separate ICs (integrated circuits). In this embodiment, multiple drivers 4 are provided in the liquid crystal display 1, and the image processing circuit 3 and the each driver 4 are Peer-to-Peer coupled with each other. Specifically, the graphic processing circuit 3 is coupled to each driver 4 through a serial signal line exclusive for the each driver 4. Data transfer between the graphic processing circuit 3 and the each driver 4 is performed by serial data transfer through the serial signal line. Although there may be generally considered an architecture of coupling a graphic processing circuit and a driver with a bus in the liquid crystal display having multiple drivers, the architecture of coupling the graphic processing circuit 3 and the each driver 4 by Peer-to-Peer connection like this embodiment is useful in a respect that a transfer rate required for data transfer between the graphic processing circuit 3 and the each driver 4 can be reduced.

The graphic processing circuit 3 includes memory 11 and a timing control circuit 12. The memory 11 is used in order to temporarily storing the image data used for overdrive processing. The memory 11 has a capacity of memorizing the image data of one frame, and is used in order to supply the image data of a frame (the previous frame) immediately before the object frame (the current frame) of the overdrive processing to the timing control circuit 12. Below, the image data 6 of the current frame supplied to the timing control circuit 12 from the outside may be called current frame data 6*a*, and the image data 6 of the previous frame supplied to the timing control circuit 12 from the memory 11 may be called previous frame data 6*b*.

Responding to a timing control signal supplied from the outside, the timing control circuit 12 controls the driver 4 and the gate line driving circuit 5 so that a desired image may be displayed on the liquid crystal display panel 2. In addition, the timing control circuit 12 is configured so that the overdrive generation arithmetic circuit 13 therein may perform the overdrive processing and compression processing. The overdrive generation arithmetic circuit 13 performs the overdrive processing while referring to the previous frame data 6*b* stored in the memory 11 to the current frame data 6*a*, and further performs the compression processing on the data obtained by the overdrive processing to generate compressed data 7. The generated compressed data 7 is sent to each driver 4 by a data transmission circuit 14. The data transmission circuit 14 further has a function of sending timing control data to the each driver 4.

The driver 4 drives the data lines of the liquid crystal display panel 2 in response to the compressed data 7 and the timing control data that are received. In detail, the driver 4 includes an uncompression circuit 15, a display latch part 16, and a data line driving circuit 17. The uncompression circuit 15 uncompresses the received compressed data 7 to generate display data 8, and transfers the generated display data 8 sequentially to the display latch part 16. Here, the display latch part 16 latches the display data 8 received from the uncompression circuit 15 sequentially. The display latch part 16 of the each driver 4 stores the display data 8 of a pixel corresponding to the driver 4 of the pixels in one pixel line. Responding to the display data 8 latched by the display latch part 16, the data line driving circuit 17 drives the data lines. In each horizontal synchronization period, in response to the display data 8 stored in the display latch part 16, the data line corresponding to each of the display data is driven. Incidentally, although only the configuration of the one driver 4 is illustrated in FIG. 3, it should be noted that the other drivers 4 are configured similarly.

Here, it should be noted that in this embodiment, the memory 11 is provided on the transmission side, i.e., in the graphic processing circuit 3. Such a configuration is suitable in order to reduce the hardware as the whole of the liquid crystal display 1. The graphic processing circuit 3 may uses frame memory for various image processing, and the memory 11 for the overdrive processing can be used also as the frame memory for other image processing. On the other hand, providing the memory 11 on the transmission side negates the need for memory in the driver 4. It is suitable for reduction in the hardware that pieces of memory become unnecessary in multiple drivers 4 that exist.

Figure 4:
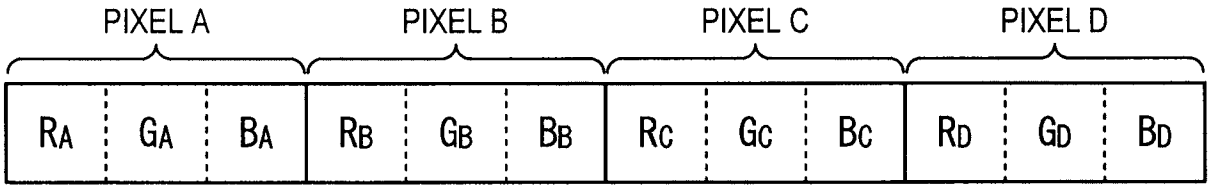
FIG. 4 is a diagram showing an arrangement of pixels in a block that serves one unit of compression processing in this embodiment.

Below, a configuration and an operation of the overdrive generation arithmetic circuit 13 of the timing control circuit 12 will be explained. In this embodiment, the overdrive generation arithmetic circuit 13 performs the overdrive processing and the compression processing by handling a block comprised of four pixels belonging to the same pixel line as a unit. FIG. 4 is a diagram showing an arrangement of the four pixels in the each block. Below, the four pixels included in the each block may be called a pixel A, a pixel B, a pixel C, and a pixel D, respectively. Each of pixels A to D has an R subpixel, a G subpixel, and a B subpixel. The R subpixel, the G subpixel, and the B subpixel of the pixel A are referred to by symbols $R_A$, $G_A$, and $B_A$, respectively. This reference is the same for the pixels B to D. In this embodiment, the subpixels $R_A$, $G_A$, $B_A$, $R_B$, $G_B$, $B_B$, $R_C$, $G_C$, $B_C$, $R_D$, $G_D$, and $B_D$ of the four pixels of each block are located on the same pixel line, and are coupled to the same gate line. In the following explanation, the block that has become an object of the overdrive processing and the compression processing may be called an object block.

Figure 5:
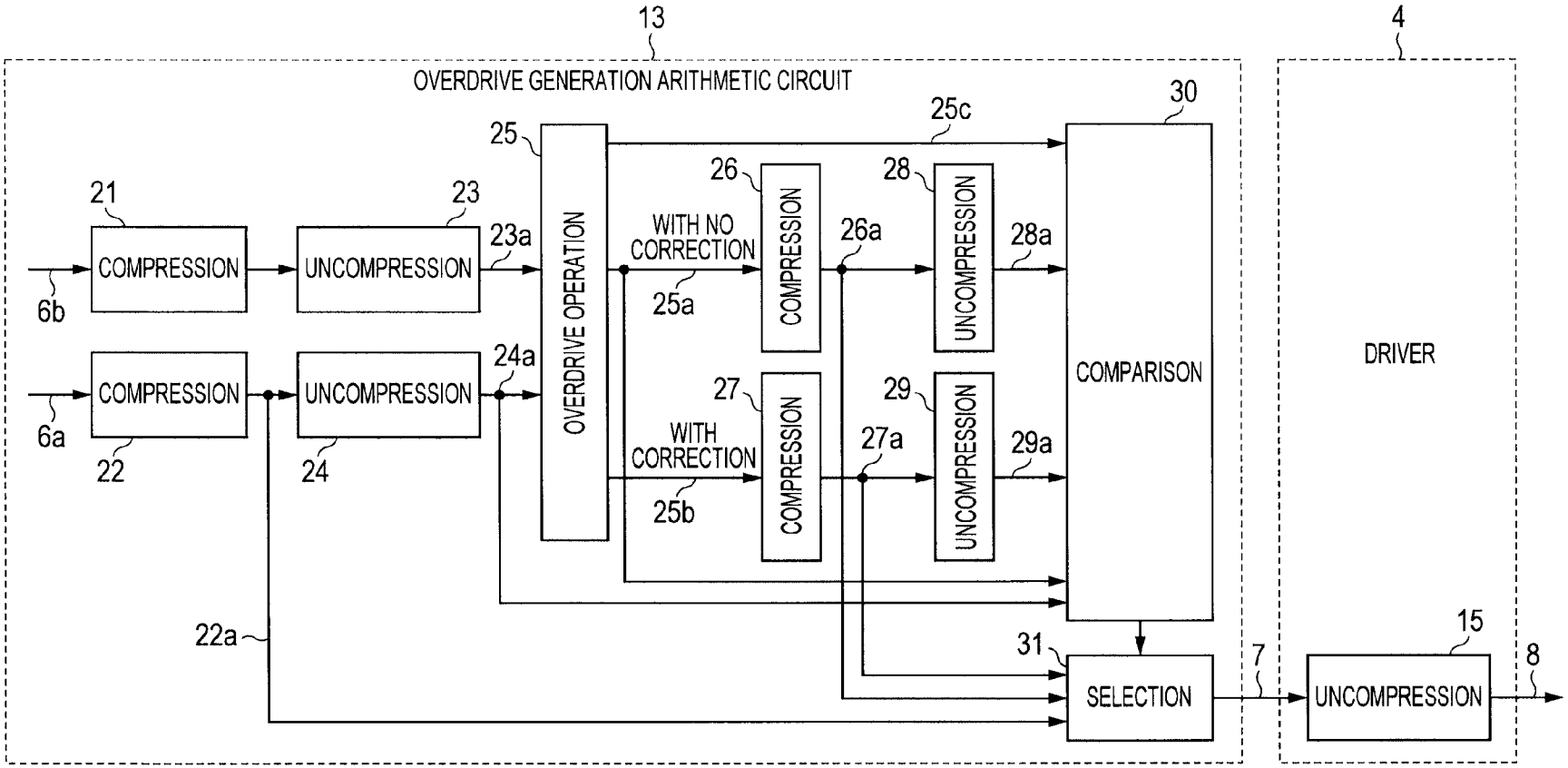
FIG. 5 is a block diagram showing a configuration of an overdrive generation arithmetic circuit in the first embodiment.

FIG. 5 is a block diagram showing a configuration of the overdrive generation arithmetic circuit 13. The overdrive generation arithmetic circuit 13 includes compression circuits 21, 22, uncompression circuits 23, 24, an overdrive arithmetic circuit 25, compression circuits 26, 27, uncompression circuits 28, 29, a comparison circuit 30, and a selection circuit 31.

The compression circuits 21, 22 perform the compression processing on the previous frame data 6*b* and the current frame data 6*a*, respectively. The uncompression circuits 23, 24 perform uncompression processing on the compressed data outputted from the compression circuits 21, 22. Here, the data outputted from the uncompression circuits 23, 24 is called previous frame uncompressed compressed data 23*a* and current frame uncompressed compressed data 24*a*, respectively. Here, it should be noted that the compression circuits 21, 22 and the uncompression circuits 23, 24 perform the compression processing and the uncompression processing by using the block comprised of four pixels as a unit, respectively.

The overdrive arithmetic circuit 25 performs the overdrive processing on the previous frame uncompressed compressed data 23*a* and the current frame uncompressed compressed data 24*a*. What should be noted is that the overdrive arithmetic circuit 25 performs the overdrive processing on the previous frame uncompressed compressed data 23*a* and the current frame uncompressed compressed data 24*a* that are obtained by performing the compression processing and the uncompression processing. As will be described later, it is possible to avoid the overdrive processing whose overdrive direction is improper from being performed due to an effect of a compression error by deciding the overdrive direction based on the previous frame uncompressed compressed data 23*a* and the current frame uncompressed compressed data 24*a* that are obtained by performing the compression processing and the uncompression processing on the previous frame data 6*b* and the current frame data 6*a*, and by performing the overdrive processing so that the direction may be kept correctly.

Figure 6:
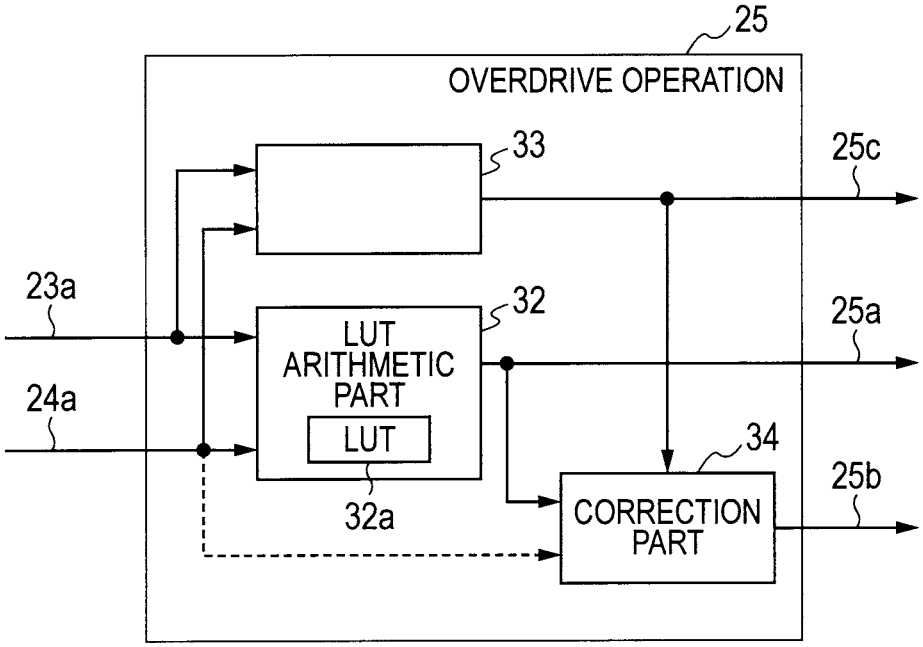
FIG. 6 is a block diagram showing a configuration of an overdrive arithmetic circuit in the first embodiment.

FIG. 6 is a block diagram showing an example of a configuration of the overdrive arithmetic circuit 25 in this embodiment. The overdrive arithmetic circuit 25 includes an LUT (lookup table) operation part 32, an overdrive direction detection part 33, and a correction part 34.

The LUT arithmetic part 32 functions as an overdrive processing unit that outputs the gradation values after the overdrive processing that corresponds to a combination of the gradation values of the previous frame uncompressed compressed data 23*a* and the current frame uncompressed compressed data 24*a* for each subpixel of each pixel of the object block. Here, the gradation value after the overdrive processing outputted from the LUT arithmetic part 32 is generically named the no-correction overdrive processed data 25*a*. Here, "no-correction" means that correction according to the overdrive direction described later is not performed. The LUT arithmetic part 32 includes an LUT 32*a* and an interpolation circuit (not illustrated) in one embodiment, and generates the no-correction overdrive processed data 25*a* by interpolating values obtained by table look-up according to a combination of the previous frame uncompressed compressed data 23*a* and the current frame uncompressed compressed data 24*a* with the interpolation circuit. The no-correction overdrive processed data 25*a* is generated so that optimal overdrive processing may be realized, that is, so that the drive voltage actually supplied to the data lines may be brought close to a desired drive voltage quickly. Incidentally, a generation method of the no-correction overdrive processed data 25*a* may be modified variously. For example, not using the LUT 32*a*, an arithmetic formula that uses the gradation values of the previous frame uncompressed compressed data 23*a* and the current frame uncompressed compressed data 24*a* as variables may be used to generate the no-correction overdrive processed data 25*a*.

The no-correction overdrive processed data 25*a* generated for a specific subpixel of a specific pixel of the object block satisfies the following conditions: (a) When the gradation value of the current frame uncompressed compressed data 24*a* is larger than a sum of the gradation value of the previous frame uncompressed compressed data 23*a* and a prescribed value $\alpha$, the gradation value of the no-correction overdrive processed data 25*a* is larger than the gradation value of the current frame uncompressed compressed data 24*a*. Here, the prescribed value $\alpha$ is an integer larger than or equal to zero. (b) When the gradation value of the current frame uncompressed compressed data 24*a* is smaller than a difference obtained by subtracting the prescribed value $\alpha$ from the gradation value of the previous frame uncompressed compressed data 23*a*, the gradation value of the no-correction overdrive processed data 25*a* is smaller than the gradation value of the current frame uncompressed compressed data 24*a*. Here, the prescribed value $\alpha$ is an integer larger than or equal to zero. (c)

When both of the above-mentioned conditions (a), (b) do not hold true, the gradation value of the no-correction overdrive processed data 25*a* is equal to the gradation value of the current frame uncompressed compressed data 24*a* (that is, overdriving is not performed). Here, it should be noted that the condition (c) with the prescribed value α equal to zero holds true only when the gradation value of the current frame uncompressed compressed data 24*a* is equal to the gradation value of the previous frame uncompressed compressed data 23*a*.

The overdrive direction detection part 33 detects a proper overdrive direction in the overdrive processing by comparing the previous frame uncompressed compressed data 23*a* and the current frame uncompressed compressed data 24*a*. The proper overdrive direction is detected for each subpixel of each pixel of the object block. When the gradation value of the current frame uncompressed compressed data 24*a* corresponding to a certain subpixel of a certain pixel of the object block is larger than or equal to the corresponding gradation value of the previous frame uncompressed compressed data 23*a* of the subpixel, the proper overdrive direction is detected as "positive"; when the value is smaller than it, the overdrive direction is detected as "negative." The overdrive direction detection part 33 outputs drive direction data 25*c* indicating the overdrive direction for each subpixel of each pixel of the object block.

The correction part 34 corrects the no-correction overdrive processed data 25*a* according to the drive direction data 25*c* to generate post-correction overdrive processed data 25*b*. This correction is performed so that, when the compressed data generated by the compression circuit 27 compressing the post-correction overdrive processed data 25*b* is uncompressed by the uncompression circuit 15 of the driver 4 to generate the display data 8, the overdrive direction detected by the overdrive direction detection part 33 may be maintained also in the display data 8. When the data line is driven in response to the display data 8 obtained by the uncompression processing by the uncompression circuit 15 of the driver 4, there is a possibility that the overdriving is performed in an opposite direction to the proper overdrive direction because of an effect of the compression error caused by the compression/uncompression processing. The correction part 34 generates the post-correction overdrive processed data 25*b* such that the overdrive direction detected by the overdrive direction detection part 33 in the display data 8 is maintained surely by adding or subtracting the gradation value of the no-correction overdrive processed data 25*a* according to the overdrive direction. Generation of the post-correction overdrive processed data 25*b* by the correction part 34 will be explained in detail later.

Returning to FIG. 5, the no-correction overdrive processed data 25*a* and the post-correction overdrive processed data 25*b* that are outputted from the overdrive arithmetic circuit 25 are supplied to the compression circuits 26, 27, respectively. The compression circuits 26, 27 perform the compression processing on the no-correction overdrive processed data 25*a* and the post-correction overdrive processed data 25*b*, respectively. Pieces of the compressed data outputted from the compression circuits 26, 27 are described as no-correction compressed data 26*a* and post-correction compressed data 27*a*, respectively.

The uncompression circuits 28, 29 perform the uncompression processing on the no-correction compressed data 26*a* and the post-correction compressed data 27*a*, respectively. Pieces of the data outputted from the uncompression circuits 28, 29 are described as no-correction uncompressed compressed data 28*a* and post-correction uncompressed compressed data 29*a*, respectively.

The comparison circuit 30 selects any of the following data as the compressed data 7 to be sent to the driver 4: the compressed data 22*a* outputted from the compression circuit 22 (that is, the compressed data that is not overdrive processed); and one of the no-correction compressed data 26*a* and the post-correction compressed data 27*a* that are outputted from the compression circuits 26, 27. This selection is performed based on the following data: (1) the current frame uncompressed compressed data 24*a* outputted from the uncompression circuit 24, (2) the no-correction uncompressed compressed data 28*a* and the post-correction uncompressed compressed data 29*a* outputted from the uncompression circuits 28, 29, and (3) the drive direction data 25*c*. The selection of the compressed data 7 by the comparison circuit 30 will be explained in detail later. The selection circuit 31 outputs the compressed data (22*a*, 26*a*, or 27*a*) selected by the comparison circuit 30 as the compressed data 7.

Next, the overdrive processing and the compression processing in the overdrive generation arithmetic circuit 13 will be explained in detail. As described above, when the overdrive processing and the compression processing are used together, the overdriving may be performed on each pixel in an improper overdrive direction by an influence of the compression error. Moreover, depending on the compression processing, although the overdriving is originally unnecessary, the overdriving may be performed by an influence of the gradation values of surrounding pixels. For example, when the compression processing is performed by using the block comprised of four pixels like this embodiment as a unit, it is affected by other pixels of the same block.

In order to resolve such a problem, the overdrive generation arithmetic circuit 13 of this embodiment performs the following two operations.

First, the overdrive generation arithmetic circuit 13 of this embodiment adopts the overdrive processing that puts a high value on a fact that the overdriving is performed in a proper direction rather than accuracy of the overdrive processing. That is, when it is determined that the overdriving in the improper overdrive direction is performed due to the compression error, the post-correction compressed data 27*a* generated by compressing the post-correction overdrive processed data 25*b* is selected as the compressed data 7 and is sent to the driver 4. The driver 4 generates the display data 8 by uncompressing the compressed data 7 and drives the data lines according to the display data 8.

Here, the post-correction overdrive processed data 25*b* is data that is obtained by increasing or decreasing the gradation value of the no-correction overdrive processed data 25*a* generated by ideal overdrive processing according to an overdrive direction shown in the drive direction data 25*c*. Below, generation of the post-correction overdrive processed data 25*b* will be explained in detail.

In the one embodiment, for a subpixel whose overdrive direction shown in the drive direction data 25*c* is "positive," the gradation value of the post-correction overdrive processed data 25*b* is generated by adding a correction value to the gradation value of the no-correction overdrive processed data 25*a*. On the other hand, for the subpixel whose overdrive direction shown in the drive direction data 25*c* is "negative," the gradation value of the post-correction overdrive processed data 25*b* is generated by subtracting the correction value from the gradation value of the no-correction overdrive processed data 25*a*.

The correction value added or subtracted may be set variously. However, the correction value is set as follows: In the case of a subpixel whose overdrive direction shown in the drive direction data 25*c* is "positive," the gradation value of the post-correction overdrive processed data 25*b* may become larger than or equal to a sum of the corresponding gradation value of the current frame uncompressed compressed data 24*a* and an absolute value of a maximum compression error; and in the case of a subpixel whose overdrive direction shown in the drive direction data 25*c* is "negative," the gradation value of the post-correction overdrive processed data 25*b* may become smaller than or equal to a value obtained by subtracting the absolute value of the maximum compression error from the corresponding gradation value of the current frame uncompressed compressed data 24*a*. If it is done in this way, a correct overdrive method is maintained even for the display data 8 obtained by uncompressing the post-correction compressed data 27*a*.

What is necessary to do this in a simplest way is just to make the correction value to be added or subtracted agree with the absolute value of the maximum compression error generated by compression and uncompression. For example, when the overdrive direction shown in the drive direction data 25*c* is "positive" and a compression error of ±4 occurs by compression and uncompression, the post-correction overdrive processed data 25*b* is generated by adding a constant value four to the gradation value of the no-correction overdrive processed data 25*a*. The display data 8 obtained by compressing and uncompressing the post-correction overdrive processed data 25*b* thus generated realizes a correct overdrive direction surely.

Alternatively, the post-correction overdrive processed data 25*b* may be generated as follows: (A) If the overdrive direction shown in the drive direction data 25*c* is "positive," (A1) when the gradation value of the no-correction overdrive processed data 25*a* is larger than or equal to a value obtained by adding an absolute value of the maximum compression error to the gradation value of the current frame uncompressed compressed data 24*a*, the gradation value of the post-correction overdrive processed data 25*b* is decided to be identical to the gradation value of the no-correction overdrive processed data 25*a* (it is not corrected); (A2) when the gradation value of the no-correction overdrive processed data 25*a* is smaller than the value obtained by adding the absolute value of the maximum compression error to the gradation value of the current frame uncompressed compressed data 24*a*, the gradation value of the post-correction overdrive processed data 25*b* is set to a value obtained by adding the absolute value of the maximum compression error to the gradation value of the current frame uncompressed compressed data 24*a*.

(B) If the overdrive direction shown in the drive direction data 25*c* is "negative," (B1) when the gradation value of the no-correction overdrive processed data 25*a* is smaller than or equal to a value obtained by subtracting the absolute value of the maximum compression error from the gradation value of the current frame uncompressed compressed data 24*a*, the gradation value of the post-correction overdrive processed data 25*b* is decided to be identical to the no-correction overdrive processed data 25*a* (it is not corrected); (B2) when the gradation value of the no-correction overdrive processed data 25*a* is larger than a value obtained by subtracting the absolute value of the maximum compression error from the gradation value of the current frame uncompressed compressed data 24*a*, the gradation value of the post-correction overdrive processed data 25*b* is set to a value obtained by subtracting the absolute value of the maximum compression error from the gradation value of the current frame uncompressed compressed data 24*a*.

The post-correction compressed data 27*a* is generated by compressing the post-correction overdrive processed data 25*b* thus generated and further the post-correction compressed data 27*a* is sent to the driver 4 as the compressed data 7, whereby also in the display data 8, the overdrive direction detected by the overdrive direction detection part 33 is maintained.

What should be noted is a respect that the overdrive direction should be decided based on the gradation values after the compression and uncompression processing (that is, the gradation values of the previous frame uncompressed compressed data 23*a* and the current frame uncompressed compressed data 24*a*), and further the no-correction overdrive processed data 25*a* should be generated by performing the overdrive processing. When lossless compression processing is performed, there may be a case where a desired gradation is intended to be realized as a long time temporal average. In such a case, if the overdrive direction is not decided on the basis of the gradation value after the uncompression processing, the proper overdrive direction cannot be acquired.

Second, when there is no (or small) change of the gradation value of each subpixel of each pixel of the object block, the overdrive generation arithmetic circuit 13 of this embodiment determines that the overdrive processing is unnecessary, selects the compressed data 22*a* obtained by compressing the current frame data 6*a* as the compressed data 7, and transmits it to the driver 4. Here, it should be noted that the overdrive processing is not performed on the compressed data 22*a*.

In order to realize the above two operations, the comparison circuit 30 and the selection circuit 31 select the compressed data 7 to be actually sent to the driver 4 as described below:

First, when the gradation value of the current frame uncompressed compressed data 24*a* and the gradation value of the no-correction overdrive processed data 25*a* are identical for all the subpixels of all the pixels of the object block, the comparison circuit 30 determines that the overdrive processing is unnecessary, and selects the compressed data 22*a* outputted from the compression circuit 22 as the compressed data 7 to be actually sent to the driver 4. Here, it should be noted that a fact that the gradation value of the current frame uncompressed compressed data 24*a* and the gradation value of the no-correction overdrive processed data 25*a* are the same means that there is no change in the gradation value of each subblock of each pixel of the object block or it is small. When the difference of the previous frame uncompressed compressed data 23*a* and the current frame uncompressed compressed data 24*a* is small, depending on details of the overdrive processing, the gradation value of the current frame uncompressed compressed data 24*a* and the gradation value of the no-correction overdrive processed data 25*a* can become identical.

FIG. 7 is one example of the previous frame uncompressed compressed data 23*a* and the current frame uncompressed compressed data 24*a* that are determined not to need the overdrive processing, and the no-correction overdrive processed data 25*a*. For example, the gradation value of the R subpixel of the pixel A is "11" and is the same for both the current frame uncompressed compressed data 24*a* and the no-correction overdrive processed data 25*a*, the gradation value of the G subpixel of the pixel A is "100" and is the same for both the current frame uncompressed compressed data 24*a* and the no-correction overdrive processed data 25*a*, and the gradation value of the B subpixel of the pixel A "16" and is the same for both the current frame uncompressed compressed data 24*a* and the no-correction overdrive processed data 25*a*. This situation similarly stands also for subpixels of other pixels: the gradation value of the current frame uncompressed compressed data 24*a* and the gradation value of the no-correction overdrive processed data 25*a* are identical.

If the gradation value of the current frame uncompressed compressed data 24*a* and the gradation value of the no-correction overdrive processed data 25*a* are different for any of the subpixels of any of the pixels of the object block, the comparison circuit 30 will determine whether the overdrive direction realized with the no-correction compressed data 26*a* is proper for each subpixel of each pixel of the object block. This determination is made by comparing the no-correction uncompressed compressed data 28*a* obtained by uncompressing the no-correction compressed data 26*a* (this agrees with data obtained by the uncompression processing of the no-correction compressed data 26*a* as the display data 8 in the driver 4) with the current frame uncompressed compressed data 24*a*.

For example, consider a case where the overdrive direction shown in the drive direction data 25*c* for a specific subpixel of a certain specific pixel is "positive." In this case, when a value of the no-correction uncompressed compressed data 28*a* of the specific subpixel of the specific pixel is larger than or equal to a value of the current frame uncompressed compressed data 24*a* of the specific subpixel of the specific pixel, the overdrive direction is determined to be proper; when it is not so, the overdrive direction is determined to be improper. Similarly, in the case where the overdrive direction shown in the drive direction data 25*c* for a specific subpixel of a certain specific pixel is "negative," when the value of the no-correction uncompressed compressed data 28*a* of the specific subpixel of the specific pixel is smaller than the value of the current frame uncompressed compressed data 24*a* of the specific subpixel of the specific pixel, the overdrive direction is determined to be proper; when it is not so, the overdrive direction is determined to be improper.

If the overdrive direction realized with the no-correction compressed data 26*a* for all the subpixels of all the pixels of the object block is proper, the comparison circuit 30 will select the no-correction compressed data 26*a* as the compressed data 7 to be actually sent to the driver 4.

On the other hand, if the overdrive direction realized with the no-correction compressed data 26*a* is improper at least for one subpixel of the pixels included in the object block, the comparison circuit 30 will select the post-correction compressed data 27*a* as the compressed data 7 to be actually sent to the driver 4.

It should be noted that the above-mentioned selection is performed for every object block. Taking a look at a certain object block, the compressed data 22*a* outputted from the compression circuit 22 is selected for all the subpixels of all the pixels, or the no-correction compressed data 26*a* is selected for all the subpixels of all the pixels, or the post-correction compressed data 27*a* is selected for all the subpixels of all the pixels.

Figure 8:
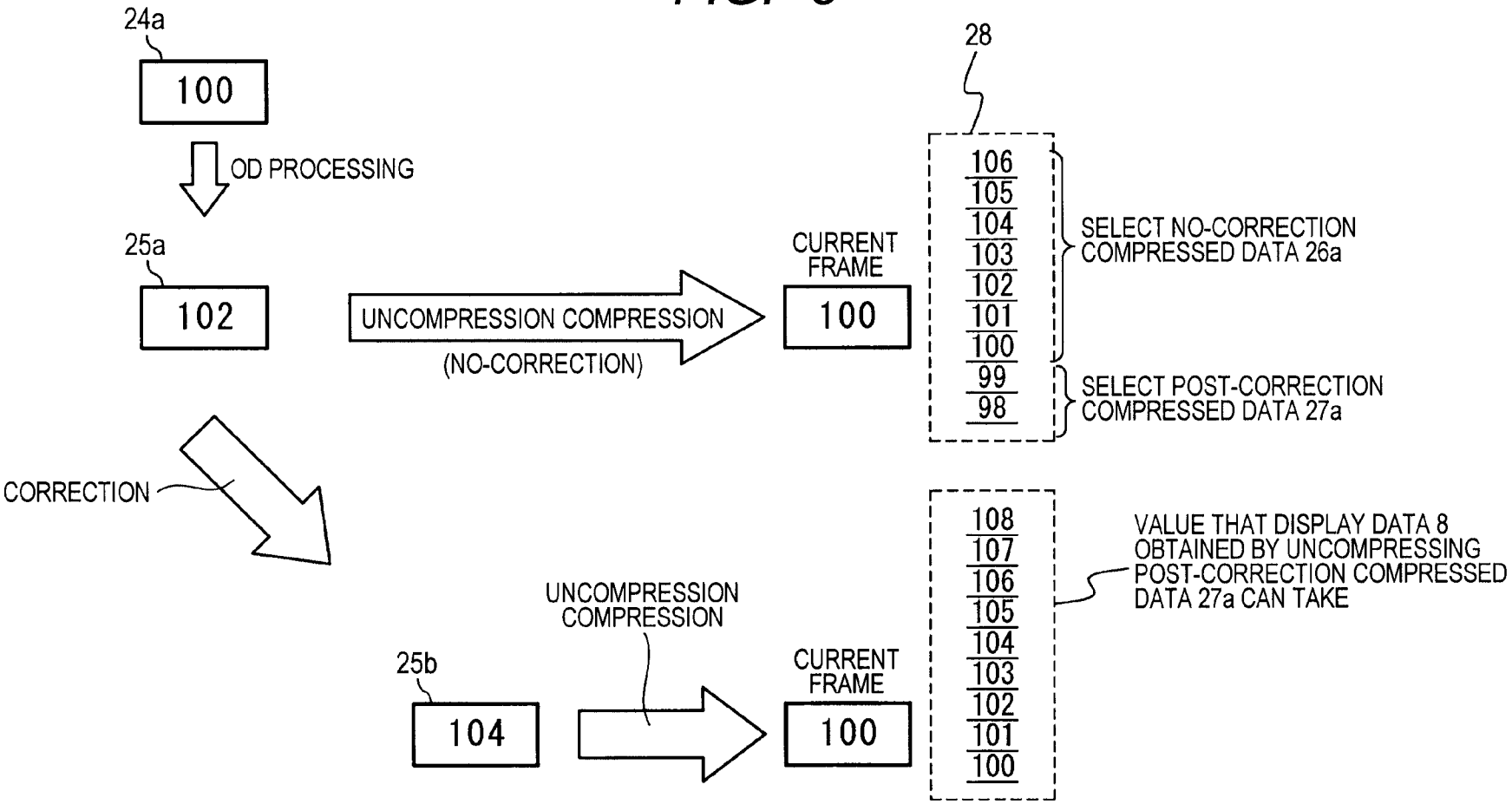
FIG. 8 is a conceptual diagram showing one example of selection of no-correction compressed data and post-correction compressed data in a comparison circuit of the overdrive generation arithmetic circuit of FIG. 5.

FIG. 8 shows one example of selection of determination of property of the overdrive direction. Let it be assumed that for a certain subpixel of a certain pixel in the object block, the compression error is in a range of ±4, the gradation value of the current frame uncompressed compressed data 24*a* is 100, and the overdrive direction shown in the drive direction data 25*c* is "positive." In one example, the gradation value of the no-correction overdrive processed data 25*a* is computed to be 102 by processing by the LUT arithmetic part 32, and the gradation value of the post-correction overdrive processed data 25*b* is computed to be 104 by processing by the correction part 34.

In this case, the gradation value of the no-correction uncompressed compressed data 28*a* obtained by performing the compression processing and the uncompression processing on the no-correction overdrive processed data 25*a* can take a value of not less than 98 and not more than 106. When the gradation value of the no-correction uncompressed compressed data 28*a* is larger than or equal to 100 (that is, when it is larger than or equal to the gradation value of the current frame uncompressed compressed data 24*a*), the overdrive direction is determined to be proper. In this case, the proper overdrive direction can be certainly realized by selecting the no-correction compressed data 26*a* as the compressed data 7 to be sent to the driver 4. On the other hand, when the gradation value of the no-correction uncompressed compressed data 28*a* is smaller than 100 (that is, when it is smaller than the gradation value of the current frame uncompressed compressed data 24*a*), it is possible to realize the proper overdrive direction by selecting the post-correction compressed data 27*a* as the compressed data 7 to be sent to the driver 4. When the gradation value of the post-correction overdrive processed data 25*b* is 104, although the display data 8 obtained by uncompressing the post-correction compressed data 27*a* can take a value of not less than 100 and not more than 108, the overdrive direction does not become a reverse direction even if it takes any value. Therefore, the overdriving is not performed in an improper overdrive direction.

By selecting the compressed data 7 in this way, the overdriving is prevented from being performed in the improper overdrive direction, and the overdriving is prevented from being performed although the overdriving is originally unnecessary.

Incidentally, it should be noted that for the compression processing performed in the compression circuits 21, 22, 26, and 27 and the uncompression processing performed in the uncompression circuits 15, 23, 24, 28, and 29, well-known various compression processing and uncompression processing can be used.

Moreover, in the above-mentioned embodiment, when the gradation value of the current frame uncompressed compressed data 24*a* corresponding to a certain subpixel of a certain pixel of the object block is larger than or equal to the corresponding gradation value of the previous frame uncompressed compressed data 23*a* of the subpixel, the proper overdrive direction is detected as "positive"; when it is not so, the proper overdrive direction is detected as "negative." However, the proper overdrive direction when the gradation value of the current frame uncompressed compressed data 24*a* corresponding to a certain subpixel of a certain pixel of the object block is equal to the corresponding gradation value of the previous frame uncompressed compressed data 23*a* of the subpixel may be different from this direction. That is, the following detection may be all right: when the gradation value of the current frame uncompressed compressed data 24*a* corresponding to a certain subpixel of a certain pixel of the object block exceeds the corresponding gradation value of the previous frame uncompressed compressed data 23*a* of the subpixel, the proper overdrive direction is detected as "positive"; when it is not so, the overdrive direction is detected as "negative."

In this case, in the comparison circuit 30, in the case where the overdrive direction shown in the drive direction data 25*c* for a specific subpixel of a certain specific pixel is "positive," when the value of the no-correction uncompressed compressed data 28*a* of the specific subpixel of the specific pixel exceeds the value of the current frame uncompressed compressed data 24*a* of the specific subpixel of the specific pixel, the overdrive direction is determined to be proper; when it is not so, the overdrive direction is determined to be improper. Moreover, in the case where the overdrive direction shown in the drive direction data 25*c* for a specific subpixel of a certain specific pixel is "negative," when the value of the no-correction uncompressed compressed data 28*a* of the specific subpixel of the specific pixel is smaller than or equal to the value of the current frame uncompressed compressed data 24*a* of the specific subpixel of the specific pixel, the overdrive direction is determined to be proper; when it is not so, the overdrive direction is determined to be improper.

Furthermore, in the above-mentioned embodiment, although the compressed data 7 is selected from among the no-correction compressed data 26*a*, the post-correction compressed data 27*a*, and the compressed data 22*a* (on which the overdrive processing is not performed), an operation where the compressed data 22*a* is not selected as the compressed 7, that is, either the no-correction compressed data 26*a* or the post-correction compressed data 27*a* is selected as the compressed data 7 is also possible. Even in this case, an effect that the overdriving is performed in the improper direction is obtained. Moreover, the post-correction compressed data 27*a* may always be used as the compressed data 7 with no selection by the comparison circuit 30 and the selection circuit 31 being performed. In this case, since the liquid crystal display panel 2 is always driven in response to the display data 8 obtained by uncompressing the compressed data 7 generated from the post-correction overdrive processed data 25*b*, the status is unsuitable to perform ideal overdriving (the no-correction overdrive processed data 25*a* is more preferable than the post-correction overdrive processed data 25*b* in order to realize the ideal overdriving). However, this scheme at least prevents the overdriving from being performed in the improper overdrive direction. As described above, according to the inventors' examination, it is rather important that the overdriving is not performed in the improper overdrive direction.

Second Embodiment

Figure 9:
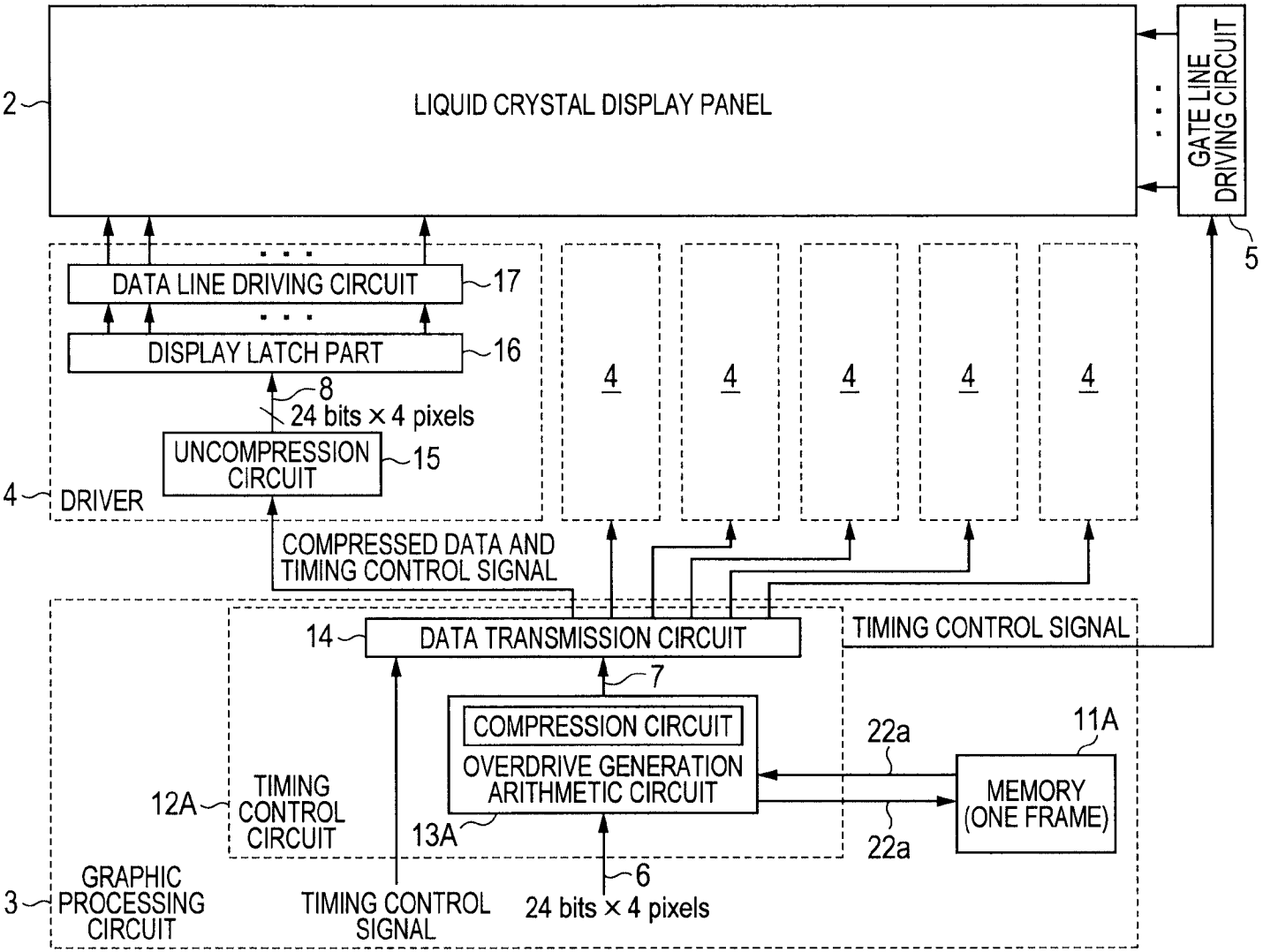
FIG. 9 is a block diagram showing a configuration of a liquid crystal display of a second embodiment of the present invention.
Figure 10:
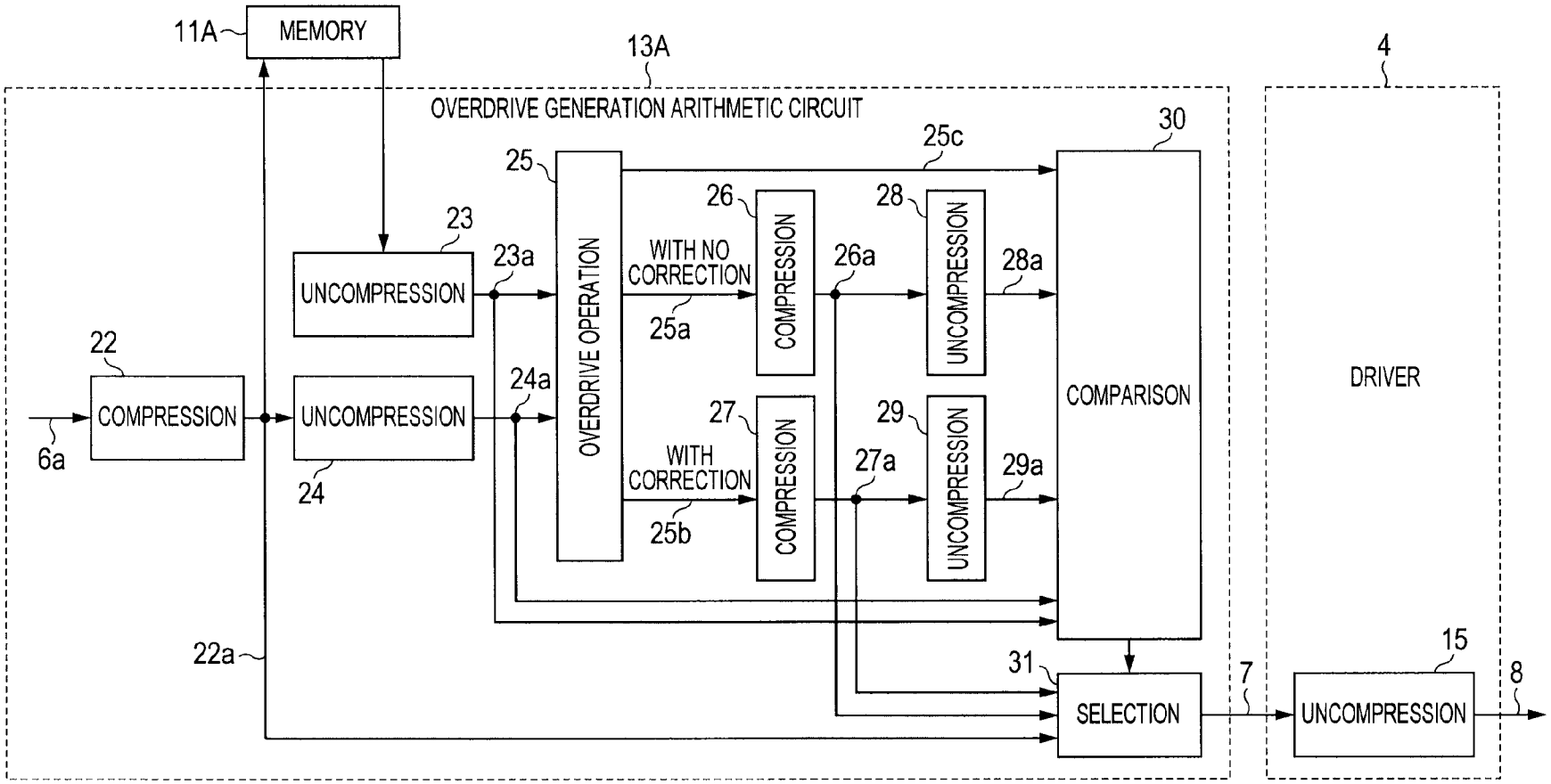
FIG. 10 is a block diagram showing a configuration of an overdrive generation arithmetic circuit in the second embodiment.

FIG. 9 is a block diagram showing a configuration of a liquid crystal display 1A of a second embodiment of the present invention, and FIG. 10 is a block diagram showing a configuration of an overdrive generation arithmetic circuit 13A. Although the configuration and operation of the liquid crystal display 1A of this embodiment are the same as those of the liquid crystal display 1 of the first embodiment in general, they differ from them in the following respects. In the second embodiment, instead of the image data 6, the compressed data 22*a* obtained by performing the compression processing on the image data 6 is stored in memory 11A. The compressed data stored in the memory 11A is uncompressed by the uncompression circuit 23 and, thereby, the previous frame uncompressed compressed data 23*a* is generated. In connection with this, the compression circuit 21 for compressing the previous frame data 6*b* is not used.

In this embodiment where the compressed data 22*a* generated by the compression circuit 22 for performing the compression processing on the current frame data 6*a* is stored in the memory 11A, it is possible to make a capacity of the memory 11A smaller than the memory 11 used in the first embodiment. Moreover, the compression circuit 21 can be removed from the overdrive generation arithmetic circuit 13A. Thus, the configuration of the liquid crystal display 1A of the second embodiment has an advantage that the hardware can be made small.

Third Embodiment

Figure 11:
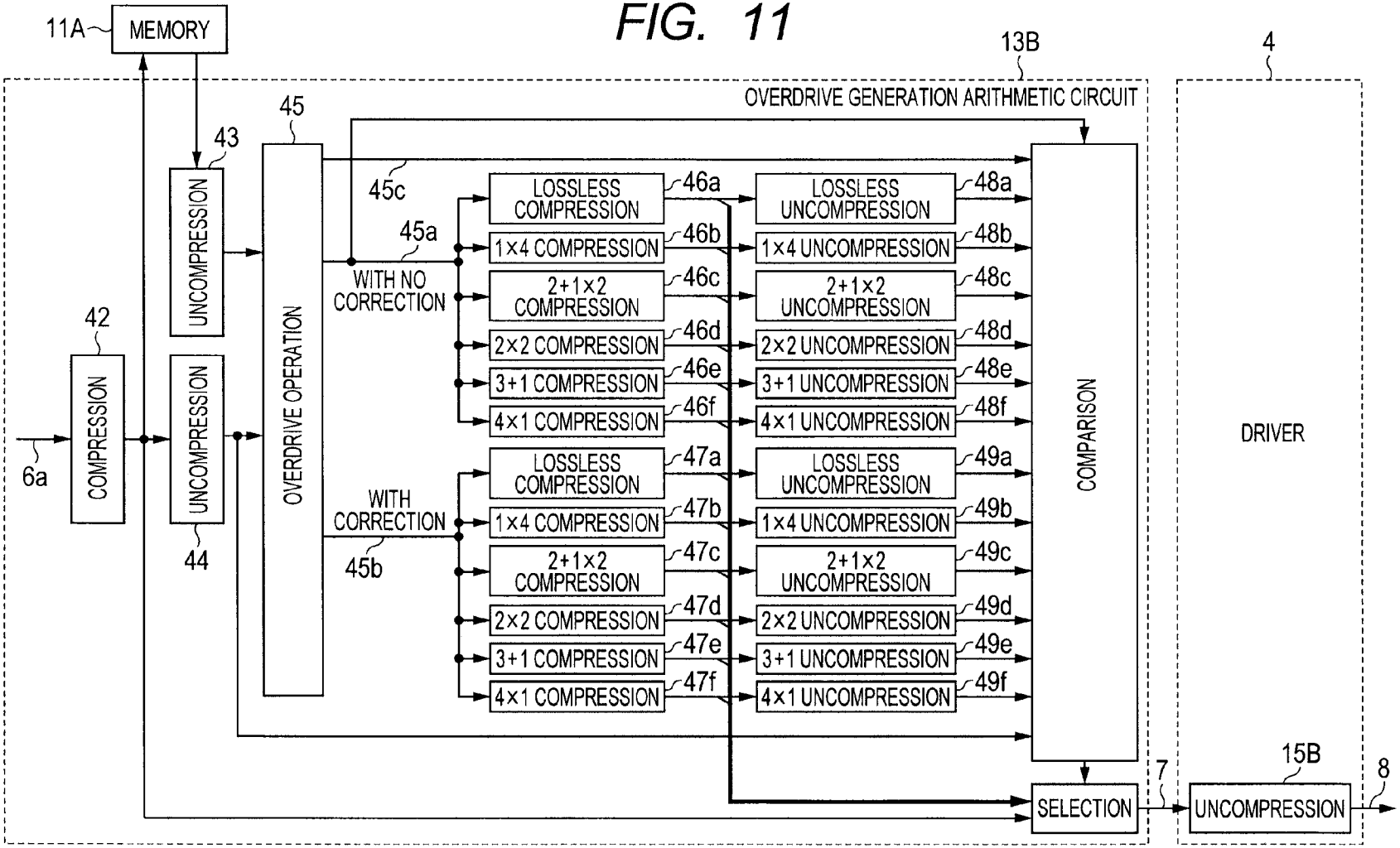
FIG. 11 is a block diagram showing a configuration of an overdrive generation arithmetic circuit in a third embodiment.

FIG. 11 is a block diagram showing a configuration of an overdrive generation arithmetic circuit 13B that is used in a liquid crystal display of a third embodiment of the present invention. Although the liquid crystal display of this embodiment has the configuration similar to that of the liquid crystal display 1A of the second embodiment, it is different therefrom in that the overdrive generation arithmetic circuit 13B is configured to perform optimal compression processing selected from among multiple compression processing operations.

In detail, in this embodiment, the overdrive generation arithmetic circuit 13B is configured to compress the image data 6 that it receives by any of the following six compression processing operations: ●lossless compression, ●(1×4) pixel compression, ●(2+1×2) pixel compression, ●(2×2) pixel compression, ●(3+1) pixel compression, and ●(4×1) pixel compression.

Here, the lossless compression is a scheme of compressing the image data 6 so that the original image data 6 can be completely restored from the compressed data 7. In this embodiment, it is used when the image data of the object block has a specific pattern. As described above, it should be noted that each block includes pixels of one row and four columns in this embodiment. The (1×4) pixel compression is a scheme of independently performing processing of reducing the number of bit planes for each of all the four pixels of the object block (in this embodiment, dithering using a dither matrix). This (1×4) pixel compression is suitable to a case where the correlation of the image data of the four pixels is low. The (2+1×2) pixel compression is a scheme of deciding a representative value that represents the image data of two pixels of all the four pixels of the object block and, on the other hand, performing processing of reducing the number of bit planes on each of the other two pixels. This (2+1×2) pixel compression is suitable to a case where the correlation of the image data of two pixels of the four pixels is high and the correlation of the image data of the other two pixels is low. The (2×2) pixel compression is a scheme where all the four pixels of the object block are divided into two sets each including two pixels and a representative value representing the image data is determined for each set of the two pixels and the image data is compressed. This (2×2) pixel compression is suitable to a case where the correlation of the image data of two pixels of the four pixels is high and the correlation of the image data of the other two pixels is high. The (3+1) pixel compression is a scheme where a representative value representing the image data of three pixels of all the four pixels of the object block is decided and, on the other hand, processing of reducing the number of bit planes is performed on the remaining one pixel. This (3+1) pixel compression is suitable to a case where the correlation among the image data of three pixels of the object block is high and the correlation between the image data of the remaining one pixel and the image data of the three pixels is low. (4×1) pixel compression is a scheme whereby a representative value that represents the image data of the four pixels of the object block is decided and the image data is compressed. This (4×1) pixel compression is suitable to a case where the correlation among the image data of all the four pixels of the object block is high.

Here, a fact that when the image data of the object block has a specific pattern, pieces of the image data of the object block are configured so that the lossless compression can be performed thereon is useful to enable inspection of the liquid display crystal panel 2 to be performed appropriately. In the inspection of the liquid crystal display panel 2, evaluations of a luminance characteristic and a color gamut characteristic are performed. In this evaluation of the luminance characteristic and the color gamut characteristic, an image of a specific pattern is displayed on the liquid crystal display panel 2. In order to evaluate the luminance characteristic and the color gamut characteristic appropriately at this time, it is necessary to display an image reproducing colors faithfully to the inputted image data on the liquid crystal display panel 2. If a compressive strain exists, it is impossible to perform the evaluation of the luminance characteristic and the color gamut characteristic appropriately. Therefore, this embodiment is configured so that the overdrive generation arithmetic circuit 13B may be able to perform the lossless compression.

Which one among the six compression processing operations is to be used is decided according to whether the image data of the object block has a specific pattern and a correlation among the image data of the pixels of one row and four columns that are included in the object block. For example, when the correlation of the image data of all the four pixels is high, the (4×1) pixel compression is used; when the correlation of the image data of two pixels in the four pixels is high and the correlation of the image data of the other two pixels is high, the (2×2) pixel compression is used. Selection of the six compression processing operations, and the compression processing and the uncompression processing in each will be explained in detail later.

As a specific configuration, as illustrated in FIG. 11, the overdrive generation arithmetic circuit 13B includes a compression circuit 42, uncompression circuits 43, 44, an overdrive arithmetic circuit 45, compression parts 46*a* to 46*f* and 47*a* to 47*f*, uncompression parts 48*a* to 48*f* and 49*a* to 49*f*, a comparison circuit 50, and a selection circuit 51.

Figure 12:
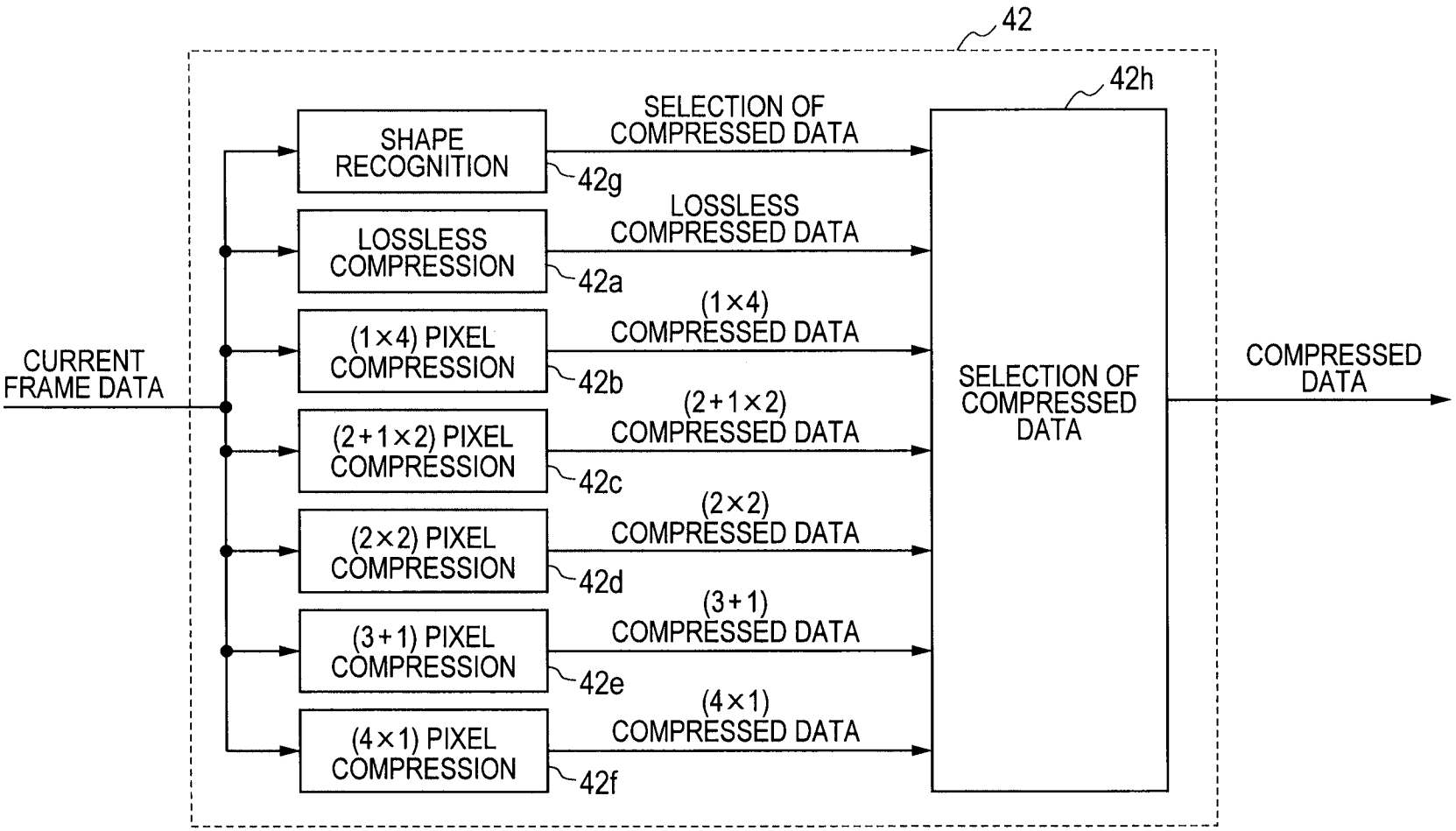
FIG. 12 is a block diagram showing a configuration of a compression circuit of the overdrive generation arithmetic circuit of FIG. 11.

The compression circuit 42 performs the compression processing on the image data 6 (that is, the current frame data 6*a*) to generate the compressed data. FIG. 12 is a block diagram showing a configuration of the compression circuit 42. The compression circuit 42 includes a lossless compression part 42*a*, a (1×4) pixel compression part 42*b*, a (2+1×2) pixel compression part 42*c*, a (2×2) pixel compression part 42*d*, a (3+1) pixel compression part 42*e*, a (4×1) pixel compression part 42*f*, a shape recognition part 42*g*, and a compressed data selection part 42*h*. The lossless compression part 42*a* performs the lossless compression on the current frame data 6*a* to generate lossless compressed data. The (1×4) pixel compression part 42*b* performs the (1×4) pixel compression on the current frame data 6*a* to generate (1×4) compressed data. The (2+1×2) pixel compression part 42*c* performs the (2+1×2) pixel compression on the current frame data 6*a* to generate (2+1×2) compressed data. The (2×2) pixel compression part 42*d* performs the (2×2) pixel compression on the current frame data 6*a* to generate (2×2) compressed data. The (3+1) pixel compression part 42*e* performs the (3+1) pixel compression on the current frame data 6*a* to generate (3+1) compressed data. The (4×1) pixel compression part 42*f* performs the (4×1) pixel compression on the current frame data 6*a* to generate (4×1) compressed data. The shape recognition part 42*g* recognizes the correlation between the pixels of the object block from the current frame data 6*a*, selects any of the lossless compressed data, the (1×4) compressed data, the (2+1×2) compressed data, the (2×2) compressed data, the (3+1) compressed data, and the (4×1) compressed data according to the recognized correlation, and sends compressed data selection data indicating the selected compressed data to the compressed data selection part 42*h*. The compressed data selection part 42*h* outputs the compressed data specified by the compressed data selection data. The compressed data outputted from the compressed data selection part 42*h* is sent to the uncompression circuit 44 and the selection circuit 51 and is also sent to and stored in the memory 11A.

Returning to FIG. 11, the uncompression circuits 43, 44 receive the compressed data from the memory 11A and the compression circuit 42, and perform the uncompression processing on the received compressed data, respectively. Here, the compressed data received from the memory 11A is the compressed data corresponding to the image data of the previous frame, while the compressed data received from the compression circuit 42 is the compressed data corresponding to the image data of the current frame. The uncompression circuits 43, 44 perform the uncompression processing corresponding to the compression scheme selected by the above-mentioned compression circuit 42, and generate the previous frame uncompressed compressed data and the current frame uncompressed compressed data, respectively.

Figure 13:
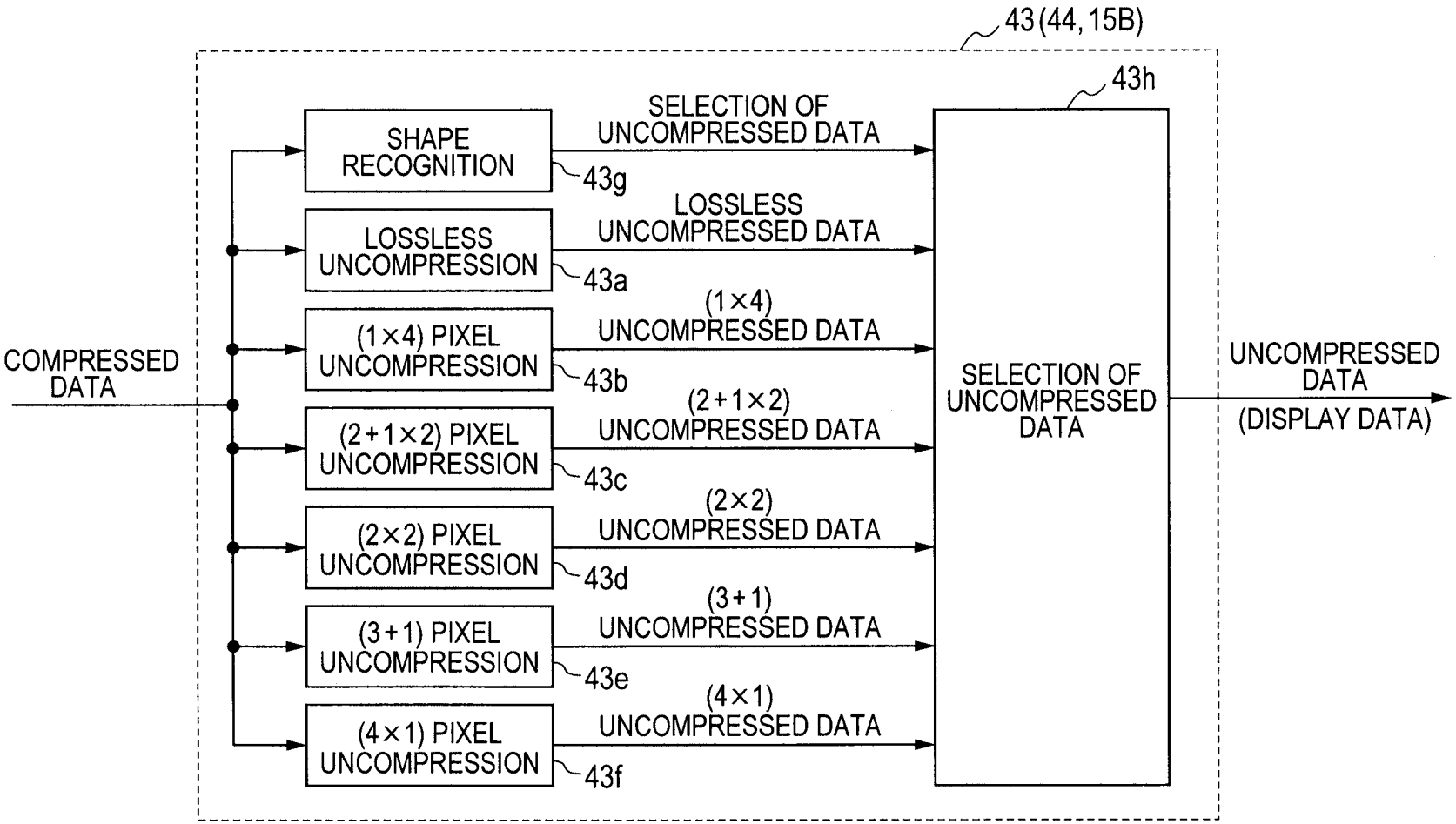
FIG. 13 is a block diagram showing a configuration of an uncompression circuit of the overdrive generation arithmetic circuit of FIG. 11.

FIG. 13 is a block diagram showing a configuration of the uncompression circuits 43, 44. Incidentally, although the configuration of the uncompression circuit 43 will be explained below, the uncompression circuit 44 also has the same configuration as the uncompression circuit 43 and performs the same operation. Furthermore, an uncompression circuit 15B provided in the driver 4 also has the same configuration as the uncompression circuit 43, and performs the same operation.

The uncompression circuit 43 includes a lossless uncompression part 43*a*, a (1×4) pixel uncompression part 43*b*, a (2+1×2) pixel uncompression part 43*c*, a (2×2) pixel uncompression part 43*d*, a (3+1) pixel uncompression part 43*e*, a (4×1) pixel uncompression part 43*f*, and a shape recognition part 43*g*. The lossless uncompression part 43*a* performs uncompression processing corresponding to the lossless compression on the received compressed data to generate lossless uncompressed data. The (1×4) pixel uncompression part 43*b* performs uncompression processing corresponding to the (1×4) pixel compression on the received compressed data to generate (1×4) uncompressed data. The (2+1×2) pixel uncompression part 43*c* performs uncompression processing corresponding to the (2+1×2) pixel compression on the received compressed data to generate (2+1×2) uncompressed data. The (2×2) pixel uncompression part 43*d* performs uncompression processing corresponding to the (2×2) pixel compression on the received compressed data to generate (2×2) uncompressed data. The (3+1) pixel uncompression part 43*e* performs uncompression processing corresponding to the (3+1) pixel compression on the received compressed data to generate (3+1) uncompressed data. The (4×1) pixel uncompression part 43*f* performs uncompression processing corresponding to the (4×1) pixel compression on the received compressed data to generate (4×1) uncompressed data. The shape recognition part 43*g* recognizes the compression processing being used for compression of the received compressed data from a compression type recognition bit included in the compressed data, selects the uncompressed data corresponding to the compression processing being recognized, and sends uncompressed data selection data indicating selected uncompressed data to the uncompressed data selection part 43*h*. The uncompressed data selection part 43*h* outputs the uncompressed data specified by the uncompressed data selection data.

Returning to FIG. 11, the overdrive arithmetic circuit 45 has the same configuration as the overdrive arithmetic circuits 25 of the first and second embodiments, and performs the same processing on the previous frame uncompressed compressed data received from the uncompression circuit 43 and the current frame uncompressed compressed data received from the uncompression circuit 44 to generate no-correction overdrive processed data 45*a*, post-correction overdrive processed data 45*b*, and drive direction data 45*c*.

The lossless compression part 46*a*, the (1×4) pixel compression part 46*b*, the (2+1×2) pixel compression part 46*c*, the (2×2) pixel compression part 46*d*, the (3+1) pixel compression part 46*e*, and the (4×1) pixel compression part 46*f* are of a circuit group for performing the compression processing on the no-correction overdrive processed data 45*a*. In detail, the lossless compression part 46*a* performs the lossless compression on the no-correction overdrive processed data 45*a* to generate the no-correction lossless compressed data. The (1×4) pixel compression part 46*b* performs the (1×4) pixel compression on the no-correction overdrive processed data 45*a* to generate no-correction (1×4) compressed data. The (2+1×2) pixel compression part 46*c* performs the (2+1×2) pixel compression on the no-correction overdrive processed data 45*a* to generate no-correction (2+1×2) compressed data. The (2×2) pixel compression part 46*d* performs the (2×2) pixel compression on the no-correction overdrive processed data 45*a* to generate no-correction (2×2) compressed data. The (3+1) pixel compression part 46*e* performs the (3+1) pixel compression on the no-correction overdrive processed data 45*a* to generate no-correction (3+1) compressed data. The (4×1) pixel compression part 46*f* performs the (4×1) pixel compression on the no-correction overdrive processed data 45*a* to generate no-correction (4×1) compressed data.

The lossless compression part 47*a*, the (1×4) pixel compression part 47*b*, the (2+1×2) pixel compression part 47*c*, the (2×2) pixel compression part 47*d*, the (3+1) pixel compression part 47*e*, and the (4×1) pixel compression part 47*f* are of a circuit group that performs the compression processing on the post-correction overdrive processed data 45*b*. The lossless compression part 47*a* performs the lossless compression on the post-correction overdrive processed data 45*b* to generate post-correction lossless compressed data 45*b*. The (1×4) pixel compression part 47*b* performs the (1×4) pixel compression on the post-correction overdrive processed data 45*b* to generate post-correction (1×4) compressed data. The (2+1×2) pixel compression part 47*c* performs the (2+1×2) pixel compression on the post-correction overdrive processed data 45*b* to generate post-correction (2+1×2) compressed data. The (2×2) pixel compression part 47*d* performs the (2×2) pixel compression on the post-correction overdrive processed data 45*b* to generate post-correction (2×2) compressed data. The (3+1) pixel compression part 47*e* performs the (3+1) pixel compression on the post-correction overdrive processed data 45*b* to generate post-correction (3+1) compressed data. The (4×1) pixel compression part 47*f* performs the (4×1) pixel compression on the post-correction overdrive processed data 45*b* to generate post-correction (4×1) compressed data.

The lossless uncompression part 48*a*, the (1×4) pixel uncompression part 48*b*, the (2+1×2) pixel uncompression part 48*c*, the (2×2) pixel uncompression part 48*d*, the (3+1) pixel uncompression part 48*e*, and the (4×1) pixel uncompression part 48*f* are of a circuit group for uncompressing the compressed data that is generated by the compression processing on the no-correction overdrive processed data 45*a*. The lossless uncompression part 48*a* performs uncompression processing corresponding to the lossless compression on the no-correction lossless compressed data received from the lossless compression part 46*a* to generate the no-correction lossless uncompressed compressed data. The (1×4) pixel uncompression part 48*b* performs uncompression processing corresponding to the (1×4) pixel compression on the no-correction (1×4) compressed data received from the (1×4) pixel compression part 46*b* to generate the no-correction (1×4) uncompressed compressed data. The (2+1×2) pixel uncompression part 48*c* performs uncompression processing corresponding to the (2+1×2) pixel compression on the compressed data received from the (2+1×2) pixel compression part 46*c* to generate the no-correction (2+1×2) uncompressed compressed data. The (2×2) pixel uncompression part 48*d* performs uncompression processing corresponding to the (2×2) pixel compression on the compressed data received from the (2×2) pixel compression part 46*d* to generate the no-correction (2×2) uncompressed compressed data. The (3+1) pixel uncompression part 48*e* performs uncompression processing corresponding to the (3+1) pixel compression on the compressed data received from the (3+1) pixel compression part 46*e* to generate no-correction (3+1) uncompressed compressed data. The (4×1) pixel uncompression part 48*f* performs uncompression processing corresponding to the (4×1) pixel compression on the compressed data received from the (4×1) pixel compression part 46*f* to generate no-correction (4×1) uncompressed data.

The lossless uncompression part 49*a*, the (1×4) pixel uncompression part 49*b*, the (2+1×2) pixel uncompression part 49*c*, the (2×2) pixel uncompression part 49*d*, the (3+1) pixel uncompression part 49*e*, and the (4×1) pixel uncompression part 49*f* are of a circuit group for uncompressing the compressed data that is generated by the compression processing on the post-correction overdrive processed data 45*b*. The lossless uncompression part 49*a* performs uncompression processing corresponding to the lossless compression on the post-correction lossless compressed data received from the lossless compression part 46*a* to generate post-correction lossless uncompressed compressed data. The (1×4) pixel uncompression part 49*b* performs uncompression processing corresponding to the (1×4) pixel compression on the post-correction (1×4) compressed data received from the (1×4) pixel compression part 46*b* to generate post-correction (1×4) uncompressed compressed data. The (2+1×2) pixel uncompression part 49*c* performs uncompression processing corresponding to the (2+1×2) pixel compression on the compressed data received from the (2+1×2) pixel compression part 46*c* to generate post-correction (2+1×2) uncompressed compressed data. The (2×2) pixel uncompression part 49*d* performs uncompression processing corresponding to the (2×2) pixel compression on the compressed data received from the (2×2) pixel compression part 46*d* to generate post-correction (2×2) uncompressed compressed data. The (3+1) pixel uncompression part 49*e* performs uncompression processing corresponding to the (3+1) compression on the compressed data received from the (3+1) pixel compression part 46*e* to generate post-correction (3+1) uncompressed compressed data. The (4×1) pixel uncompression part 49*f* performs uncompression processing corresponding to the (4×1) compression on the compressed data received from the (4×1) pixel compression part 46*f* to generate post-correction (4×1) uncompressed data.

The comparison circuit 50 selects any of the compressed data outputted from the compression circuit 42 and the compression circuits 46*a* to 46*f* and 47*a* to 47*f* as the compressed data 7 to be sent to the driver 4. Here, the compressed data outputted from the compression circuit 42 is compressed data on which the overdrive processing is not performed. Moreover, each piece of the compressed data outputted from the compression circuits 46*a* to 46*f* is compressed data obtained by performing the compression processing on the data on which the overdrive processing is performed by the LUT processing part and yet the correction processing by the correction part is not performed; each piece of the compressed data outputted from the compression circuits 47*a* to 47*f* is compressed data obtained by performing the compression processing on the data on which the overdrive processing is performed and further the correction processing is performed. The selection by the comparison circuit 50 is performed based on (1) the current frame uncompressed compressed data outputted from the uncompression circuit 44, (2) the data outputted from the uncompression circuits 46*a* to 46*f* and 47*a* to 47*f*, and (3) the drive direction data 45*c*. The selection circuit 51 outputs the compressed data selected by the comparison circuit 50 as the compressed data 7 that should be sent to the driver 4.

The selection in the comparison circuit 50 is performed as follows in the one embodiment: First, if the gradation value of the current frame uncompressed compressed data outputted from the uncompression circuit 44 and the gradation value of the no-correction overdrive processed data 45*a* are identical for all the subpixels of all the pixels of the object block, the comparison circuit 50 determines that the overdrive processing is unnecessary and selects the compressed data outputted from the compression circuit 42 as the compressed data 7 to be actually sent to the driver 4.

If the gradation value of the current frame uncompressed compressed data and the gradation value of the no-correction overdrive processed data 45*a* are different for any subpixel of any pixel of the object block, the comparison circuit 50 further selects the compressed data 7 that should be sent to the driver 4 from among pieces of the compressed data received from the lossless compression part 46*a*, the (1×4) pixel compression part 46*b*, the (2+1×2) pixel compression part 46*c*, the (2×2) pixel compression part 46*d*, the (3+1) pixel compression part 46*e*, the (4×1) pixel compression part 46*f*, the lossless compression part 47*a*, the (1×4) pixel compression part 47*b*, the (2+1×2) pixel compression part 47*c*, the (2×2) pixel compression part 47*d*, the (3+1) pixel compression part 47*e*, and the (4×1) pixel compression part 47*f*. The selection of the compressed data 7 that should be sent to the driver 4 is performed as follows:

First, the comparison circuit 50 determines whether the overdrive direction realized with pieces of the compressed data outputted from the lossless compression part 46*a*, the (1×4) pixel compression part 46*b*, the (2+1×2) pixel compression part 46*c*, the (2×2) pixel compression part 46*d*, the (3+1) pixel compression part 46*e*, and the (4×1) pixel compression part 46*f* is proper for each subpixel of each pixel of the object block. This determination is made by comparison of the no-correction uncompressed compressed data obtained by uncompressing each of the compressed data (that is, pieces of the uncompressed data outputted from the lossless uncompression part 48*a*, the (1×4) pixel uncompression part 48*b*, the (2+1×2) pixel uncompression part 48*c*, the (2×2) pixel uncompression part 48*d*, the (3+1) pixel uncompression part 48*e*, and the (1×4) pixel uncompression part 48*f*), and the current frame uncompressed compressed data.

For example, consider a case where the overdrive direction shown in the drive direction data 45*c* for a specific subpixel of a certain specific pixel is "positive," and an object of determination of the overdrive direction is the compressed data outputted from the lossless compression part 46*a*. In this case, when a value of the uncompressed data outputted from the lossless uncompression part 48*a* for the specific subpixel of the specific pixel is larger than or equal to the value of the current frame uncompressed compressed data of the specific subpixel of the specific pixel, the overdrive direction realized with the compressed data outputted from the lossless compression part 46*a* is determined to be proper; when it is not so, the overdrive direction is determined to be improper. Similarly, in the case where the overdrive direction shown in the drive direction data 45*c* for a specific subpixel of a certain specific pixel is "negative," when the value of the uncompressed data outputted from the lossless uncompression part 48*a* for the specific subpixel of the specific pixel is smaller than the value of the current frame uncompressed compressed data of the specific subpixel of the specific pixel, the overdrive direction is determined to be proper; when it is not so, the overdrive direction is determined to be improper. Furthermore, the same determination is made on the compressed data outputted from the (1×4) pixel compression part 46*b*, the (2+1×2) pixel compression part 46*c*, the (2×2) pixel compression part 46*d*, the (3+1) pixel compression part 46*e*, and the (4×1) pixel compression part 46*f*. Thereby, for each piece of the compressed data outputted from the lossless compression part 46*a*, the (1×4) pixel compression part 46*b*, the (2+1×2) pixel compression part 46*c*, the (2×2) pixel compression part 46*d*, the (3+1) pixel compression part 46*e*, and the (4×1) pixel compression part 46*f*, whether the overdrive direction of all the subpixels of all the pixels of the object block is proper is determined.

If there is only one piece of the compressed data whose overdrive direction of all the subpixels of all the pixels of the object block is proper among pieces of the compressed data generated by the lossless compression part 46*a*, the (1×4) pixel compression part 46*b*, the (2+1×2) pixel compression part 46*c*, the (2×2) pixel compression part 46*d*, the (3+1) pixel compression part 46*e*, and the (4×1) pixel compression part 46*f*, the comparison circuit 50 will select the one piece of the compressed data as the compressed data 7 that should be sent to the driver 4.

If there are plural pieces of the compressed data whose overdrive direction of all the subpixels of all the pixels of the object block is proper, the compressed data whose uncompressed data obtained by uncompressing the compressed data is the closest to the no-correction overdrive processed data 45*a* will be selected from among the plural pieces of the compressed data. In the one embodiment, regarding each subpixel of each pixel of the object block, a difference absolute value of the value of the uncompressed data and the value of the no-correction overdrive processed data 45*a* is computed, and the compressed data corresponding to uncompressed data such that a sum of the difference absolute values of all the subpixels of all the pixels of the object block is the smallest is selected as the compressed data 7 that should be sent to the driver 4 from among pieces of the compressed data each of whose overdrive direction of all the subpixels of all the pixels of the object block is proper.

If the compressed data whose overdrive direction of all the subpixels of all the pixels of the object block is proper does not exist among pieces of the compressed data generated by the lossless compression part 46*a*, the (1×4) pixel compression part 46*b*, the (2+1×2) pixel compression part 46*c*, the (2×2) pixel compression part 46*d*, the (3+1) pixel compression part 46*e*, and the (4×1) pixel compression part 46*f*, the compressed data 7 that should be sent to the driver 4 will be selected from among pieces of the compressed data outputted from the lossless compression part 47*a*, the (1×4) pixel compression part 47*b*, the (2+1×2) pixel compression part 47*c*, the (2×2) pixel compression part 47*d*, the (3+1) pixel compression part 47*e*, and the (4×1) pixel compression part 47*f*.

In detail, the compressed data such that corresponding uncompressed data (that is, the uncompressed data outputted from each of the lossless uncompression part 49*a*, the (1×4) pixel uncompression part 49*b*, the (2+1×2) pixel uncompression part 49*c*, the (2×2) pixel uncompression part 49*d*, the (3+1) pixel uncompression part 49*e*, and the (4×1) pixel uncompression part 49*f*) is the closest to the no-correction overdrive processed data 45*a* in the pieces of the compressed data is selected as the compressed data 7 that should be sent to the driver 4. In the one embodiment, on each subpixel of each pixel of the object block, difference absolute values between the values of the uncompressed data outputted from the lossless uncompression part 49*a*, the (1×4) pixel uncompression part 49*b*, the (2+1×2) pixel uncompression part 49*c*, the (2×2) pixel uncompression part 49*d*, the (3+1) pixel uncompression part 49*e*, and the (4×1) pixel uncompression part 49*f* and the value of the no-correction overdrive processed data 45*a* are computed, and the compressed data corresponding to the uncompressed data such that a sum of the difference absolute values of all the subpixels of all the pixels of the object block is the smallest is selected as the compressed data 7 that should be sent to the driver 4. In this case, the compressed data 7 that should be sent to the driver 4 will be selected from among pieces of the compressed data outputted from the lossless compression part 47*a*, the (1×4) pixel compression part 47*b*, the (2+1×2) pixel compression part 47*c*, the (2×2) pixel compression part 47*d*, the (3+1) pixel compression part 47*e*, and the (4×1) pixel compression part 47*f*.

Then, selection of the compression processing in the compression circuit 42 and details of each compression processing operation (the lossless compression, the (1×4) pixel compression, the (2+1×2) pixel compression, the (2×2) pixel compression, the (3+1) pixel compression, and the (4×1) pixel compression) will be explained. In the following explanation, the gradation values of the R subpixels of the pixels A, B, C and D are described as $R_A$, $R_B$, $R_C$, and $R_D$, respectively, the gradation values of the G subpixels of the pixels A, B, C and D are described as $G_A$, $G_B$, $G_C$, and $G_D$, respectively, and the gradation values of the B subpixels of the pixels A, B, C and D are described as $B_A$, $B_B$, $B_C$, and $B_D$, respectively.

1. Selection of Compression Processing in Compression Circuit 42

Figure 14:
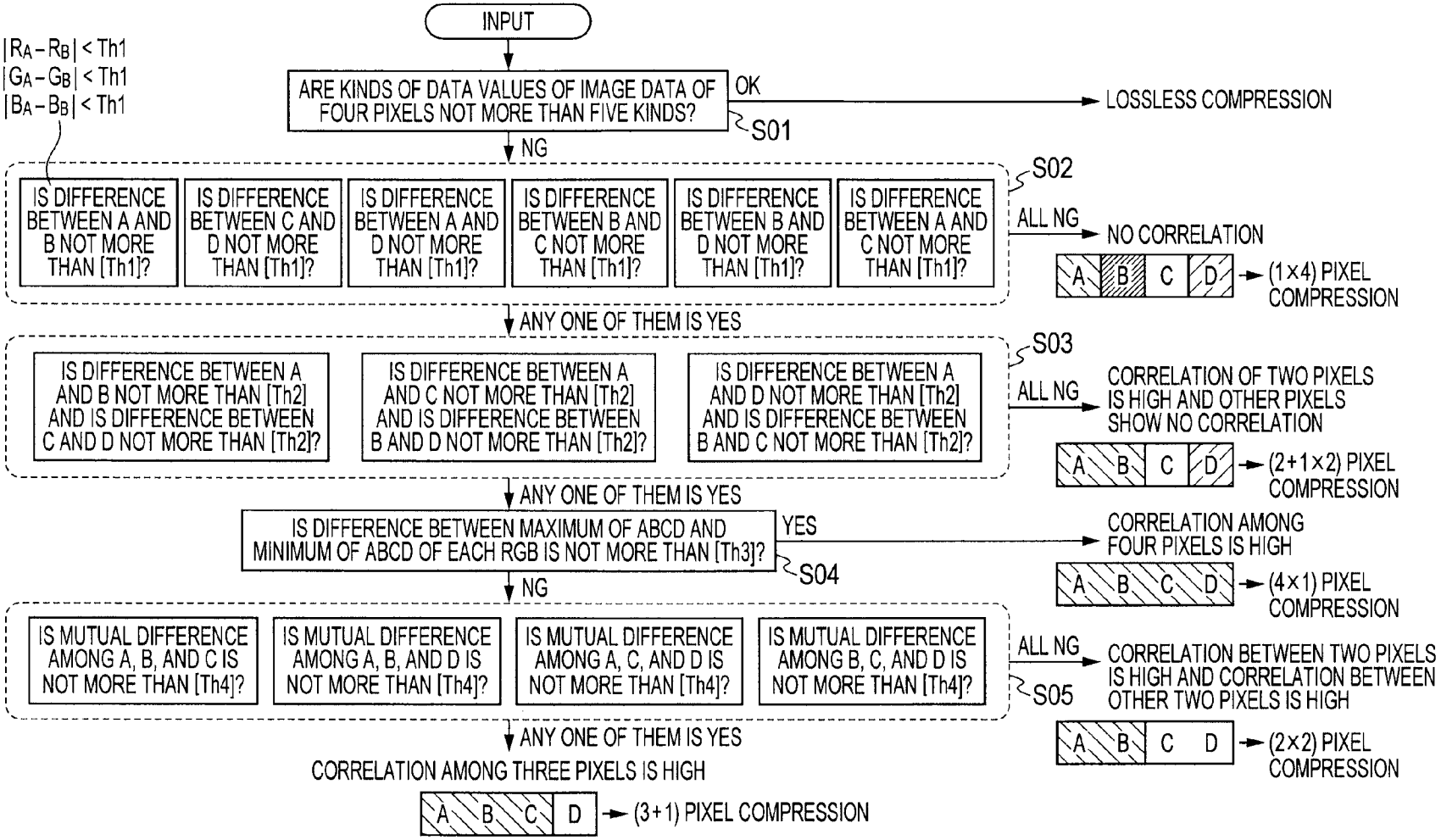
FIG. 14 is a flowchart showing an example of a procedure of selection of the compression processing.

FIG. 14 is a flowchart showing a selection procedure of the compression processing in the compression circuit 42 in this embodiment. The shape recognition part 42*g* of the compression circuit 42 determines whether the image data of the four pixels of the object block corresponds to a specific pattern (Step S01) and, when it corresponds to the specific pattern, selects the lossless compression. In this embodiment, a predetermined pattern whose gradation values of the image data of the four pixels of the object block is fewer than or equal to five kinds is selected as a specific pattern on which the lossless compression is to be performed.

In detail, if the gradation values of the image data of the four pixels of the object block correspond to one of the following four patterns (1) to (4), the lossless compression will be performed:

(1) Gradation Values of Each Color of Four Pixels are Identical (FIG. 15A)

When the gradation values of the image data of the four pixels of the object block satisfy the following condition (1a), the lossless compression is performed. Condition (1a): $R_A=R_B=R_C=R_D$, $G_A=G_B=G_C=G_D$, and $B_A=B_B=B_C=B_D$. In this case, the gradation values of the image data of the four pixels of the object block are three kinds.

(2) Gradation Values of the R Subpixel, the G Subpixel, and the B Subpixel are Identical Among the Four Pixels (FIG. 15*b*)

When the gradation values of the image data of the four pixels of the object block satisfy the following condition (2a), the lossless compression is performed. Condition (2a): $R_A=G_A=B_A$, $R_B=G_B=B_B$, $R_C=G_C=B_C$, and $R_D=G_D=B_D$. In this case, the gradation values of the image data of the four-pixels of the object block are four kinds.

(3) For Four Pixels of the Object Block, the Gradation Values of Two Colors in R, G, and B are Identical (FIG. 15C to FIG. 15E)

When any of the below-mentioned three conditions (3a) to (3c) is satisfied, the lossless compression is performed: Condition (3a): $G_A=G_B=G_C=G_D=B_A=B_B=B_C=B_D$. Condition (3b): $B_A=B_B=B_C=B_D=R_A=R_B=R_C=R_D$. Condition (3c): $R_A=R_B=R_C=R_D=G_A=G_B=G_C=G_D$. In this case, the gradation values of the image data of the four pixels of the object block are five kinds.

(4) When the Gradation Values of One Color in R, G, and B are Identical and the Gradation Values of the Remaining Two Colors are Identical for the Four Pixels of the Object Block (FIG. 15F to FIG. 15H)

Also when further any of the below-mentioned three conditions (4a) to (4c) is satisfied, the lossless compression is performed. Condition (4a): $G_A=G_B=G_C=G_D$, $R_A=B_A$, $R_B=B_B$, $R_C=B_C$, and $R_D=B_D$. Condition (4b): $B_A=B_B=B_C=B_D$, $R_A=G_A$, $R_B=G_B$, $R_C=G_C$, and $R_D=G_D$. Condition (4c): $R_A=R_B=R_C=R_D$, $G_A=B_A$, $G_B=B_B$, $G_C=B_C$, and $G_D=B_D$. In this case, the gradation values of the image data of the four pixels are five kinds.

When the lossless compression is not performed, the compression processing is selected according to the correlation among the four pixels. More specifically, the shape recognition part 42*g* of the compression circuit 42 determines to which case among the following cases the gradation value of each subpixel of the four pixels of the object block corresponds: Case A: A correlation among the image data of an arbitrary combination of pixels in the four pixels is low. Case B: A high correlation exists between the image data of two pixels, and the image data of the other two pixels have low correlations with the previous two pixels and have a low correlation with each other. Case C: A high correlation exists among the image data of the four pixels. Case D: A high correlation exists among the image data of three pixels, and the image data of the other one pixel has low correlations with the previous three pixels. Case E: A high correlation exists between the image data of two pixels and a high correlation exists between the image data of the other two pixels.

In detail, when the following condition (A) does not hold true for all the combination of i and j such that $i\in\{A, B, C, D\}$, $j\in\{A, B, C, D\}$, $i\neq j$, the shape recognition part 42*g* of the compression circuit 42 determines that the status corresponds to Case A (that is, a correlation among the image data of arbitrarily combined pixels from among the four pixels is low) (Step S02). Condition (A): $|Ri-Rj|\leq Th1$, $|Gi-Gj|\leq Th1$, and $|Bi-Bj|\leq Th1$. When the status corresponds to Case A, the shape recognition part 42*g* selects the (1×4) pixel compression.

When it is determined that the status does not correspond to Case A, the shape recognition part 42*g* specifies two pixels of a first pair and two pixels of a second pair for the four pixels, and determines for all combinations thereof whether the following condition is satisfied: a difference of the image data between the two pixels of the first pair is smaller than the prescribed value and a difference of the image data between the two pixels of the second pair is smaller than the prescribed value (Step S03). More specifically, the shape recognition part 42*g* determines whether any of the following conditions (B1) to (B3) holds true (Step S03). Condition (B1): $|R_A-R_B|\leq Th2$, $|G_A-G_B|\leq Th2$, $|B_A-B_B|\leq Th2$, $|R_C-R_D|\leq Th2$, $|G_C-G_D|\leq Th2$, and $|B_C-B_D|\leq Th2$. Condition (B-2): $|R_A-R_C|\leq Th2$, $|G_A-G_C|\leq Th2$, $|B_A-B_C|\leq Th2$, $|R_B-R_D|\leq Th2$, $|G_B-G_D|\leq Th2$, and $|B_B-B_D|\leq Th2$. Condition (B3): $|R_A-R_D|\leq Th2$, $|G_A-G_D|\leq Th2$, $|B_A-B_D|\leq Th2$, $|R_B-R_C|\leq Th2$, $|G_B-G_C|\leq Th2$, and $|B_B-B_C|\leq Th2$.

When none of the above-mentioned conditions (B1) to (B3) holds true, the shape recognition part 42g determines that the status corresponds to Case B (that is, a high correlation exists between the image data of the two pixels, and the image data of the other two pixels have a low correlation with each other). In this case, the shape recognition part 42g selects the (2+1×2) pixel compression.

When it is determined that the status corresponds to neither of Cases A, B, the shape recognition part 42g determines whether a condition that a difference between a maximum and a minimum of the image data of the four subpixels is smaller than the prescribed value is satisfied for each of all the colors of the four pixels. More specifically, the shape recognition part 42g determines whether the following condition (C) holds true (Step S04). Condition (C): max ($R_A$, $R_B$, $R_C$, $R_D$)−min ($R_A$, $R_B$, $R_C$, $R_D$)<Th3, max ($G_A$, $G_B$, $G_D$, $G_D$)−min ($G_A$, $G_B$, $G_C$, $G_D$)<Th3, and max ($B_A$, $B_B$, $B_C$, $B_D$)−min ($B_A$, $B_B$, $B_C$, $B_D$)<Th3.

If the condition (C) holds true, the shape recognition part 42g determines that the status corresponds to Case C (high correlations exist among the four-pixel image data). In this case, the shape recognition part 42g decides to perform the (4×1) pixel compression.

On the other hand, if the condition (C) does not hold true, the shape recognition part 42g determines whether a high correlation exists among any image data of combinations of three pixels of the four pixels and the image data of the other one pixel has low correlations with the three pixels (Step S05). More specifically, the shape recognition part 42g determines whether any of the following conditions (D1) to (D4) holds true (Step S04).

$$|R_A-R_B|\le Th4, |G_A-G_B|\le Th4, |B_A-B_B|\le Th4, |R_B-R_C|\le Th4, |G_B-G_C|\le Th4, |B_B-B_C|\le Th4, |R_C-R_A|\le Th4, |G_C-G_A|\le Th4, \text{and } |B_C-B_A|\le Th4. \quad \text{Condition (D1):}$$

$$|R_A-R_B|\le Th4, |G_A-G_B|\le Th4, |B_A-B_B|\le Th4, |R_B-R_D|\le Th4, |G_B-G_D|\le Th4, |B_B-B_D|\le Th4, |R_D-R_A|\le Th4, |G_D-G_A|\le Th4, \text{and } |B_D-B_A|\le Th4. \quad \text{Condition (D2):}$$

$$|R_A-R_D|\le Th4, |G_A-G_D|\le Th4, |B_A-B_D|\le Th4, |R_D-R_D|\le Th4, |G_C-G_D|\le Th4, |B_C-B_D|\le Th4, |R_D-R_A|\le Th4, |G_D-G_A|\le Th4, \text{and } |B_D-B_A|\le Th4. \quad \text{Condition (D3):}$$

$$|R_B-R_D|\le Th4, |G_B-G_D|\le Th4, |B_B-B_D|\le Th4, |R_D-R_D|\le Th4, |G_C-G_D|\le Th4, |B_C-B_D|\le Th4, |R_D-R_B|\le Th4, |G_D-G_B|<Th4, \text{and } |B_D-B_B|\le Th4. \quad \text{Condition (D4):}$$

If any of the conditions (D1) to (D4) holds true, the shape recognition part 42g will determine that the status corresponds to Case D (that is, a high correlation exists among the image data of three pixels and these three pixels has a low correlation with the image data of the other one pixel). In this case, the shape recognition part 42g decides to perform the (3+1) pixel compression.

If none of the above-mentioned conditions (D1) to (D4) holds true, the shape recognition part 42g determines that the status corresponds to Case E (that is, high correlations exist among the image data of the pixels and a high correlation exists between the image data of the other two pixels. In this case, the shape recognition part 42g decides to perform the (2×2) pixel compression.

The shape recognition part 42g selects any of the (1×4) pixel compression, the (2+1×2) pixel compression, the (2×2) pixel compression, the (3+1) pixel compression, or the (4×1) pixel compression based on the recognition result of correlation as described above. According to the selection result thus obtained, selection of the compressed data outputted from the compression circuit 42 and selection of the compressed data in the comparison circuit 50 are performed.

2. Details of Each Compression Processing and Uncompression Processing

Then, regarding each of the lossless compression, the (1×4) pixel compression, the (2+1×2) pixel compression, the (2×2) pixel compression, the (3+1) pixel compression, and the (4×1) pixel compression, details of the compression processing and details of the uncompression processing will be explained.

2-1. Lossless Compression

Figure 16:
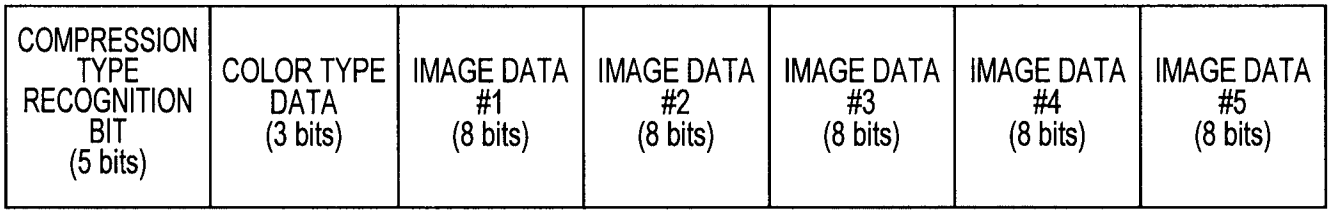
FIG. 16 is a diagram showing a format of the compressed data generated by the lossless compression in this embodiment.

In this embodiment, the lossless compression is performed by rearranging the gradation values of respective subpixels of the pixel of the object block. FIG. 16 is a diagram showing a format of the compressed data generated by the lossless compression. In this embodiment, the compressed data generated by the lossless compression is 48-bit data, and is comprised of the compression type recognition bit, color type data, and image data pieces #1 to #5.

The compression type recognition bit is data indicating a type of the compression processing used for compression and five bits are assigned to the compression type recognition bit for the lossless compressed data. In this embodiment, a value of the compression type recognition bit of the lossless compressed data is "11111."

The color type data is data indicating to which pattern of eight patterns of FIG. 15A to FIG. 15H described above the image data of the four pixels of the object block corresponds. In this embodiment, since eight specific patterns are defined, the color type data is three bits.

The image data pieces #1 to #5 are data obtained by rearranging the data values of the image data of the pixels of the object block. Each of the image data pieces #1 to #5 is eight-bit data. As described above, since the data values of the image data of the four pixels of the object block is five kinds or fewer, all the data values can be stored in the image data pieces #1 to #5.

Uncompression of the compressed data generated by the above-mentioned lossless compression is performed by rearranging the image data pieces #1 to #5 referring to the color type data. Since it is described in the color type data to which pattern among FIG. 15A to FIG. 15H the image data of the four pixels of the object block corresponds, data completely identical to the original image data of the four pixels of the object block can be restored as uncompressed data.

2-2. (1×4) Pixel Compression

Figure 17:
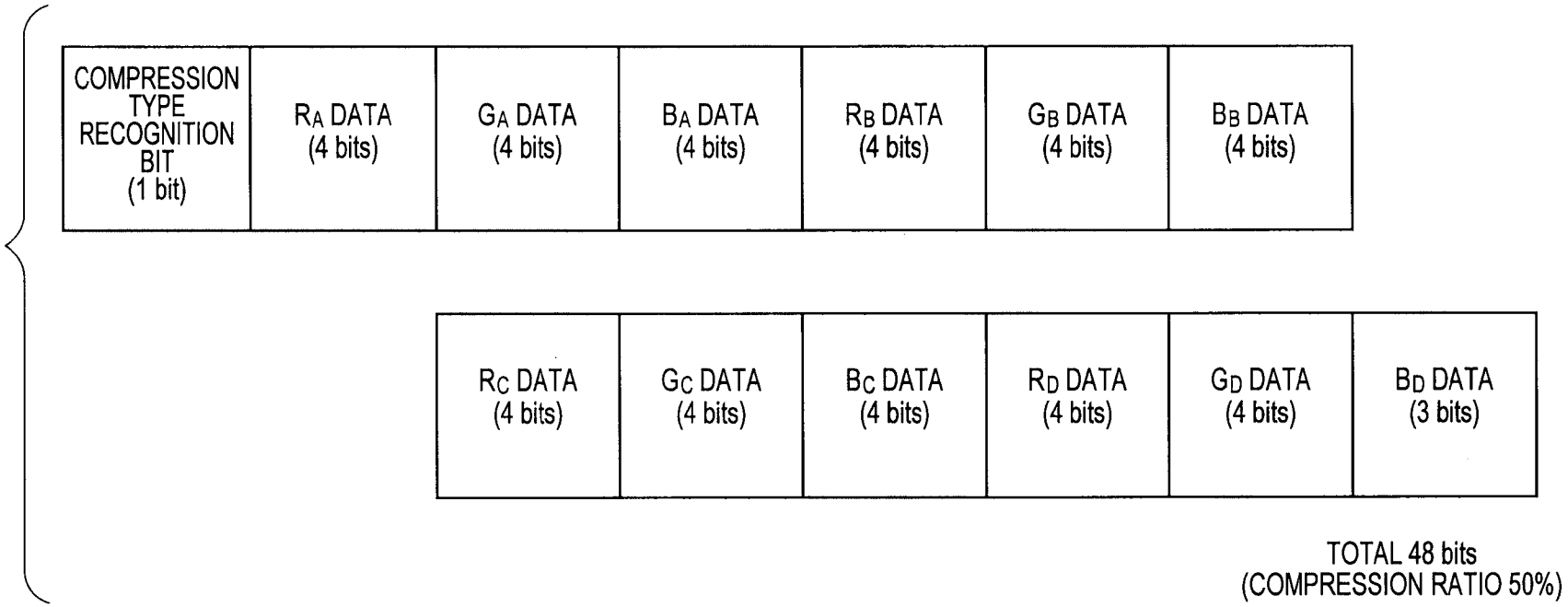
FIG. 17 is a diagram showing a format of (1×4) compressed data.

FIG. 17 is a conceptual diagram showing a format of the (1×4) compressed data. As described above, the (1×4) pixel compression is compression processing that is adopted when the correlation between the image data of pixels of an arbitrary combination from among the four pixels is low. The (1×4) compressed data is comprised of the compression type recognition bit, $R_A$, $G_A$, and $B_A$ data pieces corresponding to the image data of the pixel A, $R_B$, $G_B$, and $B_B$ data pieces corresponding to the image data of the pixel B, $R_C$, $G_C$, and $B_D$ data pieces corresponding to the image data of the pixel C, and $R_D$, $G_D$, and $B_D$ data pieces corresponding to the image data of the pixel D. Here, the compression type recognition bit is data indicating the type of the compression processing used for compression, and one bit is assigned to the compression type recognition bit in the (1×4) pixel compression. In this embodiment, a value of the compression type recognition bit of the (1×4) compressed data is "0."

The $R_A$, $G_A$, and $B_A$ data pieces are bit plane reduction data obtained by performing processing of reducing the number of bit planes on the gradation values of R, G, and B subpixels of the pixel A. The $R_B$, $G_B$, and $B_B$ data pieces are bit plane reduction data obtained by performing processing of reducing the number of bit planes on the gradation values of the R, G, and B subpixels of the pixel B. Similarly, the $R_C$, $G_C$, and $B_C$ data pieces are bit plane reduction data obtained by performing processing of reducing the number of bit planes on the gradation values of the R, G, and B subpixels of the pixel C. The $R_D$, $G_D$, and $B_D$ data pieces are bit plane reduction data obtained by performing processing of reducing the number of bit planes on the gradation values of the R, G, and B subpixels of the pixel D.

In this embodiment, only $B_D$ data corresponding to the B subpixel of the pixel D is three-bit data, and other pieces of data are four-bit data. In this bit allocation, the sum number of bits including the compression type recognition bit becomes 48 bits.

FIG. 18 is a conceptual diagram explaining the (1×4) pixel compression. In the (1×4) pixel compression, the dithering using the dither matrix is performed on each of the pixels A to D and, thereby, the number of bit planes of the image data of the pixels A to D is reduced. In detail, processing of adding error data α to each of the image data pieces of the pixels A, B, C, and D is performed. In this embodiment, the error data α of each pixel is decided from the coordinates of the pixel using a basic matrix that is a Bayer matrix. Computation of the error data α will be described separately later. Below, an explanation will be given assuming that the error data α determined for the pixels A, B, C, and D are 0, 5, 10, and 15, respectively.

Furthermore, rounding is performed and, thereby, the $R_A$, $G_A$, and $B_A$ data pieces, the $R_B$, $G_B$, and $B_B$ data pieces, the $R_C$, $G_C$, and $B_C$ data pieces, the $R_D$, $G_D$, and $B_D$ data pieces are generated. Here, the rounding means processing in which a value $2^{(n-1)}$ is added to data where n is a desired value and lower n bits are omitted. On the gradation value of the B subpixel of the pixel D, processing of adding a value 16 and subsequently omitting lower five bits is performed. A value "0" is added, as the compression type recognition bit, to the $R_A$, $G_A$, and $B_A$ data pieces, the $R_B$, $G_B$, and $B_B$ data pieces, the $R_C$, $G_C$, and $B_C$ data pieces, and the $R_D$, $G_D$, and $B_D$ data pieces that are generated as described above, whereby the (1×4) compressed data is generated.

FIG. 19 is a diagram showing uncompression processing of the (1×4) compressed data. In uncompression of the (1×4) compressed data, first, bit advance of the $R_A$, $G_A$, $B_A$ data pieces, the $R_B$, $G_B$, $B_B$ data pieces, the $R_C$, $G_C$, $B_C$ data pieces, and the $R_D$, $G_D$, $B_D$ data pieces is performed. The number of bits advanced is the same as the number of the bits omitted in the (1×4) pixel compression. That is, five-bit advance is performed for the $B_D$ data corresponding to the B subpixel of the pixel D, and four-bit advance is performed for other data.

Furthermore, subtraction of the error data α is performed and the uncompression of the (1×4) compressed data is completed. Thereby, the (1×4) uncompressed data showing the gradation of each subpixel of the pixels A to D is generated. The (1×4) uncompressed data is data that restored the original image data in general. If the gradation values of the subpixels of the pixels A to D of the (1×4) uncompressed data of FIG. 18 are compared with the gradation values of the subpixels of the pixels A to D of the original image data of FIG. 19, it will be understood that the original image data pieces of the pixels A to D are restored in general by the above-mentioned uncompression processing.

2-3. (2+1×2) Pixel Compression

Figure 20:
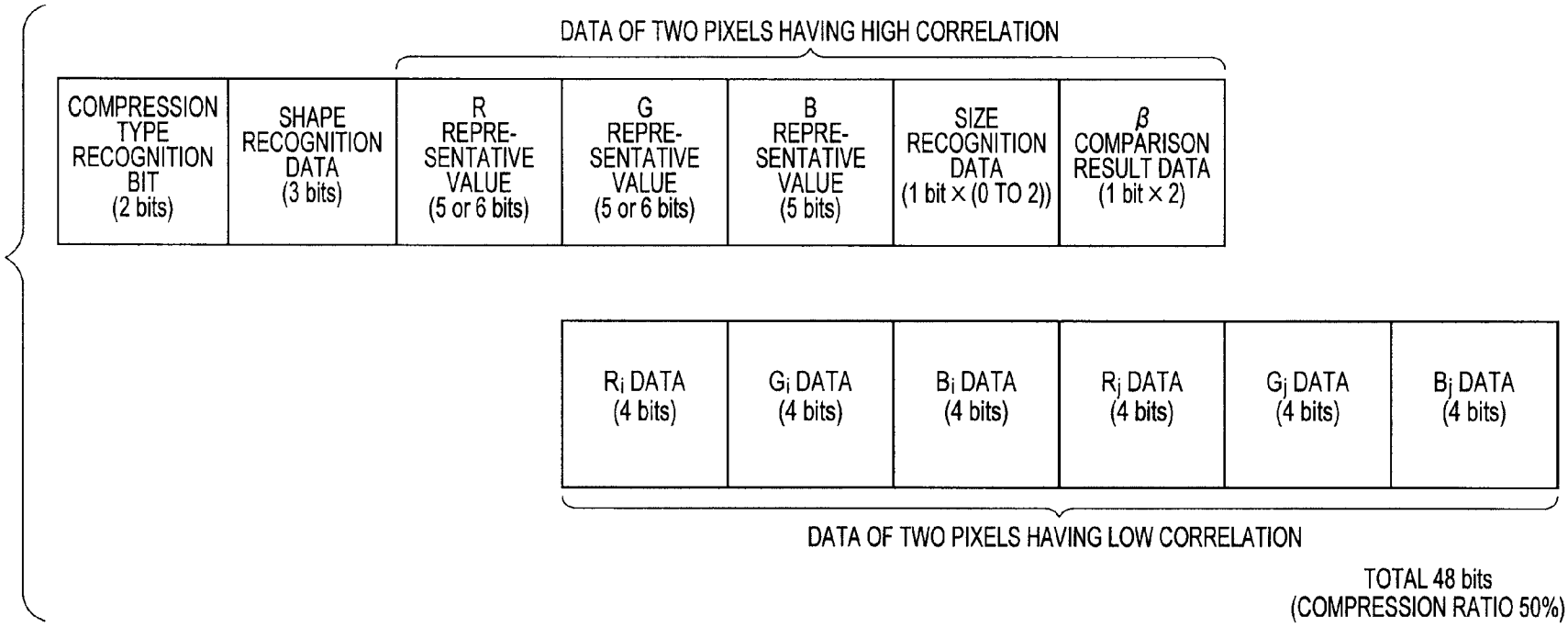
FIG. 20 is a diagram showing a format of (2+1×2) compressed data.

FIG. 20 is a conceptual diagram showing a format of the (2+1×2) compressed data. As described above, the (2+1×2) pixel compression is adopted when a high correlation exists between the image data pieces of two pixels, and the image data pieces of the other two pixels have low correlations with the previous two pixels and have a low correlation with each other.

As shown in FIG. 20, in this embodiment, the (2+1×2) compressed data is comprised of a header including the compression type recognition bit, shape recognition data, the R representative value, the G representative value, the B representative value, size recognition data, β comparison result data, $R_i$, $G_i$, and $B_i$ data pieces, and $R_j$, $G_j$, and $B_j$ data pieces.

The compression type recognition bit is data indicating the type of the compression processing used for compression, and two bits are assigned to the compression type recognition bit in the (2+1×2) compressed data. In this embodiment, a value of the compression type recognition bit of the (2+1×2) compressed data is "10."

The shape recognition data is three-bit data indicating which two pixels have a high correlation between the image data thereof in the pixels A to D. When the (2+1×2) pixel compression is used, the correlation between the image data of two pixels from among the pixels A to D is high, and the remaining two pixels have a low correlation with the image data of other pixels. Therefore, combinations of two pixels whose correlation between the image data is high are the below-mentioned six cases: pixels A, C; pixels B, D; pixels A, B; pixels C, D; pixels B, C; and pixels A, D. The shape recognition data indicates to which combination in these six combinations the two pixels having a high correlation between the image data correspond by three bits.

The R representative value, the G representative value, and the B representative value are values that represent the gradation values of the R subpixels, the G subpixels, and the B subpixels of two pixels having a high correlation, respectively. As illustrated in FIG. 20, the R representative value and the G representative value are each five-bit or six-bit data, and the B representative value is five-bit data.

The β comparison data is data indicating whether a difference between the gradation values of the identical color subpixels of two pixels having a high correlation is larger than the prescribed threshold β. The β comparison data is data indicating whether a difference of the gradation values of the R subpixels of two pixels having a high correlation and a difference of the gradation values of the G subpixels of the two pixels having a high correlation are larger than the prescribed threshold β.

On the other hand, the size recognition data is data indicating which gradation value of the R subpixels of two pixels is larger than that of the other and which gradation value of the G subpixels of two pixels is larger than that of the other in the two pixels having a high correlation. The size recognition data corresponding to the R subpixel is generated only when the difference of the gradation values of the R subpixels of two pixels having a high correlation is larger than the threshold β; the size recognition data corresponding to the G subpixel is generated only when the difference of the gradation values of the G subpixels of two pixels having a high correlation is larger than the threshold β. Therefore, the size recognition data is zero-bit to two-bit data.

The $R_i$, $G_i$, and $B_i$ data pieces and the $R_j$, $G_j$, and $B_j$ data pieces are bit plane reduced data obtained by performing processing of reducing the number of bit planes on the gradation values of the R, G, and B subpixels of the two pixels having a low correlation. Each set of the $R_i$, $G_i$, and $B_i$ data pieces and the $R_j$, $G_j$, and $B_j$ data is four-bit data pieces.

Below, the (2+1×2) pixel compression will be explained referring to FIG. 21. FIG. 21 describes generation of the (2+1×2) compressed data when the correlation between the image data of the pixels A, B is high, the image data of the pixels C, D has a low correlation with the image data of the pixels A, B, and the correlation of the image data between the pixels C, D is low. It will be easily understood by the person skilled in the art that the (2+1×2) compressed data can be similarly generated when a combination of pixels having a high correlation is different.

First, the compression processing of the image data of the pixels A, B (correlation is high) will be explained. First, an average of the gradation values is computed for each of the R subpixel, the G subpixel, and the B subpixel. Averages Rave, Gave, and Bave of the gradation values of the R subpixel, the G subpixel, and the B subpixel are computed by the following formulae: $Rave=(R_A+R_B+1)/2$, $Gave=(G_A+G_B+1)/2$, and $Bave=(B_A+B_B+1)/2$.

Furthermore, a comparison as to whether the difference $|R_A-R_B|$ of the gradation values of the R subpixels and the difference $|G_A-G_B|$ of the gradation values of the G subpixels of the pixels A, B are larger than the prescribed threshold β is made. These comparison results are described in the (2+1×2) compressed data as the β comparison data.

Furthermore, the size recognition data is created by the following procedure. When the difference $|R_A-R_B|$ of the gradation values of the R subpixels of the pixels A, B is larger than the threshold β, which gradation value of the R subpixel is larger than that of the other between the pixels A, B is described in the size recognition data. When the difference $|R_A-R_B|$ of the gradation values of the R subpixels of the pixels A, B is smaller than or equal to the threshold β, a size relation of the gradation values of the R subpixels of the pixels A, B is not described in the size recognition data. Similarly, when the difference $|G_A-G_B|$ of the gradation values of the G subpixels of the pixels A, B is larger than the threshold β, which gradation value of the G subpixel is larger than that of the other between the pixels A, B is described in the size recognition data. When the difference $|G_A-G_B|$ of the gradation values of the G subpixels of the pixels A, B is smaller than or equal to the threshold β, a size relation of the gradation values of the G subpixels of the pixels A, B is not described in the size recognition data.

In the example of FIG. 21, the gradation values of the R subpixels of the pixels A, B are 50 and 59, respectively, and the threshold β is four. In this case, since the difference $|R_A-R_B|$ of the gradation values is larger than the threshold β, this fact is described in the β comparison data, and a fact that the gradation value of the R subpixel of the pixel B is larger than the gradation value of the R subpixel of the pixel A is described in the size recognition data. On the other hand, the gradation values of the G subpixels of the pixels A, B are two and unity, respectively. Since the difference $|G_A-G_B|$ of the gradation values is smaller than or equal to the threshold β, this fact is described in the β comparison data. The size relation of the gradation values of the G subpixels of the pixels A, B is not described in the size recognition data. As a result, the size recognition data becomes one-bit data in the example of FIG. 21.

Then, the error data α is added to the averages Rave, Gave, and Bave of the gradation values of the R subpixel, the G subpixel, and the B subpixel. In this embodiment, the error data α is decided from the coordinates of two pixels of each combination using the basic matrix. Computation of the error data α will be described separately later. Below, in this embodiment, an explanation will be given assuming that the error data α determined for the pixels A, B is zero.

Furthermore, the rounding is performed to compute the R representative value, the G representative value, and the B representative value. A numerical value that is added in the rounding and the number of bits that is omitted by the round-down processing are decided according to the size relation between the differences $|R_A-R_B|$, $|G_A-G_B|$, and $|B_A-B_B|$ of the gradation values and the threshold β, and compressibility. Regarding the R subpixels, when the difference $|R_A-R_B|$ of the gradation values of the R subpixels is larger than the threshold β, processing of adding a value four to the average Rave of the gradation values of the R subpixels of the pixel D and subsequently omitting lower three bits is performed and, thereby, the R representative value is computed. When it is not so, processing of adding a value two to the average Rave and subsequently omitting lower two bits is performed and, thereby, the R representative value is computed. Regarding the G subpixels, similarly, when the difference $|G_A-G_B|$ of the gradation values is larger than the threshold β, processing of adding a value four to the average Gave of the gradation values of the G subpixels and subsequently omitting lower three bits is performed and, thereby, the G representative value is computed. When it is not so, processing of adding a value two to the average Gave and subsequently omitting lower two bits is performed and, thereby, the R representative value is computed. In the example of FIG. 21, regarding the average Rave of the R subpixels, processing of adding a value four and subsequently omitting lower three bits is performed; regarding the average Gave of the G subpixels, processing of adding a value two and subsequently omitting lower two bits is performed. Finally, regarding the B subpixels, processing of adding a value four to the average Bave of the gradation values of the R subpixels and subsequently omitting lower three bits is performed and, thereby, the B representative value is computed. By the above procedure, the compression processing of the image data of the pixels A, B is completed.

On the other hand, on the image data of the pixels C, D (correlation is low), the same processing as the (1×4) pixel compression is performed. That is, for each of the pixels C, D, the dithering using the dither matrix is performed independently and, thereby, the numbers of bit planes of the image data of the pixels C, D are reduced. In detail, first, processing of adding the error data α to each of the image data of the pixels C, D is performed. As described above, the error data α of each pixel is computed from the coordinates of the pixel. Below, an explanation will be given assuming that the error data α determined for the pixels C, D are 10 and 15, respectively.

Furthermore, the rounding is performed to generate the $R_C$, $G_C$, and $B_C$ data pieces and the $R_D$, $G_D$, and $B_D$ data pieces. In detail, processing of adding a value eight to each set of the gradation values of the R, G, and B subpixels of each of the pixels C, D and subsequently omitting lower four bits is performed. Thereby, the $R_C$, $G_C$, and $B_C$ data pieces and the $R_D$, $G_D$, and $B_D$ data pieces are computed.

The (2+1×2) compressed data is generated by adding the compression type recognition bit and the shape recognition data to the R representative value, the G representative value, the B representative value, the size recognition data, the β comparison result data, the $R_C$, $G_C$, and $B_C$ data pieces, and the $R_D$, $G_D$, and $B_D$ data pieces all of which are generated as described above.

Figure 22:
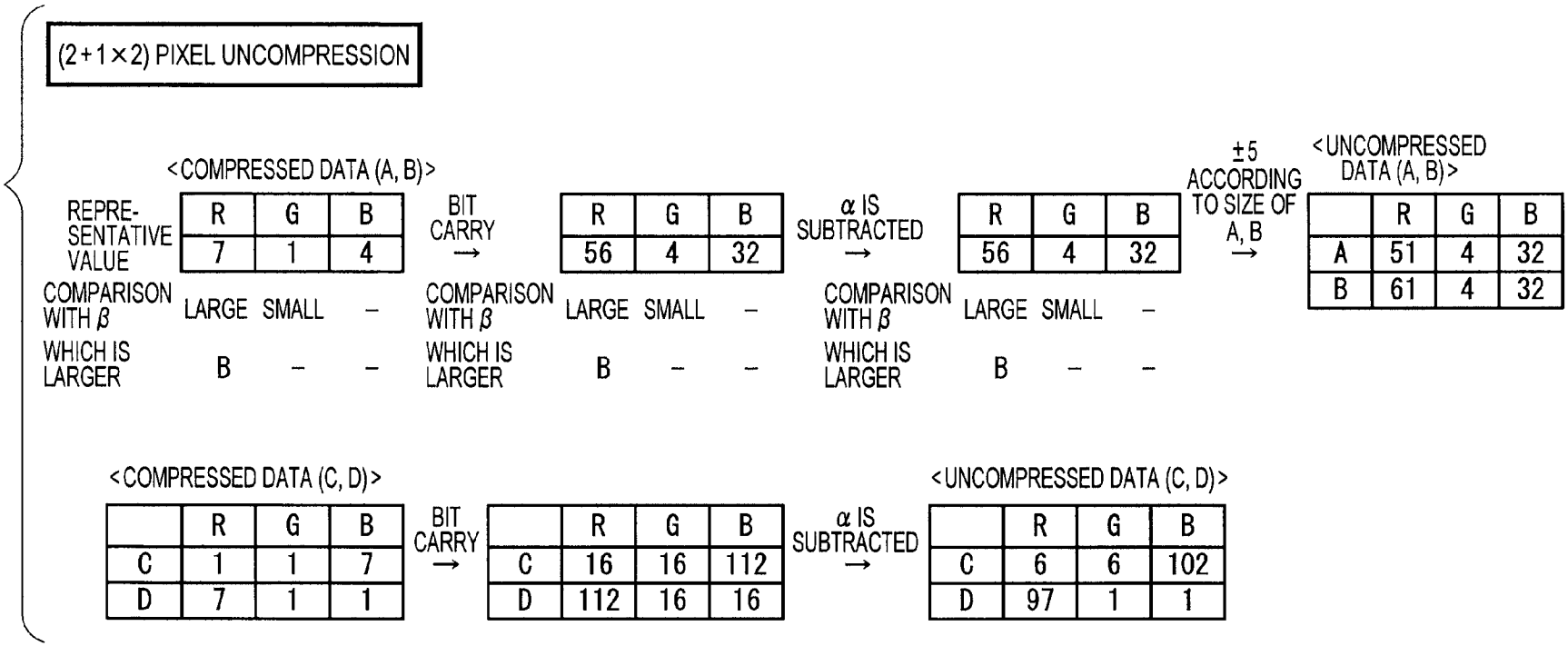
FIG. 22 is a conceptual diagram showing details of uncompression processing of the (2+1×2) compressed data.

On the other hand, FIG. 22 is a diagram showing the uncompression processing of the (2+1×2) compressed data. FIG. 22 describes uncompression of the (2+1×2) compressed data in the case where the correlation between the image data of the pixels A, B is high, the image data of the pixels C, D have low correlations with the image data of the pixels A, B, and the correlation of the image data between the pixels C, D is low. It will be easily understood by the person skilled in the art that also when the correlation between the pixels is different, the (2+1×2) compressed data can be uncompressed similarly.

In uncompression of the (2+1×2) compressed data, first, bit advance processing is performed on the R representative value, the G representative value, and the B representative value. However, execution/non-execution of the bit advance processing is decided depending on the size relation of the differences $|R_A-R_B|$, $|G_A-G_B|$, and $|B_A-B_B|$ of the gradation values and the compressibility described in the β comparison data. When the difference $|R_A-R_B|$ of the gradation values of the R subpixels is larger than the threshold β, three-bit bit advance processing is performed on the R representative value; when it is not so, two-bit bit advance processing is performed. Similarly, when the difference $|G_A-G_B|$ of the gradation values of the G subpixels is larger than the threshold β, the three-bit bit advance processing is performed on the G representative value; when it is not so, the two-bit bit advance processing is performed. In the example of FIG. 22, processing of advancing three bits is performed on the R representative value, and processing of advancing two bits is performed on the G representative value. On the other hand, processing of advancing three bits is performed on the B representative value, without depending on the β comparison data.

After the above-mentioned bit advance processing is completed, subtraction of the error data α is performed on each of the R representative value, the G representative value, and the B representative value, and further processing of restoring the gradation values of the R, G, and B subpixels of the pixels A, B of the (2+1×2) uncompressed data from the R representative value, the G representative value, and the B representative value is performed.

In restoration of the gradation values of the R subpixels of the pixels A, B of the (2+1×2) uncompressed data, the β comparison data and the size recognition data are used. When the β comparison data describes that the difference $|R_A-R_B|$ of the gradation values of the R subpixels is larger than the threshold β, a value obtained by adding a constant value five to the R representative value is restored as the gradation value of the R subpixel of the pixel that is described to be large in the size recognition data in the pixels A, B, and a value obtained by subtracting a constant value five from the R representative value is restored as the gradation value of the R subpixel of the pixel that is described to be small in the size recognition data. On the other hand, when the difference $|R_A-R_B|$ of the gradation values of the R subpixels is smaller than the threshold β, the gradation values of the R subpixels of the pixels A, B are restored so as to agree with the R representative value. In the example of FIG. 22, the gradation value of the R subpixel of the pixel A is restored as a value obtained by subtracting a value five from the R representative value, and the gradation value of the R subpixel of the pixel B is restored as a value obtained by adding a value five to the R representative value. Also in the restoration of the gradation values of the G subpixels of the pixels A, B, the same processing is performed using the β comparison data and the size recognition data. In the example of FIG. 22, the restoration is performed assuming that both values of the G subpixels of the pixels A, B agree with the G representative value.

However, since the β comparison data and the size recognition data do not exist for the B subpixels of the pixels A, B, restoration is performed assuming that values of the B subpixels of the pixels A, B both agree with the B representative value regardless of the β comparison data and the size recognition data.

By the above procedure, the restoration of the gradation values of the R subpixels, the G subpixels, and the B subpixels of the pixels A, B is completed.

On the other hand, in the uncompression processing on the image data of the pixels C, D (correlation is low), the same processing as the above-mentioned uncompression processing of the (1×4) compressed data is performed. In the uncompression processing on the image data of the pixels C, D, first, the four-bit bit advance processing is performed on each of the $R_C$, $G_C$, and $B_C$ data pieces, and the $R_D$, $G_D$, and $B_D$ data pieces. Furthermore, subtraction of the error data α is performed and, thereby, the gradation values of the R subpixels, the G subpixels, and the B subpixels of the pixels C, D are restored.

By the above procedure, the restoration of the gradation values of the R subpixels, the G subpixels, and the B subpixels of the pixels C, D is completed. The gradation values of the R subpixels, the G subpixels, and the B subpixels of the pixels C, D are restored as values of eight bits.

2-4. (2×2) Pixel Compression

Figure 23:
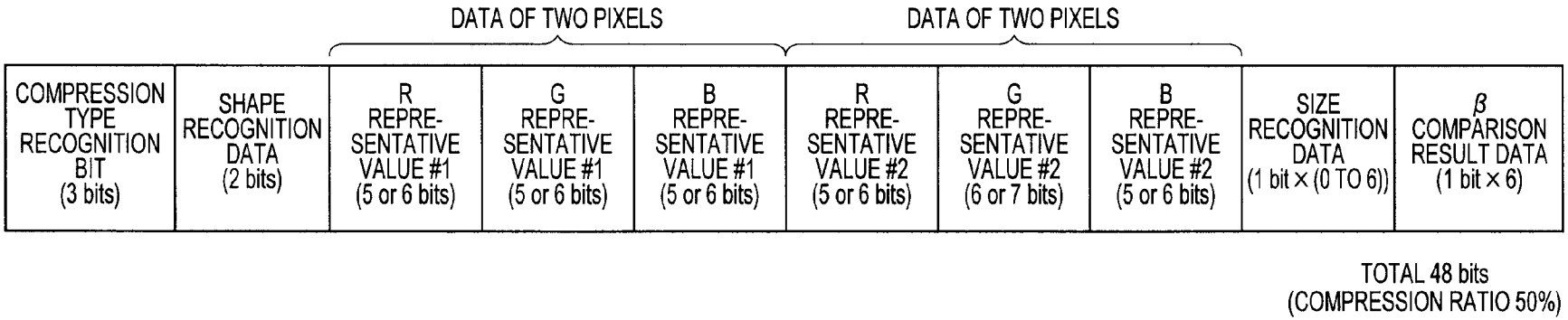
FIG. 23 is a diagram showing a format of (2×2) compressed data.
Figure 26:
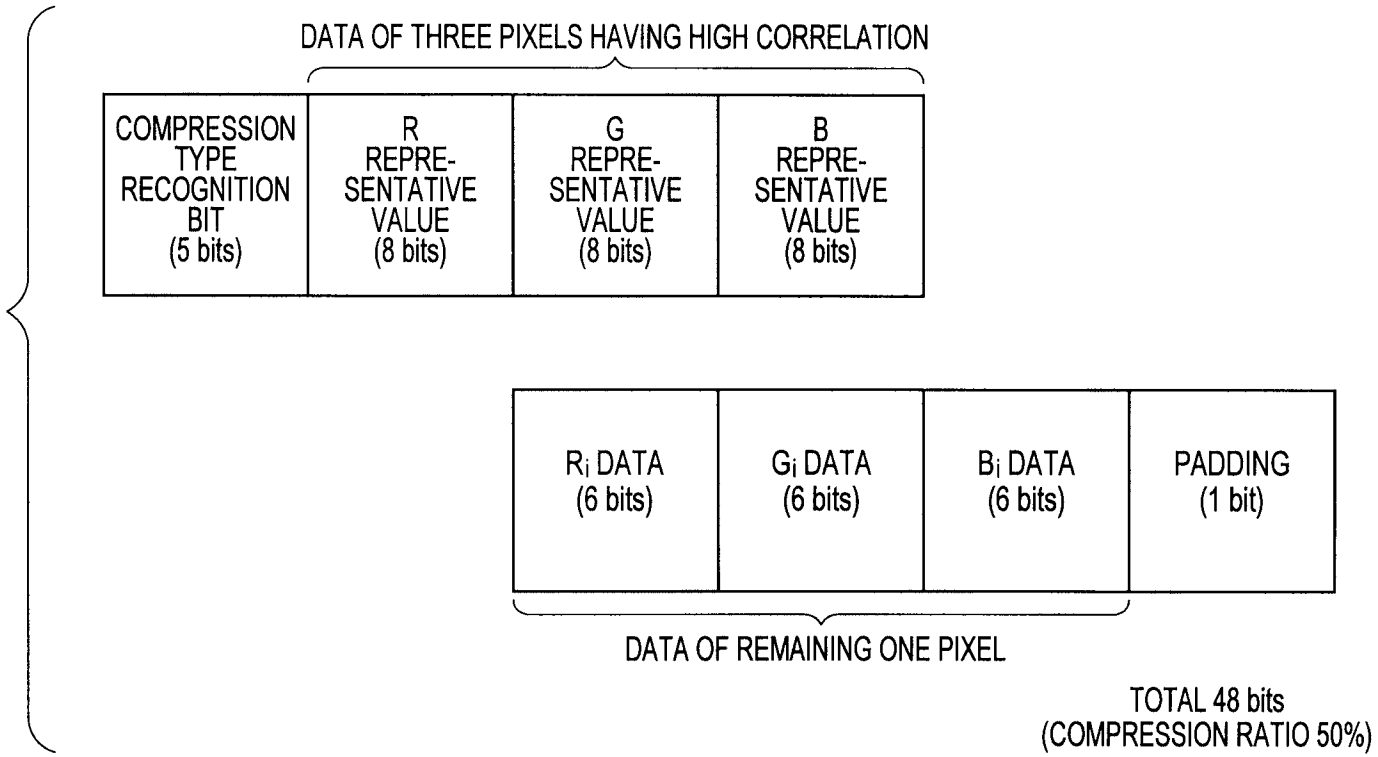
FIG. 26 is a diagram showing a format of (3+1) pixel compressed data.

FIG. 23 is a conceptual diagram showing a format of the (2×2) compressed data. As described above, the (2×2) pixel compression is compression processing that is used when a high correlation exists between the image data of two pixels and a high correlation exists between the image data of the other two pixels.

In this embodiment, the (2×2) compressed data is comprised of the compression type recognition bit, the shape recognition data, an R representative value #1, a G representative value #1, a B representative value #1, an R representative value #2, a G representative value #2, a B representative value #2, the size recognition data, and the β comparison result data.

The compression type recognition bit is data indicating the type of the compression processing used for compression and three bits are assigned to the compression type recognition bit in the (2×2) compressed data. In this embodiment, a value of the compression type recognition bit of the (2×2) compressed data is "110."

The shape recognition data is two-bit data indicating which pair of two pixels from among the pixels A to D has a higher correlation between the image data thereof. When the (2×2) pixel compression is used, a high correlation exists between the image data of two pixels from among the pixels A to D, and a high correlation exists between the image data of the other two pixels. Therefore, combinations of two pixels whose correlation of the image data is high are following three cases: A correlation of the pixels A, B is high and a correlation of the pixels C, D is high; A correlation of the pixels A, C is high and a correlation of the pixels B, D is high; and A correlation of the pixels A, D is high and a correlation of the pixels B, C is high. The shape recognition data shows which one from among these three combinations exists by two bits.

The R representative value #1, the G representative value #1, and the B representative value #1 are values representing the gradation values of two pixels of the one pair, respectively, and the R representative value #2, the G representative value #2, and the B representative value #2 are values representing the gradation values of two pixels of the other pair, respectively. As illustrated in FIG. 23, the R representative value #1, the G representative value #1, the B representative value #1, the R representative value #2, and the B representative value #2 are each five-bit or six-bit data, and the G representative value #2 is six-bit or seven-bit data.

The β comparison data is data indicating whether a difference of the gradation values of the R subpixels of the two pixels having a high correlation, a difference of the gradation values of the G subpixels of the two pixels having a high correlation, and a difference of the gradation values of the R subpixels of the two pixels having a high correlation are larger than the prescribed threshold β. In this embodiment, the β comparison data of the (2×2) compressed data is six-bit data such that three bits are assigned to each of two pairs each having two pixels. On the other hand, the size recognition data is data indicating which pixel in the two pixels having a high correlation has a larger gradation value of the R subpixel, which pixel in the two pixels having a high correlation has a larger gradation value of the G subpixel, and which pixel in the two pixels having a high correlation has a larger gradation value of the B subpixel. The size recognition data corresponding to the R subpixel is generated only when the difference of the gradation values of the R subpixels of the two pixels having a high correlation is larger than the threshold β; the size recognition data corresponding to the G subpixel is generated only when the difference of the gradation values of the G subpixels of the two pixels having a high correlation is larger than the threshold β; and the size recognition data corresponding to the B subpixel is generated only when the difference of the gradation values of the R subpixels of the two pixels having a high correlation is larger than the threshold β. Therefore, the size recognition data of the (2×2) compressed data is zero- to six-bit data.

Below, the (2×2) pixel compression will be explained referring to FIG. 24. FIG. 24 describes generation of the (2×2) compressed data when a correlation between the image data of the pixels A, B is high and a correlation between the image data of the pixels C, D is high. It will be easily understood by the person skilled in the art that the (2×2) compressed data can be similarly generated when the correlation between pixels is different.

First, the average of the gradation values is computed for each of the R subpixel, the G subpixel, and the B subpixel. The averages Rave1, Gave1, and Bave1 of the gradation values of the R subpixel, the G subpixel, and the B subpixel of the pixels A, B and the averages Rave2, Gave2, and Bave2 of the gradation values of the R subpixel, the G subpixel, and the B subpixel of the pixel C, D are computed by the following formulae: Rave1=$(R_A+R_B+1)/2$, Gave1=$(G_A+G_B+1)/2$, Bave1=$(B_A+B_B+1)/2$, Rave2=$(R_A+R_B+1)/2$, Gave2=$(G_A+G_B+1)/2$, and Bave2=$(B_A+B_B+1)/2$.

Furthermore, a comparison is made as to whether the difference $|R_A-R_B|$ of the gradation values of the R subpixels, the difference $|G_A-G_B|$ of the gradation values of the G subpixels, and the difference $|B_A-B_B|$ of the gradation values of the B subpixels of the pixels A, B are larger than the prescribed threshold β. Similarly, a comparison is made as to whether the difference $|R_C-R_D|$ of the gradation values of the R subpixels, the difference $|G_C-G_D|$ of the gradation values of the G subpixels, and the difference $|B_C-B_D|$ of the gradation values of the B subpixels of the pixels C, D are larger than the prescribed threshold β. These comparison results are described in the (2×2) compressed data as the β comparison data.

Furthermore, the size recognition data is created for each of the combination of the pixels A, B and the combination of the pixels C, D.

In detail, when the difference $|R_A-R_B|$ of the gradation values of the R subpixels of the pixels A, B is larger than the threshold β, it is described in the size recognition data which R subpixel of the pixels A, B has a larger gradation value. When the difference $|R_A-R_B|$ of the gradation values of the R subpixels of the pixels A, B is smaller than or equal to the threshold β, the size relation of the gradation values of the R subpixels of the pixels A, B is not described in the size recognition data. Similarly, when the difference $|G_A-G_B|$ of the gradation values of the G subpixels of the pixels A, B is larger than the threshold β, it is described in the size recognition data which G subpixel of the pixels A, B has a larger gradation value. When the difference $|G_A-G_B|$ of the gradation values of the G subpixels of the pixels A, B is smaller than or equal to the threshold β, the size relation of the gradation values of the G subpixels of the pixels A, B is not described in the size recognition data. In addition, when the difference $|B_A-B_B|$ of the gradation values of the B subpixels of the pixels A, B is larger than the threshold β, it is described in the size recognition data which B subpixel of the pixels A, B has a larger gradation value. When the difference $|B_A-B_B|$ of the gradation values of the B subpixels of the pixels A, B is smaller than or equal to the threshold β, the size relation of the gradation values of the B subpixels of the pixels A, B is not described in the size recognition data.

Similarly, when the difference $|R_C-R_D|$ of the gradation values of the R subpixels of the pixels C, D is larger than the threshold β, it is described in the size recognition data which R subpixel of the pixels C, D has a larger gradation value. When the difference $|R_C-R_D|$ of the gradation values of the R subpixels of the pixels C, D is smaller than or equal to the threshold β, the size relation of the gradation values of the R subpixels of the pixels C, D is not described in the size recognition data. Similarly, when the difference $|G_C-G_D|$ of the gradation values of the G subpixels of the pixels C, D is larger than the threshold β, it is described in the size recognition data which G subpixel of the pixels C, D has a larger gradation value. When the difference $|G_C-G_D|$ of the gradation values of the G subpixels of the pixels C, D is smaller than or equal to the threshold β, the size relation of the gradation values of the G subpixels of the pixels C, D is not described in the size recognition data. In addition, when the difference $|B_C-B_D|$ of the gradation values of the B subpixels of the pixels C, D is larger than the threshold β, it is described in the size recognition data which B subpixel of the pixels C, D has a larger gradation value. When the difference $|B_C-B_D|$ of the gradation values of the B subpixels of the pixels C, D is smaller than or equal to the threshold β, the size relation of the gradation values of the B subpixels of the pixels C, D is not described in the size recognition data.

In the example of FIG. 24, the gradation values of the R subpixels of the pixels A, B are 50 and 59, respectively, and the threshold β is four. In this case, since the difference $|R_A-R_B|$ of the gradation values is larger than the threshold β, this fact is described in the β comparison data, and a fact that the gradation value of the R subpixel of the pixel B is larger than the gradation value of the R subpixel of the pixel A is described in the size recognition data. On the other hand, the gradation values of the G subpixels of the pixels A, B are two and unity, respectively. In this case, since the difference $|G_A-G_B|$ of the gradation values is smaller than or equal to the threshold β, this fact is described in the β comparison data. The size relation of the gradation values of the G subpixels of the pixels A, B is not described in the size recognition data. Furthermore, the gradation values of the B subpixels of the pixels A, B are 30 and 39, respectively. In this case, since the difference $|B_A-B_B|$ of the gradation values is larger than the threshold β, this fact is described in the β comparison data, and a fact that the gradation value of the B subpixel of the pixel B is larger than the gradation value of the B subpixel of the pixel A is described in the size recognition data.

Moreover, both of gradation values of the R subpixels of the pixels C, D are 100. In this case, since the difference $|R_C-R_D|$ of the gradation values is smaller than or equal to the threshold β, this fact is described in the β comparison data.

The size relation of the gradation values of the G subpixels of the pixels A, B is not described in the size recognition data. Moreover, the gradation values of the G subpixels of the pixels C, D are 80 and 85, respectively. In this case, since the difference $|G_C-G_D|$ of the gradation values is larger than the threshold β, this fact is described in the β comparison data, and a fact that the gradation value of the G subpixel of the pixel D is larger than the gradation value of the G subpixel of the pixel C is described in the size recognition data. Furthermore, the gradation values of the B subpixels of the pixels C, D are 8 and 2, respectively. In this case, since the difference $|B_C-B_D|$ of the gradation values is larger than the threshold β, this fact is described in the β comparison data, and a fact that the gradation value of the B subpixel of the pixel C is larger than the gradation value of the B subpixel of the pixel D is described in the size recognition data.

Furthermore, the error data α is added to the averages Rave1, Gave1, and Bave1 of the gradation values of the R subpixels, the G subpixels, and the B subpixels of the pixels A, B and the averages Rave2, Gave2, and Bave2 of the gradation values of the R subpixels, the G subpixels, and the B subpixels of the pixels C, D. In this embodiment, the error data α is decided from the coordinates of two pixels of each combination using the basic matrix that is the Bayer matrix. Computation of the error data α will be described separately later. Below, in this embodiment, an explanation will be given assuming that the error data α determined for the pixels A, B is zero.

Furthermore, the rounding and bit round-down processing are performed to compute the R representative value #1, the G representative value #1, the B representative value #1, the R representative value #2, the G representative value #2, and the B representative value #2. The rounding and the bit round-down processing are performed according to the compressibility. Regarding the pixels A, B, a numerical value that is added in the rounding and the number of bits that are omitted by the bit round-down processing are decided to be two bits or three bits according to the size relation between the differences $|R_A-R_B|$, $|G_A-G_B|$, and $|B_A-B_B|$ of the gradation values and the threshold β. Regarding the R subpixel, when the difference $|R_A-R_B|$ of the gradation values of the R subpixels is larger than the threshold β, processing of adding a value four to the gradation values of the R subpixels and subsequently omitting lower three bits is performed and, thereby, the R representative value #1 is computed. When it is not so, processing of adding a value two to the average Rave1 and subsequently omitting lower two bits is performed and, thereby, the R representative value #1 is computed. As a result, the R representative value #1 becomes five bits or six bits. The computation is also the same for the G subpixel and the B subpixel. When the difference $|G_A-G_B|$ of the gradation values is larger than the threshold β, processing of adding a value four to the average Gave1 of the gradation values of the G subpixels and subsequently omitting lower three bits is performed and, thereby, the G representative value #1 is computed. When it is not so, processing of adding a value two to the average Gave and subsequently omitting lower two bits is performed and, thereby, the G representative value #1 is computed. Furthermore, when the difference $|B_A-B_B|$ of the gradation values is larger than the threshold β, processing of adding a value four to the average Bave1 of the B subpixels and subsequently omitting lower three bits is performed and, thereby, the B representative value #1 is computed. When it is not so, processing of adding a value two to the average Bave1 and subsequently omitting lower two bits is performed and, thereby, the B representative value #1 is computed.

In the example of FIG. 24, on the average Rave1 of the R subpixels of the pixels A, B, processing of adding a value four and subsequently omitting lower three bits is performed and, thereby, the R representative value #1 is computed. Moreover, on the average Gave1 of the G subpixels of the pixels A, B, processing of adding a value two and subsequently omitting lower two bits is performed and, thereby, the G representative value #1 is computed. Furthermore, on the B subpixels of the pixels A, B, processing of adding a value four to the average Bave1 of the B subpixels and subsequently omitting lower three is performed and, thereby, the B representative value #1 is computed.

On a combination of the pixels C, D, the same processing is performed and, thereby, the R representative value #2, the G representative value #2, and the B representative value #2 are computed. However, regarding the G subpixels of the pixels C, D, a numerical value added in the rounding and the number of bits omitted by the bit round-down processing are one bit and two bits, respectively. When the difference $|G_C-G_D|$ of the gradation values is larger than the threshold β, processing of adding a value two to the average Gave2 of the G subpixels and subsequently omitting lower two bits is performed and, thereby, the G representative value #2 is computed. When it is not so, processing of adding a value unity to the average Gave2 and subsequently omitting lower one bit is performed and, thereby, the G representative value #2 is computed.

In the example of FIG. 24, on the average Rave2 of the R subpixels of the pixels C, D, processing of adding a value two and subsequently omitting lower two bits is performed and, thereby, the R representative value #2 is computed. Moreover, on the average Gave2 of the G subpixels of the pixels C, D, processing of adding a value four and subsequently omitting lower three bits is performed and, thereby, the G representative value #2 is computed. Furthermore, on the B subpixels of the pixels C, D, processing of adding a value four to the average Bave2 of the gradation values of the B subpixels and subsequently omitting lower three bits is performed and, thereby, the B representative value #2 is computed.

By the above procedure, the compression processing by the (2×2) pixel compression is completed.

On the other hand, FIG. 25 is a diagram showing the uncompression processing of the compressed image data compressed by the (2×2) pixel compression. FIG. 25 describes uncompression of the (2×2) compressed data when the correlation between the image data of the pixels C, D is high and the correlation between the image data of the pixels A, B is high. It will be easily understood by the person skilled in the art that the (2×2) compressed data can be similarly uncompressed when the correlations between pixels are different.

First, the bit advance processing is performed on the R representative value #1, the G representative value #1, and the B representative value #1. The number of bits of the bit advance processing is decided according to the size relation of the differences $|R_A-R_B|$, $|G_A-G_B|$, and $|B_A-B_B|$ of the gradation values and the threshold β and the compressibility that are described in the β comparison data. When the difference $|R_A-R_B|$ of the gradation values of the R subpixels of the pixels A, B is larger than the threshold β, the three-bit bit advance processing is performed on the R representative value #1; when it is not so, the two-bit bit advance processing is performed. Similarly, when the difference $|G_A-G_B|$ of the gradation values of the G subpixels of the pixels A, B is larger than the threshold β, the three-bit bit advance processing is performed on the G representative value #1; when it is not so, the two-bit bit advance processing is performed. Furthermore, when the difference $|B_A-B_B|$ of the gradation values of the B subpixels of the pixels A, B is larger than the threshold β, the three-bit bit advance processing is performed on the B representative value #1; when it is not so, the two-bit bit advance processing is performed. In the example of FIG. 25, processing of advancing three bits is performed on the R representative value #1, processing of advancing two bits is performed on the G representative value #1, and processing of advancing three bits is performed on the B representative value #1.

The same bit advance processing is performed on the R representative value #2, the G representative value #2, and the B representative value #2. However, the number of bits of the bit advance processing of the G representative value #2 is selected from one bit and two bits. When the difference $|G_C-G_D|$ of the gradation values of the G subpixels of the pixels C, D is larger than the threshold β, the two-bit bit advance processing is performed on the G representative value #2; when it is not so, one-bit bit advance processing is performed. In the example of FIG. 25, processing of advancing two bits is performed on the R representative value #2, processing of advancing two bits is performed on the G representative value #2, and processing of advancing three bits is performed on the B representative value #2.

Furthermore, after the error data α is subtracted from each of the R representative value #1, the G representative value #1, the B representative value #1, the R representative value #2, the G representative value #2, and the B representative value #2, processing of restoring the gradation values of the R, G, and B subpixels of the pixels A, B and the gradation values of the R, G, and B subpixels of the pixels C, D from these representative values is performed.

In the restoration of the gradation values, the β comparison data and the size recognition data are used. In the β comparison data, when the difference $|R_A-R_B|$ of the gradation values of the R subpixels of the pixels A, B is described to be larger than the threshold β, a value obtained by adding a constant value five to the R representative value #1 is restored as the gradation value of the R subpixel that is described to be large in the size recognition data in the pixels A, B, and a value obtained by subtracting a constant value five from the R representative value #1 is restored as the gradation value of the R subpixel that is described to be small in the size recognition data. When the difference $|R_A-R_B|$ of the gradation values of the R subpixels of the pixels A, B is smaller than the threshold β, the restoration is performed assuming that the gradation values of the R subpixels of the pixels A, B agree with the R representative value #1. Similarly, the gradation values of the G subpixels and the B subpixels of the pixels A, B and the gradation values of the R subpixels, the G subpixels, and the B subpixels of the pixels C, D are also restored by the same procedure.

In the example of FIG. 25, the gradation value of the R subpixel of the pixel A is restored as a value obtained by subtracting only a value five from the R representative value #1, and the gradation value of the R subpixel of the pixel B is restored as a value obtained by adding a value five to the R representative value #1. Moreover, the gradation values of the G subpixels of the pixels A, B are restored as a value agreeing with the G representative value #1. Furthermore, the gradation value of the B subpixel of the pixel A is restored as a value obtained by subtracting only a value five from the B representative value #1, and the gradation value of the B subpixel of the pixel B is restored as a value obtained by adding a value five to the B representative value #1. On the other hand, the gradation values of the R subpixels of the pixels C, D are restored as a value agreeing with the B representative value #2. Moreover, the gradation value of the G subpixel of the pixel C is restored as a value obtained by subtracting only a value five from the G representative value #2, and the gradation value of the G subpixel of the pixel D is restored as a value obtained by adding a value five to the G representative value #2. Furthermore, the gradation value of the B subpixel of the pixel C is restored as a value obtained by adding a value five to the G representative value #2, and the gradation value of the B subpixel of the pixel D is restored as a value obtained by subtracting a value five from the G representative value #2.

By the above procedure, the restoration of the gradation values of the R subpixel, the G subpixel, and the B subpixel of the pixels A to D is completed. If the image data of pixels A to D in the right column of FIG. 25 and the image data of pixels A to D in the left column of FIG. 24 are compared, it will be understood in general that by the above-mentioned uncompression processing, the original image data pieces of the pixels A to D are restored.

2-5. (3+1) Pixel Compression

FIG. 25 is a conceptual diagram showing a format of the compressed data compressed by the (3+1) pixel compression. As described above, the (3+1) pixel compression is compression processing that is used when a high correlation exists between the image data of three pixels, and a correlation between the image data of the three pixels and the image data of a remaining pixel is low. As shown in FIG. 25, in this embodiment, the compressed data generated by the (3+1) pixel compression is 48-bit data, which includes the compression type recognition bit, the R representative value, the G representative value, the B representative value, the Ri data, the $G_i$ data, the $B_i$ data, and padding data.

The compression type recognition bit is data indicating the type of the compression processing used for compression, and five bits are assigned to the compression type recognition bit in the compressed data generated by the (3+1) pixel compression. In this embodiment, a value of the compression type recognition bit of the compressed data generated by the (3+1) pixel compression is "11110."

The R representative value, the G representative value, and the B representative value are values that represent the gradation values of the R subpixels, the G subpixels, and the B subpixels of three pixels having a high correlation, respectively. The R representative value, the G representative value, and the B representative value are computed as averages of the gradation values of the R subpixels, the G subpixels, and the B subpixels of the three pixels having the high correlation, respectively. In the example of FIG. 25, each of the R representative value, the G representative value, and the B representative value is eight-bit data.

On the other hand, the $R_i$, $G_i$, and $B_i$ data pieces and the $R_j$, $G_j$, and $B_j$ data pieces are each bit plane reduction data obtained by performing processing of reducing the number of bit planes on the gradation values of the R, G, and B subpixels of the remaining one pixel. In this embodiment, each of the $R_i$, $G_i$, and $B_i$ data pieces and the $R_j$, $G_j$, and $B_j$ data pieces is six-bit data.

The padding data is added in order to make the compressed data generated by the (3+1) pixel compression have the same number of bits as the compressed data generated by the other compression processing. In this embodiment, the padding data is one-bit data.

Figure 27:
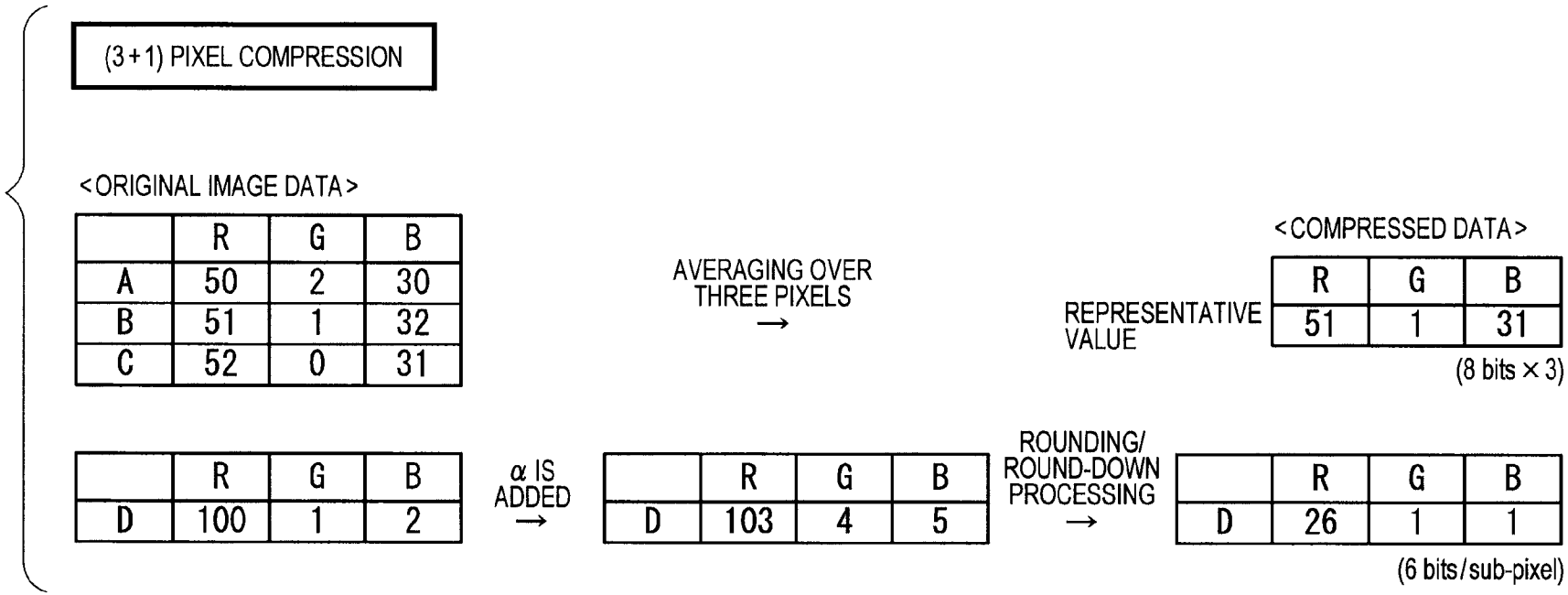
FIG. 27 is a conceptual diagram showing processing details of (3+1) pixel compression.

Below, the (3+1) pixel compression will be explained referring to FIG. 27. FIG. 27 describes generation of the compressed data when correlations among the image data pieces of the pixels A, B, and C are high and the image data of the pixel D has a low correlation with the image data of the pixels A, B, and C. It will be easily understood by the person skilled in the art that in other cases, the compressed data can be generated in the similar manner.

First, an average of the gradation values of the R subpixels, an average of the gradation values of the G subpixels, and an average of the gradation values of the B subpixels of the pixels A, B, and C are computed, respectively, and the computed averages are decided as the R representative value, the G representative value, and the B representative value, respectively. The R representative value, the G representative value, and the B representative value are computed by the following formulae: Rave1=$(R_A+R_B+R_C)/3$, Gave1=$(G_A+G_B+G_C)/3$, and Bave1=$(B_A+B_B+B_C)/3$.

On the other hand, on the image data of the pixel D (correlation is low), the same processing as the (1×4) pixel compression is performed. That is, the dithering using the dither matrix is performed on the pixel D independently and, thereby, the number of bit planes of the image data of the pixel D is reduced. In detail, first, processing of adding the error data α to each of the image data of the pixel D is performed. As described above, the error data α of each pixel is computed from the coordinates of the pixel. Below, an explanation will be given assuming that the error data α determined for the pixel D is three.

Furthermore, the rounding is performed to generate the $R_D$, $G_D$, and $B_D$ data. In detail, processing in which a value two is added to each of the gradation values of the R, G, and B subpixels of the pixel D, and subsequently lower two bits are omitted is performed. Thereby, the $R_C$, $G_C$, and $B_C$ data pieces and the $R_D$, $G_D$, and $B_D$ data pieces are computed.

On the other hand, FIG. 27 is a diagram showing the uncompression processing of the compressed data compressed by the (3+1) pixel compression. FIG. 27 describes uncompression of the compressed data generated by the (3+1) pixel compression when the correlation between the image data of the pixels A, B is high and the correlation between the image data of the pixels C, D is high. It will be easily understood by the person skilled in the art that in other cases, the compressed data generated by the (3+1) pixel compression can be uncompressed in the similar manner.

In the uncompression processing of the compressed data compressed by the (3+1) pixel compression, the uncompressed data is generated on the assumption that the gradation value of the R subpixel of each of the pixels A, B, and C agrees with the R representative value, the gradation value of the G subpixel of each of the pixels A, B, and C agrees with the G representative value, and the gradation value of the B subpixel of each of the pixels A, B, and C agrees with the B representative value.

On the other hand, on the pixel D, the same processing as the above-mentioned uncompression processing of the (1×4) compressed data is performed. In the uncompression processing on the image data of the pixel D, first, the two-bit bit advance processing is performed on each of the $R_D$, $G_D$, and $B_D$ data pieces. Furthermore, subtraction of the error data α is performed and, thereby, the gradation values of the R subpixel, the G subpixel, and the B subpixel of the pixels C, D are restored.

By the above procedure, the restoration of the gradation values of the R subpixel, the G subpixel, and the B subpixel of the pixel D is completed. The gradation values of the R subpixel, the G subpixel, and the B subpixel of the pixel D are restored as eight-bit values.

Figure 28:
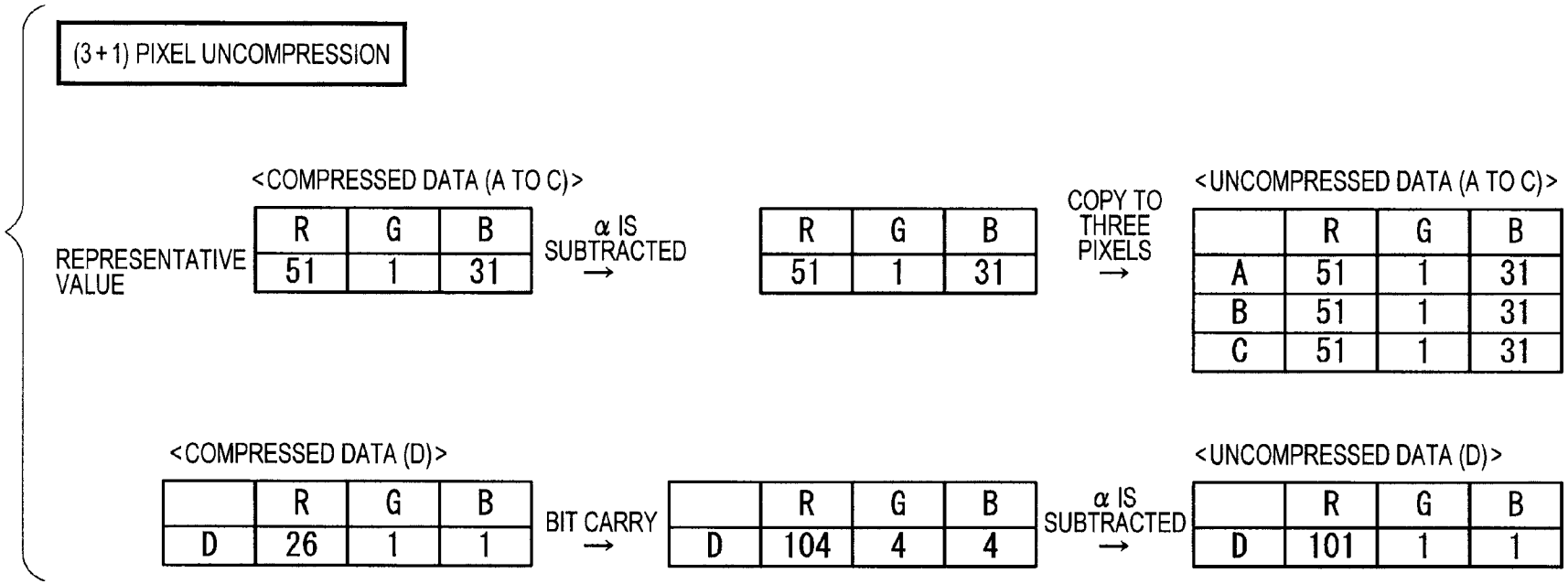
FIG. 28 is a conceptual diagram explaining uncompression processing of the (3+1) compressed data.

By the above procedure, the restoration of the gradation values of the R subpixels, the G subpixels, and the B subpixels of the pixels A to D is completed. If the image data of the pixels A to D in the right column of FIG. 28 are compared with the image data of the pixels A to D in the left column of FIG. 27, it will be understood that in the original image data of the pixels A to D are restored in general by the above-mentioned uncompression processing.

2-6. (4×1) Pixel Compression

Figure 29:
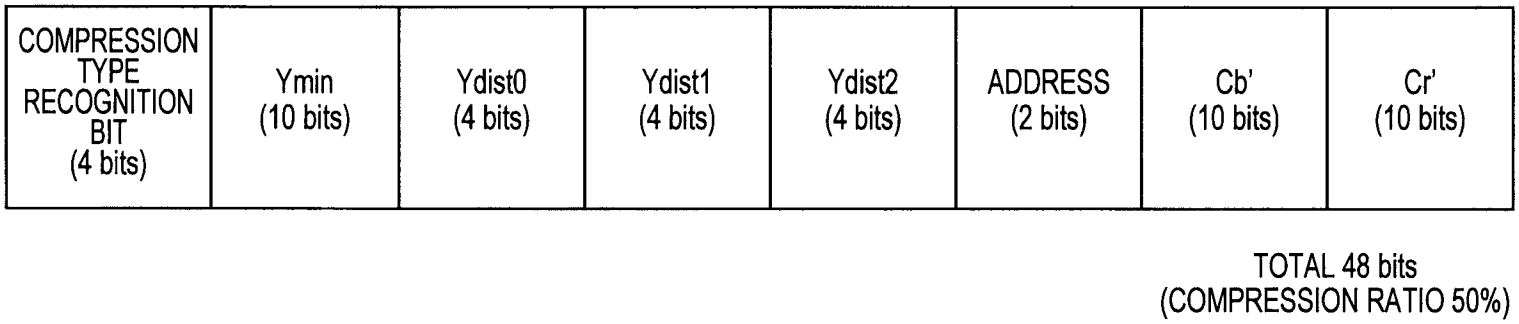
FIG. 29 is a diagram showing a format of (4×1) compressed data.

FIG. 29 is a conceptual diagram showing a format of the (4×1) compressed data. As described above, the (4×1) pixel compression is compression processing that is used when a high correlation exists between the image data of the four pixels of the object block.

As shown in FIG. 29, in this embodiment, the (4×1) compressed data includes the compression type recognition bit, and the following seven pieces of data: Ymin, Ydist0 to Ydist2, address data, Cb', and Cr'.

The compression type recognition bit is data indicating the type of the compression processing used for compression, and four bits are assigned to the compression type recognition bit in this embodiment.

Ymin, Ydist0 to Ydist2, the address data, Cb', and Cr' are data obtained by converting the RGB image data of the four pixels of the object block into YUV data and further performing the compression processing on the YUV data. Here, Ymin and Ydist0 to Ydist2 are data obtained from luminance data among YUV data of the four pixels of the object block, and Cr' and Cb' are data obtained from chrominance data. Ymin, Ydist0 to Ydist2, Cb', and Cr' are the representative values of the image data of the four pixels of the object block. As shown in FIG. 29, 10 bits are assigned to the data Ymin, four bits are assigned to each of Ydist0 to Ydist2, two bits are assigned to the address data, and 10 bits are assigned to each of Cb' and Cr'.

Below, the (4×1) pixel compression will be explained referring to FIG. 30. First, the luminance data Y and the chrominance data Cr and Cb are computed by the following matrix operation for each of the pixels A to D:

$$\begin{bmatrix} Y_k \\ Cr_k \\ Cb_k \end{bmatrix} = \begin{bmatrix} 1 & 2 & 1 \\ 0 & -1 & 1 \\ 1 & -1 & 0 \end{bmatrix} \begin{bmatrix} R_k \\ G_k \\ B_k \end{bmatrix}, \quad \text{[Formula 1]}$$

Here, $Y_k$ is luminance data of the pixel k and $Cr_k$, $Cb_k$ are chrominance data of the pixel k. Moreover, as described above, $R_k$, $G_k$, and $B_k$ are the gradation values of the R subpixel, the G subpixel, and the B subpixel of the pixel k, respectively.

Furthermore, Ymin, Ydist0 to Ydist2, the address data, Cb', and Cr' are created from the luminance data $Y_k$ and the chrominance data $Cr_k$, $Cb_k$ of the pixels A to D.

Ymin is defined as the minimum data (minimum luminance data) among pieces of the luminance data $Y_A$ to $Y_D$. Moreover, Ydist0 to Ydist2 are created by performing round-down processing of two bits on differences of pieces of the remaining luminance data and the minimum luminance data Ymin. The address data is generated as data indicating which luminance data of the pixels A to D is the minimum. In the example of FIG. 30, Ymin and Ydist0 to Ydist2 are computed by the following formulae: Ymin=$Y_D$=4, Ydist0=$(Y_A-\text{Ymin})>>2=(48-4)>>2=11$, Ydist1=$(Y_B-\text{Ymin})>>2=(28-4)>>2=6$, and Ydist2=$(Y_C-\text{Ymin})>>2=(16-4)>>2=3$, where ">>2" is an operator representing two-bit round-down processing. A fact that the luminance data $Y_D$ is the minimum is described in the address data.

Furthermore, Cr' is generated by performing one-bit round-down processing on a sum of $Cr_A$ to $Cr_D$, and similarly Cb' is generated by performing the one-bit round-down processing on a sum of $Cb_A$ to $Cb_D$. In the example of FIG. 30, Cr' and Cb' are computed by the following formulae: $Cr'=(Cr_A+Cr_B+Cr_C+Cr_D)>>1=(2+1-1+1)>>1=1$, $Cb'=(Cb_A+Cb_B+Cb_C+Cb_D)>>1=(-2-1+1-1)>>1=-1$, where ">>1" is an operator indicating the one-bit round-down processing. By the above procedure, the generation of the (4×1) compressed data is completed.

On the other hand, FIG. 31 is a diagram showing a scheme of generating the (4×1) uncompressed data by uncompressing the (4×1) compressed data. In uncompression of the (4×1) compressed data, first, the luminance data of the respective pixels A to D are restored from Ymin and Ydist0 to Ydist2. Below, the restored luminance data pieces of the pixels A to D are described as $Y_A'$ to $Y_D'$. More specifically, a value of the minimum luminance data Ymin is used as the luminance data of a pixel that is indicated as the minimum by the address data. Furthermore, the luminance data pieces of other pixels are restored by performing the two-bit bit advance processing on Ydist0 to Ydist2 and subsequently adding them to the minimum luminance data Ymin. In this embodiment, the luminance data $Y_A'$ to $Y_D'$ are restored by the following formulae: $Y_A'=Ydist0\times4+Ymin=44+4=48$, $Y_B'=Ydist1\times4+Ymin=24+4=28$, $Y_C'=Ydist2\times4+Ymin=12+4=16$, and $Y_D'=Ymin=4$.

Furthermore, the gradation values of the R, G, and B subpixels of the pixels A to D are restored from the luminance data $Y_A'$ to $Y_D'$ and the chrominance data Cr', Cb' by the following matrix operation:

$$\begin{bmatrix} R_k \\ G_k \\ B_k \end{bmatrix} = \begin{bmatrix} 1 & -1 & 3 \\ 1 & -1 & -1 \\ 1 & 3 & -1 \end{bmatrix} \begin{bmatrix} Y_k' \\ Cr' \\ Cb' \end{bmatrix} \gg 2, \quad \text{[Formula 2]}$$

Here, ">>2" is an operator indicating processing of omitting two bits. As will be understood from the above-mentioned formulae, the chrominance data Cr', Cb' are used in common in the restoration of the gradation values of the R, G, and B subpixels of the pixels A to D.

By the above procedure, the restoration of the gradation values of the R subpixel, the G subpixel, and the B subpixel of the pixels A to D is completed. If the values of the (4×1) uncompressed data of the pixels A to D in the right column of FIG. 31 are compared with the values of the original image data of the pixels A to D in the left column of FIG. 30, it will be understood that the original image data of the pixels A to D are restored in general by the above-mentioned uncompression processing.

2-7. Computation of Error Data α

Below, computation of the error data α used in the (1×4) pixel compression, the (2+1×2) pixel compression, the (2×2) pixel compression, and the (3+1) pixel compression will be explained.

Figures 32, 33:
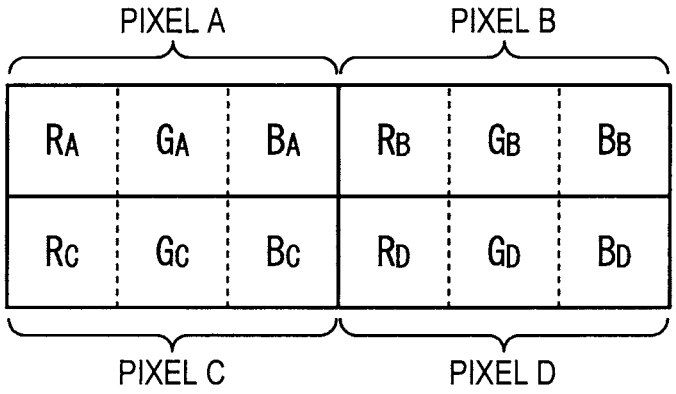
FIG. 32 is a diagram showing an example of a basic matrix used for generation of error data α.
FIG. 33 is a conceptual diagram showing another example of the configuration of the block that serves as a unit of the compression processing.

The error data α used in the bit plane reduction processing that is performed for each pixel in the (1×4) pixel compression, the (2+1×2) pixel compression, and the (3+1) pixel compression is computed from the basic matrix shown in FIG. 32 and the coordinates of the each pixel. Here, the basic matrix is a matrix that describes a relation of lower two bits x1, x0 of the x-coordinate and lower two bits y1, y2 of the y-coordinate of the pixel and a basic value Q of the error data α, and the basic value Q is a value used as a seed of the computation of the error data α.

In detail, first, based on lower two bits x1, x0 of the x-coordinate and lower two bits y1, y0 of the y-coordinate of the object pixel, the basic value Q is extracted from among matrix elements of the basic matrix. For example, in the case where the object of the bit plane reduction processing is the pixel A and the lower two bits of the coordinate of the pixel A is "00," "15" is extracted as the basic value Q.

Furthermore, according to the number of bits of the bit round-down processing successively performed in the bit plane reduction processing, the following operations are performed on the basic value Q and, thereby, the error data α is computed: α=Q×2 (the number of bits of the bit round-down processing is five), α=Q (the number of bits of the bit round-down processing is four), α=Q/2 (the number of bits of the bit round-down processing is three), and α=Q/4 (the number of bits of the bit round-down processing is two).

On the other hand, the error data α used in computation processing of the representative value of the image data of two pixels having a high correlation in the (2+1×2) pixel compression and the (2×2) pixel compression is computed from the basic matrix shown in FIG. 29 and lower second bits x1, y1 of the x-coordinate and the y-coordinate of the object two pixels. In detail, first, according to the combination of the object two pixels included in the object block, any one pixel of the object block is decided as a pixel used for extraction of the basic value Q. Below, the pixel used for extraction of the basic value Q is described as a Q extraction pixel. Relations of a combination of the object two pixels and the Q extraction pixel are as follows: In the case where the object two pixels are the pixels A, B: the Q extraction pixel is the pixel A; in the case where the object two pixels are the pixels A, C: the Q extraction pixel is the pixel A; in the case where the object two pixels are the pixels A, D: the Q extraction pixel is the pixel A; in the case where the object two pixels are the pixels B, C: the Q extraction pixel is the pixel B; in the case where the object two pixels are the pixels B, D: the Q extraction pixel is the pixel B; and in the case where the object two pixels are the pixels C, D: the Q extraction pixel is the pixel B.

Furthermore, according to the lower second bits x1, y1 of the x-coordinate and the y-coordinate of the object two pixels, the basic value Q corresponding to the Q extraction pixel is extracted from the basic matrix. For example, when the object two pixels are the pixels A, B, the Q extraction pixel is the pixel A. In this case, according to x1, y1, the basic value Q to be finally used is decided as follows from among the four basic values Q that are associated with the pixel A that is the Q extraction pixel in the basic matrix. Q=15 (x1=y1="0"), Q=01 (x1="1," y1="0"), Q=07 (x1="0," y1="1"), and Q=13 (x1=y1="1").

Furthermore, according to the number of bits of the bit round-down processing successively performed in the computation processing of the representative value, the following operation is performed on the basic value Q and, thereby, the error data α used in the computation processing of the representative value of the image data of two pixels having a high correlation is computed: α=Q/2 (the number of bits of the bit round-down processing is three), α=Q/4 (the number of bits of the bit round-down processing is two), and α=Q/8 (the number of bits of the bit round-down processing is one).

For example, in the case where the object two pixels are the pixels A, B, x1=y1="1," and the number of bits of the bit round-down processing is three, the error data α is decided by the following formula: Q=13, α=13/2=6.

Incidentally, the computation method of the error data α is not limited to what is described above. For example, as the basic matrix, another matrix that is the Bayer matrix is usable.

Although various embodiments of the present invention are described above, the present invention shall not be interpreted to be limited to the above-mentioned embodiments. For example, although the liquid crystal display having the liquid crystal display panel is presented in the embodiment described above, it is clear to a person skilled in the art that the present invention is also applicable to a display that drives a display panel that is required to charge the data lines (signal lines) at high speed, in addition to the liquid crystal display panel.

Moreover, although the object block is defined as pixels of one row and four columns in the embodiment described above, the object block may be defined as four pixels of an arbitrary arrangement. For example, as illustrated in FIG. 33, the object block may be defined as pixels of two rows and two columns. Even in this case, defining the pixels A, B, C, and D as shown in FIG. 33 enables the same processing as described above to be performed.

What is claimed is:

1. A display comprising a display panel, a driver, and a display control circuit configured to supply transfer compressed data generated from image data to the driver, wherein the display control circuit includes:

a first uncompression circuit configured to generate current frame uncompressed compressed data by performing uncompression processing on the current frame compressed data obtained by compression processing on image data of a current frame;

a second uncompression circuit configured to generate previous frame uncompressed compressed data by performing the uncompression processing on previous frame compressed data obtained by the compression processing on image data of a previous frame;

an overdrive processing part configured to generate overdrive processed data by performing overdrive processing based on the current frame uncompressed compressed data and the previous frame uncompressed compressed data;

an overdrive direction detection circuit configured to detect a proper direction of overdriving from the current frame uncompressed compressed data and the previous frame uncompressed compressed data;

a correction part configured to generate post-correction overdrive processed data by correcting the overdrive processed data according to the detected proper direction;

a first compression circuit configured to generate post-correction compressed data by performing the compression processing on the post-correction overdrive processed data;

a third uncompression circuit configured to generate post-correction uncompressed compressed data by performing the uncompression processing on the post-correction compressed data;

a transmission part configured to support an operation of transmitting the post-correction compressed data according to a comparison result of the current frame uncompressed compressed data and the post-correction uncompressed compressed data; and wherein the driver drives the display panel in response to display data obtained by uncompressing the post-correction compressed data.

2. The display according to claim 1, wherein the display control circuit further includes:

a second compression circuit configured to generate no-correction compressed data by performing the compression processing on the overdrive processed data generated by the overdrive processing part;

a fourth uncompression circuit configured to generate no-correction uncompressed compressed data by performing the uncompression processing on the no-correction compressed data, and a selection part configured to select the transfer compressed data from among plural pieces of selection data including the post-correction compressed data and the no-correction compressed data according to a comparison result of the current frame uncompressed compressed data and the no-correction uncompressed compressed data and the post-correction uncompressed compressed data.

3. The display according to claim 2, wherein when a gradation value of the no-correction uncompressed compressed data is larger than a gradation value of the current frame uncompressed compressed data corresponding thereto, the no-correction compressed data is selected as the transfer compressed data, and wherein when the gradation value of the no-correction uncompressed compressed data is smaller than the gradation value of the current frame uncompressed compressed data corresponding thereto, the post-correction compressed data is selected as the transfer compressed data.

4. The display according to claim 2, wherein the selection part selects the transfer compressed data from among the current frame compressed data, the post-correction compressed data, and the no-correction compressed data according to the comparison result of the current frame uncompressed compressed data and the no-correction uncompressed compressed data and the post-correction uncompressed compressed data.

5. The display according to claim 4, wherein the compression processing and the uncompression processing are performed for every block that includes a plurality of pixels, and wherein when a gradation value of the overdrive processed data of all the subpixels of all the pixels of a certain block is equal to the gradation value of the current frame uncompressed compressed data corresponding thereto, the selection part selects the current frame compressed data corresponding to the block as the transfer compressed data corresponding to the block.

6. The display according to claim 1, wherein when a gradation value of the current frame uncompressed compressed data is larger than a gradation value of the previous frame uncompressed compressed data, the correction part computes a gradation value of the post-correction overdrive processed data so that the gradation value of the post-correction overdrive processed data may be larger than or equal to a sum of the gradation value of the current frame uncompressed compressed data and an absolute value of a maximum compression error that can be generated by the compression processing and the uncompression processing, and wherein when the gradation value of the current frame uncompressed compressed data is smaller than the gradation value of the previous frame uncompressed compressed data, the correction part computes the gradation value of the post-correction overdrive processed data so that the gradation value of the post-correction overdrive processed data may be smaller than or equal to a difference obtained by subtracting the absolute value of the maximum compression error from the gradation value of the current frame uncompressed compressed data.

7. The display according to claim 1, wherein the display control circuit further includes:

a third compression circuit configured to generate the current frame compressed data by performing the compression processing on the image data of the current frame; and memory that receives the current frame compressed data from the third compression circuit and stores the data; and wherein the compressed data read from the memory is supplied to the second uncompression circuit as the previous frame compressed data.

* * * * *